US006172475B1

(12) United States Patent
Fitzgibbon et al.

(10) Patent No.: US 6,172,475 B1
(45) **Date of Patent: *Jan. 9, 2001**

(54) MOVABLE BARRIER OPERATOR

(75) Inventors: James J. Fitzgibbon, Streamwood, IL (US); Paul E. Wanis, San Diego, CA (US); Colin B. Willmott, Buffalo Grove, IL (US)

(73) Assignee: The Chamberlain Group, Inc., Elmhurst, IL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/161,840

(22) Filed: Sep. 28, 1998

(51) Int. Cl.[7] ..... E05F 15/18
(52) U.S. Cl. ..... 318/266; 318/461; 318/468
(58) Field of Search ..... 318/256, 265, 318/280–286, 461, 463, 466–470, 257, 266; 49/25–26, 28, 31; 160/188, 189, 291, 243.1

(56) References Cited

U.S. PATENT DOCUMENTS

| | | |
|---|---|---|
| 2,268,133 | 12/1941 | Carlson . |
| 3,147,001 | 9/1964 | Purdy . |
| 3,262,105 | 7/1966 | Bell . |
| 3,654,480 | 4/1972 | Stephenson . |

(List continued on next page.)

FOREIGN PATENT DOCUMENTS

| | | | |
|---|---|---|---|
| 297 06 251 U1 | 10/1997 | (DE) . | |
| 0 280 854 A1 | 9/1988 | (EP) | E05F/15/16 |
| 0 544 262 A2 | 6/1993 | (EP) | E05F/15/00 |
| 0 767 288 A1 | 4/1997 | (EP) | E05F/15/20 |
| 0 771 923 A2 | 5/1997 | (EP) | E05F/15/00 |
| 0 786 848 A1 | 7/1997 | (EP) | H02H/7/085 |
| 2122382 | 1/1984 | (GB) . | |
| 2245389 | 1/1992 | (GB) . | |
| WO 90/10776 | 9/1990 | (WO) . | |

*Primary Examiner*—Bentsu Ro
(74) *Attorney, Agent, or Firm*—Fitch, Even, Tabin & Flannery

(57) ABSTRACT

A movable barrier operator having improved safety and energy efficiency features automatically detects line voltage frequency and uses that information to set a worklight shut-off time. The operator automatically detects the type of door (single panel or segmented) and uses that information to set a maximum speed of door travel. The operator moves the door with a linearly variable speed from start of travel to stop for smooth and quiet performance. The operator provides for full door closure by driving the door into the floor when the DOWN limit is reached and no auto-reverse condition has been detected. The operator provides for user selection of a minimum stop speed for easy starting and stopping of sticky or binding doors.

6 Claims, 45 Drawing Sheets

U.S. PATENT DOCUMENTS

| | | | | |
|---|---|---|---|---|
| 4,064,404 | | 12/1977 | Willmott et al. | 307/141.4 |
| 4,263,536 | * | 4/1981 | Lee et al. | 318/266 |
| 4,348,625 | * | 9/1982 | Sharp | 318/757 |
| 4,369,399 | * | 1/1983 | Lee et al. | 318/467 |
| 4,467,249 | * | 8/1984 | Swearingen, Jr. | 318/282 |
| 4,565,029 | | 1/1986 | Kornbrekke et al. . | |
| 4,567,411 | * | 1/1986 | Reimann et al. | 318/341 |
| 4,597,428 | * | 7/1986 | Iha | 160/188 |
| 4,625,291 | | 11/1986 | Hormann . | |
| 4,638,433 | | 1/1987 | Schindler . | |
| 4,726,247 | | 2/1988 | Hormann . | |
| 4,727,679 | * | 3/1988 | Kornbrekke et al. | 49/138 |
| 4,868,409 | | 9/1989 | Tanaka et al. . | |
| 4,888,531 | | 12/1989 | Hörmann . | |
| 4,916,860 | | 4/1990 | Richmond et al. . | |
| 4,922,168 | | 5/1990 | Waggamon et al. . | |
| 4,952,080 | * | 8/1990 | Boiucaner et al. | 388/811 |
| 5,076,012 | | 12/1991 | Richmond et al. . | |
| 5,136,809 | | 8/1992 | Richmond et al. . | |
| 5,189,412 | | 2/1993 | Mehta et al. . | |
| 5,226,257 | | 7/1993 | Moss . | |
| 5,233,185 | | 8/1993 | Whitaker . | |
| 5,235,494 | | 8/1993 | Chang et al. . | |
| 5,241,873 | | 9/1993 | Hörmann . | |
| 5,282,337 | | 2/1994 | Duhame et al. . | |
| 5,470,185 | | 11/1995 | Tsubota et al. . | |
| 5,576,701 | | 11/1996 | Heitschel et al. . | |
| 5,589,747 | | 12/1996 | Utke . | |
| 5,596,840 | * | 1/1997 | Teich | 49/26 |
| 5,625,980 | | 5/1997 | Teich et al. . | |
| 5,656,900 | * | 8/1997 | Michel et al. | 318/286 |
| 5,661,804 | | 8/1997 | Dykema et al. . | |
| 5,774,065 | | 6/1998 | Mabuchi et al. . | |

* cited by examiner 200
80
282
280
32
E1
C1
J1
L1
C2
C3
TP2
+5V
L4
TP7
R2
R4
C5
C6
C7
TP1
Q4
R1
L5
TP4
TP3
R3
C4
L2
C8
C9
TP24
R6
R5
Q5
C11
C10
L3
C12
R9
TP25
R8
R7
C14
C13
TP23
R19
R18
R20
R21
B
A
TO FIG. 5C
D14
C18
R17
C39
U3
TP27
R16
C17
TP26
R15
C16
R12
R11
R10
TP11
R13
R14
C15

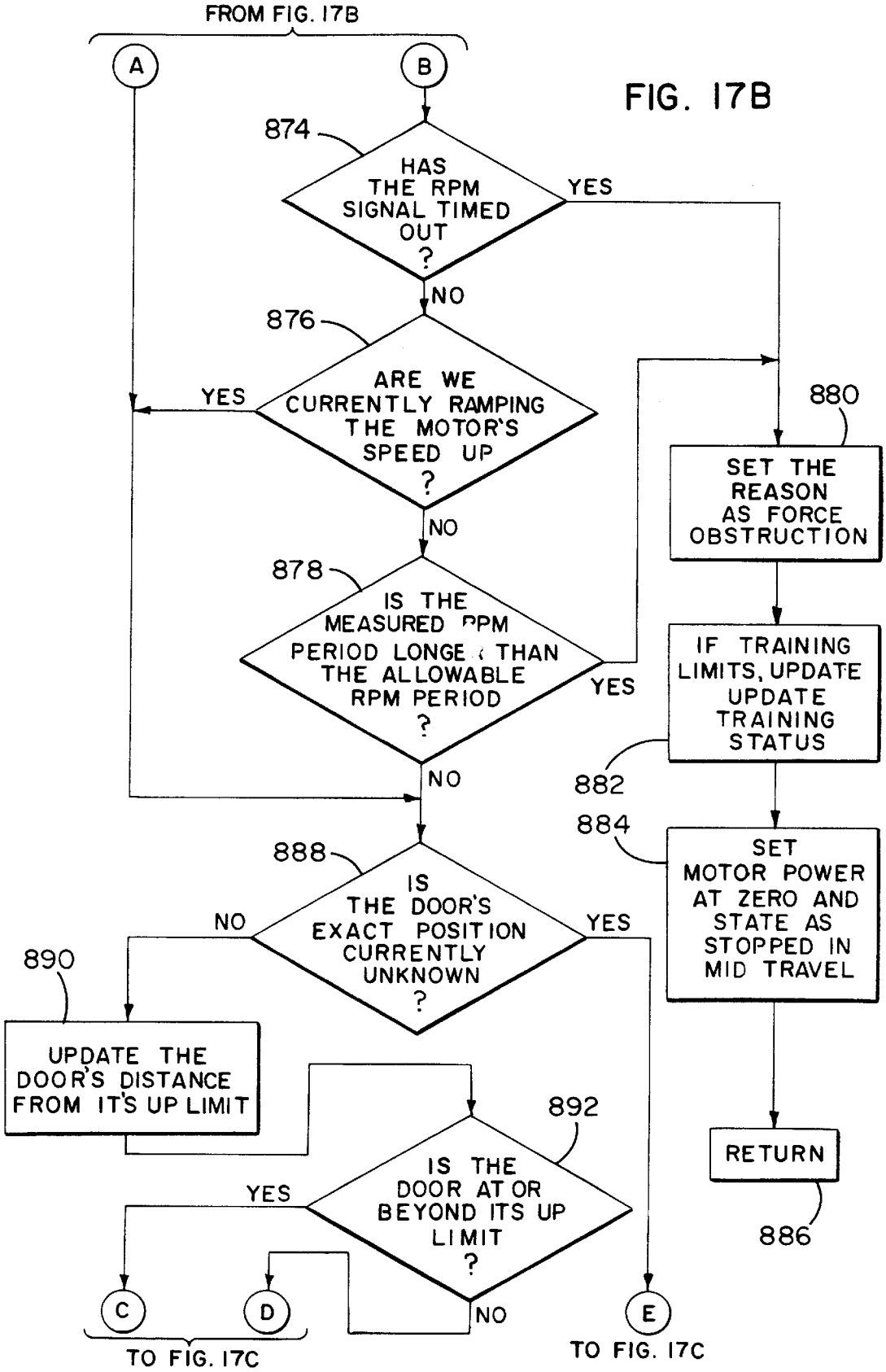
FROM FIG. 17B
A
B
FIG. 17B
874
HAS THE RPM SIGNAL TIMED OUT ?
YES
NO
876
ARE WE CURRENTLY RAMPING THE MOTOR'S SPEED UP ?
YES
NO
878
IS THE MEASURED RPM PERIOD LONGER THAN THE ALLOWABLE RPM PERIOD ?
YES
NO
880
SET THE REASON AS FORCE OBSTRUCTION
IF TRAINING LIMITS, UPDATE UPDATE TRAINING STATUS
882
884
SET MOTOR POWER AT ZERO AND STATE AS STOPPED IN MID TRAVEL
RETURN
886
888
IS THE DOOR'S EXACT POSITION CURRENTLY UNKNOWN ?
NO
YES
890
UPDATE THE DOOR'S DISTANCE FROM IT'S UP LIMIT
892
IS THE DOOR AT OR BEYOND ITS UP LIMIT ?
YES
NO
C
D
E
TO FIG. 17C
TO FIG. 17C

MOVABLE BARRIER OPERATOR

BACKGROUND OF THE INVENTION

This invention relates generally to movable barrier operators for operating movable barriers or doors. More particularly, it relates to garage door operators having improved safety and energy efficiency features.

Garage door operators have become more sophisticated over the years providing users with increased convenience and security. However, users continue to desire further improvements and new features such as increased energy efficiency, ease of installation, automatic configuration, and aesthetic features, such as quiet, smooth operation.

In some markets energy costs are significant. Thus energy efficiency options such as lower horsepower motors and user control over the worklight functions are important to garage door operator owners. For example, most garage door operators have a worklight which turns on when the operator is commanded to move the door and shuts off a fixed period of time after the door stops. In the United States, an illumination period of 4½ minutes is considered adequate. In markets outside the United States, 4½ minutes is considered too long. Some garage door operators have special safety features, for example, which enable the worklight whenever the obstacle detection beam is broken by an intruder passing through an open garage door. Some users may wish to disable the worklight in this situation. There is a need for a garage door operator which can be automatically configured for predefined energy saving features, such as worklight shut-off time.

Some movable barrier operators include a flasher module which causes a small light to flash or blink whenever the barrier is commanded to move. The flasher module provides some warning when the barrier is moving. There is a need for an improved flasher unit which provides even greater warning to the user when the barrier is commanded to move.

Another feature desired in many markets is a smooth, quiet motor and transmission. Most garage door operators have AC motors because they are less expensive than DC motors. However, AC motors are generally noisier than DC motors.

Most garage door operators employ only one or two speed of travel. Single speed operation, i.e., the motor immediately ramps up to full operating speed, can create a jarring start to the door. Then during closing, when the door approaches the floor at full operating speed, whether a DC or AC motor is used, the door closes abruptly with a high amount of tension on it from the inertia of the system. This jarring is hard on the transmission and the door and is annoying to the user.

If two operating speeds are used, the motor would be started at a slow speed, usually 20 percent of full operating speed, then after a fixed period of time, the motor speed would increase to full operating speed. Similarly, when the door reaches a fixed point above/below the close/open limit, the operator would decrease the motor speed to 20 percent of the maximum operating speed. While this two speed operation may eliminate some of the hard starts and stops, the speed changes can be noisy and do not occur smoothly, causing stress on the transmission. There is a need for a garage door operator which opens the door smoothly and quietly, with no aburptly apparent sign of speed change during operation.

Garage doors come in many types and sizes and thus different travel speeds are required for them. For example, a one-piece door will be movable through a shorter total travel distance and needs to travel slower for safety reasons than a segmented door with a longer total travel distance. To accommodate the two door types, many garage door operators include two sprockets for driving the transmission. At installation, the installer must determine what type of door is to be driven, then select the appropriate sprocket to attach to the transmission. This takes additional time and if the installer is the user, may require several attempts before matching the correct sprocket for the door. There is a need for a garage door operator which automatically configures travel speed depending on size and weight of the door.

National safety standards dictate that a garage door operator perform a safety reversal (auto-reverse) when an object is detected only one inch above the DOWN limit or floor. To satisfy these safety requirements, most garage door operators include an obstacle detection system, located near the bottom of the door travel. This prevents the door from closing on objects or persons that may be in the door path. Such obstacle detection systems often include an infrared source and detector located on opposite sides of the door frame. The obstacle detector sends a signal when the infrared beam between the source and detector is broken, indicating an obstacle is detected. In response to the obstacle signal, the operator causes an automatic safety reversal. The door stops and begins traveling up, away from the obstacle.

There are two different "forces" used in the operation of the garage door operator. The first "force" is usually preset or setable at two force levels: the UP force level setting used to determine the speed at which the door travels in the UP direction and the DOWN force level setting used to determine the speed at which the door travels in the DOWN direction. The second "force" is the force level determined by the decrease in motor speed due to an external force applied to the door, i.e., from an obstacle or the floor. This external force level is also preset or setable and is any set-point type force against which the feedback force signal is compared. When the system determines the set point force has been met, an auto-reverse or stop is commanded.

To overcome differences in door installations, i.e. stickiness and resistance to movement and other varying frictional-type forces, some garage door operators permit the maximum force (the second force) used to drive the speed of travel to be varied manually. This, however, affects the system's auto-reverse operation based on force. The auto-reverse system based on force initiates an auto-reverse if the force on the door exceeds the maximum force setting (the second force) by some predetermined amount. If the user increases the force setting to drive the door through a "sticky" section of travel, the user may inadvertently affect the force to a much greater value than is safe for the unit to operate during normal use. For example, if the DOWN force setting is set so high that it is only a small incremental value less than the force setting which initiates an auto-reverse due to force, this causes the door to engage objects at a higher speed before reaching the auto-reverse force setting. While the obstacle detection system will cause the door to auto-reverse, the speed and force at which the door hits the obstacle may cause harm to the obstacle and/or the door.

Barrier movement operators should perform a safety reversal off an obstruction which is only marginally higher than the floor, yet still close the door safely against the floor. In operator systems where the door moves at a high speed, the relatively large momentum of the moving parts, including the door, accomplishes complete closure. In systems with a soft closure, where the door speed decreases from full maximum to a small percentage of full maximum when closing, there may be insufficient momentum in the door or system to accomplish a full closure. For example, even if the door is positioned at the floor, there is sometimes sufficient play in the trolley of the operator to allow the door to move if the user were to try to open it. In particular, in systems employing a DC motor, when the DC motor is shut off, it becomes a dynamic brake. If the door isn't quite at the floor when the DOWN travel limit is reached and the DC motor is shut off, the door and associated moving parts may not have sufficient momentum to overcome the braking force of the DC motor. There is a need for a garage door operator which closes the door completely, eliminating play in the door after closure.

Many garage door operator installations are made to existing garage doors. The amount of force needed to drive the door varies depending on type of door and the quality of the door frame and installation. As a result, some doors are "stickier" than others, requiring greater force to move them through the entire length of travel. If the door is started and stopped using the full operating speed, stickiness is not usually a problem. However, if the garage door operator is capable of operation at two speeds, stickiness becomes a larger problem at the lower speed. In some installations, a force sufficient to run at 20 percent of normal speed is too small to start some doors moving. There is a need for a garage door operator which automatically controls force output and thus start and stop speeds.

SUMMARY OF THE INVENTION

A movable barrier operator having an electric motor for driving a garage door, a gate or other barrier is operated from a source of AC current. The movable barrier operator includes circuitry for automatically detecting the incoming AC line voltage and frequency of the alternating current. By automatically detecting the incoming AC line voltage and determining the frequency, the operator can automatically configure itself to certain user preferences. This occurs without either the user or the installer having to adjust or program the operator. The movable barrier operator includes a worklight for illuminating its immediate surroundings such as the interior of a garage. The barrier operator senses the power line frequency (typically 50 Hz or 60 Hz) to automatically set an appropriate shut-off time for a worklight. Because the power line frequency in Europe is 50 Hz and in the U.S. is 60 Hz, sensing the power line frequency enables the operator to configure itself for either a European or a U.S. market with no user or installer modifications. For U.S. users, the worklight shut-off time is set to preferably 4½ minutes; for European users, the worklight shut-off time is set to preferably 2½ minutes. Thus, a single barrier movement operator can be sold in two different markets with automatic setup, saving installation time.

The movable barrier operator of the present invention automatically detects if an optional flasher module is present. If the module is present, when the door is commanded to move, the operator causes the flasher module to operate. With the flasher module present, the operator also delays operation of the motor for a brief period, say one or two seconds. This delay period with the flasher module blinking before door movement provides an added safety feature to users which warns them of impending door travel (e.g. if activated by an unseen transmitter).

The movable barrier operator of the present invention drives the barrier, which may be a door or a gate, at a variable speed. After motor start, the electric motor reaches a preferred initial speed of 20 percent of the full operating speed. The motor speed then increases slowly in a linearly continuous fashion from 20 percent to 100 percent of full operating speed. This provides a smooth, soft start without jarring the transmission or the door or gate. The motor moves the barrier at maximum speed for the largest portion of its travel, after which the operator slowly decreases speed from 100 percent to 20 percent as the barrier approaches the limit of travel, providing a soft, smooth and quiet stop. A slow, smooth start and stop provides a safer barrier movement operator for the user because there is less momentum to apply an impulse force in the event of an obstruction. In a fast system, relatively high momentum of the door changes to zero at the obstruction before the system can actually detect the obstruction. This leads to the application of a high impulse force. With the system of the invention, a slower stop speed means the system has less momentum to overcome, and therefore a softer, more forgiving force reversal. A slow, smooth start and stop also provide a more aesthetically pleasing effect to the user, and when coupled with a quieter DC motor, a barrier movement operator which operates very quietly.

The operator includes two relays and a pair of field effect transistors (FETs) for controlling the motor. The relays are used to control direction of travel. The FET's, with phase controlled pulse width modulation, control start up and speed. Speed is responsive to the duration of the pulses applied to the FETs. A longer pulse causes the FETs to be on longer causing the barrier speed to increase. Shorter pulses result in a slower speed. This provides a very fine ramp control and more gentle starts and stops.

The movable barrier operator provides for the automatic measurement and calculation of the total distance the door is to travel. The total door travel distance is the distance between the UP and the DOWN limits (which depend on the type of door). The automatic measurement of door travel distance is a measure of the length of the door. Since shorter doors must travel at slower speeds than normal doors (for safety reasons), this enables the operator to automatically adjust the motor speed so the speed of door travel is the same regardless of door size. The total door travel distance in turn determines the maximum speed at which the operator will travel. By determining the total distance traveled, travel speeds can be automatically changed without having to modify the hardware.

The movable barrier operator provides full door or gate closure, i.e. a firm closure of the door to the floor so that the door is not movable in place after it stops. The operator includes a digital controller or processor, specifically a microcontroller which has an internal microprocessor, an internal RAM and an internal ROM and an external EEPROM. The microcontroller executes instructions stored in its internal ROM and provides motor direction control signals to the relays and speed control signals to the FETs. The operator is first operated in a learn mode to store a DOWN limit position for the door. The DOWN limit position of the door is used as an approximation of the location of the floor (or as a minimum reversal point, below which no auto-reverse will occur). When the door reaches the DOWN limit position, the microcontroller causes the electric motor to drive the door past the DOWN limit a small distance, say for one or two inches. This causes the door to close solidly on the floor.

The operator embodying the present invention provides variable door or gate output speed, i.e., the user can vary the minimum speed at which the motor starts and stops the door. This enables the user to overcome differences in door installations, i.e. stickiness and resistance to movement and other varying functional-type forces. The minimum barrier speeds in the UP and DOWN directions are determined by the user-configured force settings, which are adjusted using UP and DOWN force potentiometers. The force potentiometers set the lengths of the pulses to the FETs, which translate to variable speeds. The user gains a greater force output and a higher minimum starting speed to overcome differences in door installations, i.e. stickiness and resistance to movement and other varying functional-type forces speed, without affecting the maximum speed of travel for the door. The user can configure the door to start at a speed greater than a default value, say 20 percent. This greater start up and slow down speed is transferred to the linearly variable speed function in that instead of traveling at 20 percent speed, increasing to 100 percent speed, then decreasing to 20 percent speed, the door may, for instance, travel at 40 percent speed to 100 percent speed and back down to 40 percent speed.

BRIEF DESCRIPTION OF THE DRAWINGS

FIGS. 17A–17C are a flow chart of an UP direction routine executed in the microprocessor;

DETAILED DESCRIPTION OF THE PREFERRED EMBODIMENT

Figure 1:
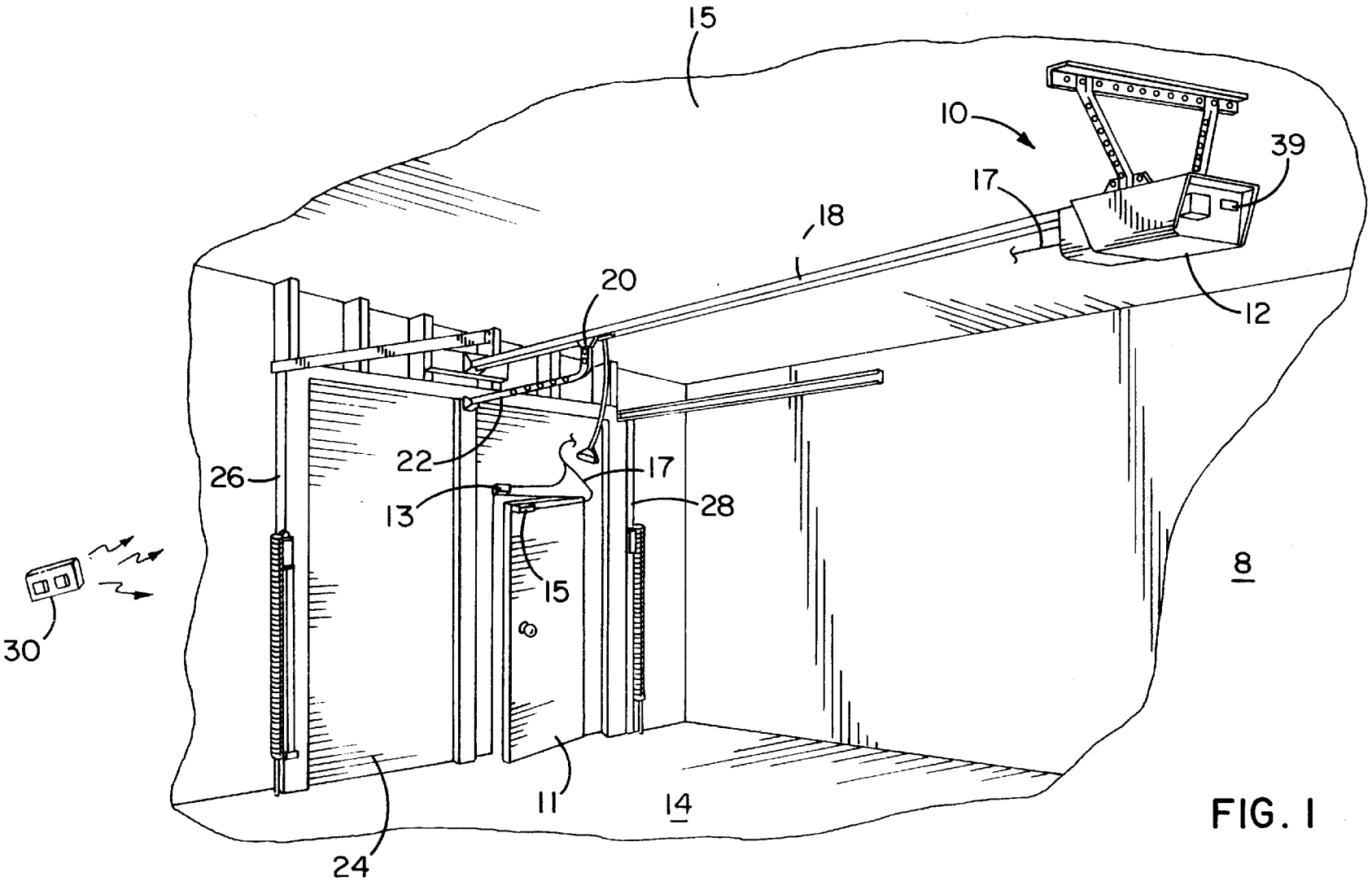
FIG. 1 is a perspective view of a garage having mounted within it a garage door operator embodying the present invention.

Referring now to the drawings and especially to FIG. 1, a movable barrier or garage door operator system is generally shown therein and referred to by numeral 8. The system 8 includes a movable barrier operator or garage door operator 10 having a head unit 12 mounted within a garage 14. More specifically, the head unit 12 is mounted to a ceiling 15 of the garage 14. The operator 10 includes a transmission 18 extending from the head unit 12 with a releasable trolley 20 attached. The releasable trolley 20 releasably connects an arm 22 extending to a single panel garage door 24 positioned for movement along a pair of door rails 26 and 28.

The system 8 includes a hand-held RF transmitter unit 30 adapted to send signals to an antenna 32 (see FIG. 4) positioned on the head unit 12 and coupled to a receiver within the head unit 12 as will appear hereinafter. A switch module 39 is mounted on the head unit 12. Switch module 39 includes switches for each of the commands available from a remote transmitter or from an optional wall-mounted switch (not shown). Switch module 39 enables an installer to conveniently request the various learn modes during installation of the head unit 12. The switch module 39 includes a learn switch, a light switch, a lock switch and a command switch, which are described below. Switch module 39 may also include terminals for wiring a pedestrian door state sensor comprising a pair of contacts 13 and 15 for a pedestrian door 11, as well as wiring for an optional wall switch (not shown).

The garage door 24 includes the pedestrian door 11. Contact 13 is mounted to door 24 for contact with contact 15 mounted to pedestrian door 11. Both contacts 13 and 15 are connected via a wire 17 to head unit 12. As will be described further below, when the pedestrian door 11 is closed, electrical contact is made between the contacts 13 and 15 closing a pedestrian door circuit in the receiver in head unit 12 and signalling that the pedestriam door state is closed. This circuit must be closed before the receiver will permit other portions of the operator to move the door 24. If circuit is open, indicating that the pedestrian door state is open, the system will not permit door 24 to move.

Figure 2:
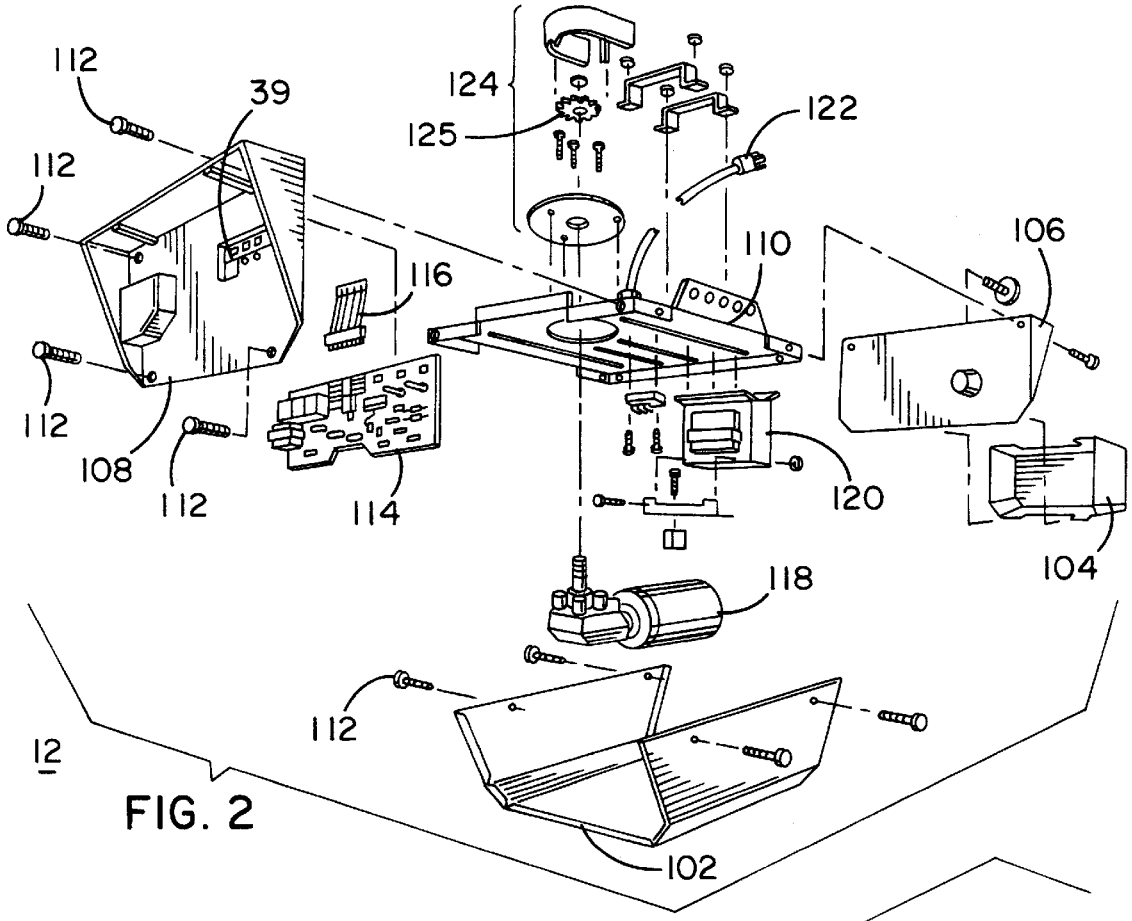
FIG. 2 is an exploded perspective view of a head unit of the garage door operator shown in FIG. 1.
Figure 3:
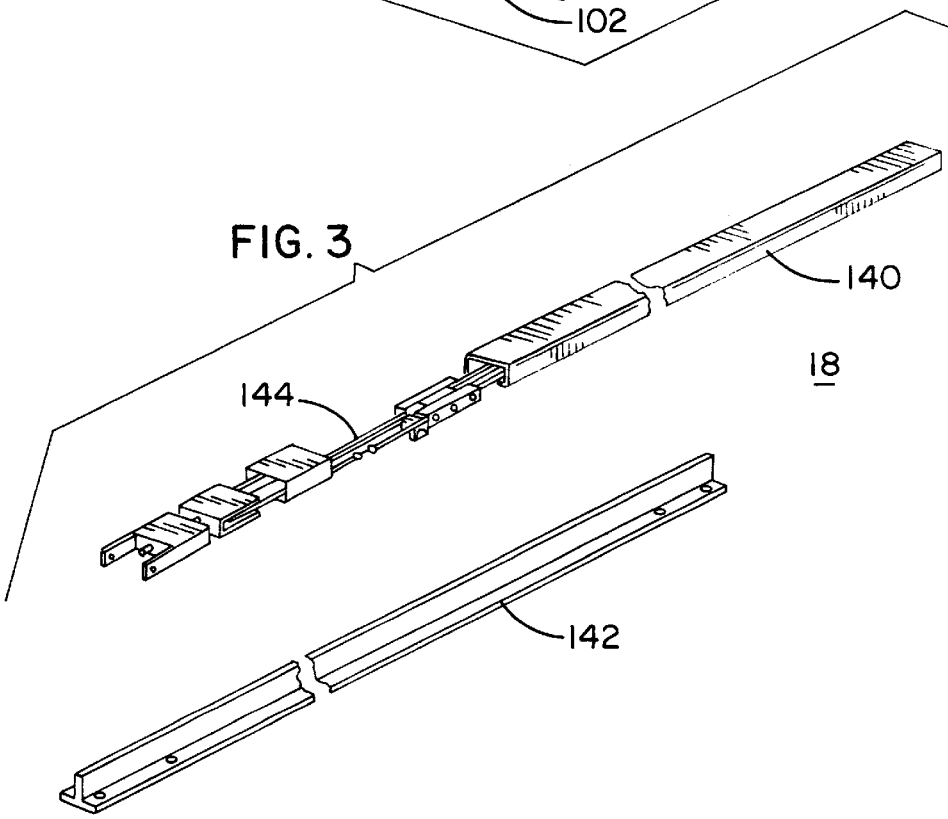
FIG. 3 is an exploded perspective view of a portion of a transmission unit of the garage door operator shown in FIG. 1.

The head unit 12 includes a housing comprising four sections: a bottom section 102, a front section 106, a back section 108 and a top section 110, which are held together by screws 112 as shown in FIG. 2. Cover 104 fits into front section 106 and provides a cover for a worklight. External AC power is supplied to the operator 10 through a power cord 122. The AC power is applied to a step-down transformer 120. An electric motor 118 is selectively energized by rectified AC power and drives a sprocket 125 in sprocket assembly 124. The sprocket 125 drives chain 144 (see FIG. 3). A printed circuit board 114 includes a controller 200 and other electronics for operating the head unit 12. A cable 116 provides input and output connections on signal paths between the printed circuit board 114 and switch module 39. The transmission 18, as shown in FIG. 3, includes a rail 142 which holds chain 144 within a rail and chain housing 140 and holds the chain in tension to transfer mechanical energy from the motor to the door.

Figure 4:
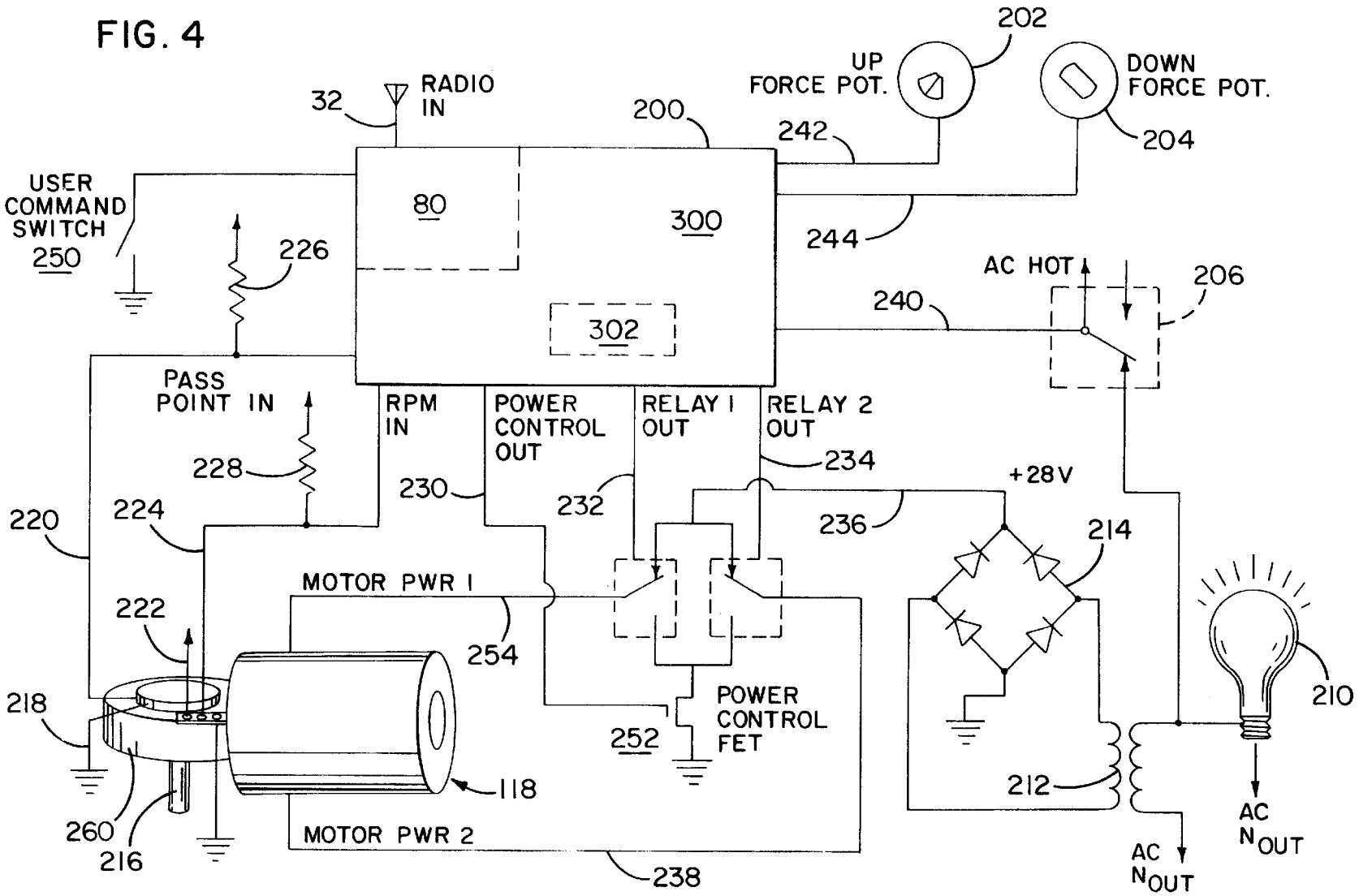
FIG. 4 is a block diagram of a controller and motor mounted within the head unit of the garage door operator shown in FIG. 1.

A block diagram of the controller and motor connections is shown in FIG. 4. Controller 200 includes an RF receiver 80, a microprocessor 300 and an EEPROM 302. RF receiver 80 of controller 200 receives a command to move the door and actuate the motor either from remote transmitter 30, which transmits an RF signal which is received by antenna 32, or from a user command switch 250. User command switch 250 can be a switch on switch panel 39, mounted on the head unit, or a switch from an optional wall switch. Upon receipt of a door movement command signal from either antenna 32 or user switch 250, the controller 200 sends a power enable signal via line 240 to AC hot connection 206 which provides AC line current to transformer 212 and power to work light 210. Rectified AC is provided from rectifier 214 via line 236 to relays 232 and 234. Depending on the commanded direction of travel, controller 200 provides a signal to either relay 232 or relay 234. Relays 232 and 234 are used to control the direction of rotation of motor 118 by controlling the direction of current flow through the windings. One relay is used for clockwise rotation; the other is used for counterclockwise rotation.

Upon receipt of the door movement command signal, controller 200 sends a signal via line 230 to power-control FET 252. Motor speed is determined by the duration or length of the pulses in the signal to a gate electrode of FET 252. The shorter the pulses, the slower the speed. This completes the circuit between relay 232 and FET 252 providing power to motor 118 via line 254. If the door had been commanded to move in the opposite direction, relay 234 would have been enabled, completing the circuit with FET 252 and providing power to motor 118 via line 238.

With power provided, the motor 118 drives the output shaft 216 which provides drive power to transmission sprocket 125. Gear reduction housing 260 includes an internal pass point system which sends a pass point signal via line 220 to controller 200 whenever the pass point is reached. The pass point signal is provided to controller 200 via current limiting resistor 226 to protect controller 200 from electrostatic discharge (ESD). An RPM interrupt signal is provided via line 224, via current limiting resistor 228, to controller 200. Lead 222 provides a plus five volts supply for the Hall effect sensors in the RPM module. Commanded force is input by two force potentiometers 202, 204. Force potentiometer 202 is used to set the commanded force for UP travel; force potentiometer 204 is used to set the commanded force for DOWN travel. Force potentiometers 202 and 204 provide commanded inputs to controller 200 which are used to adjust the length of the pulsed signal provided to FET 252.

Figure 21:
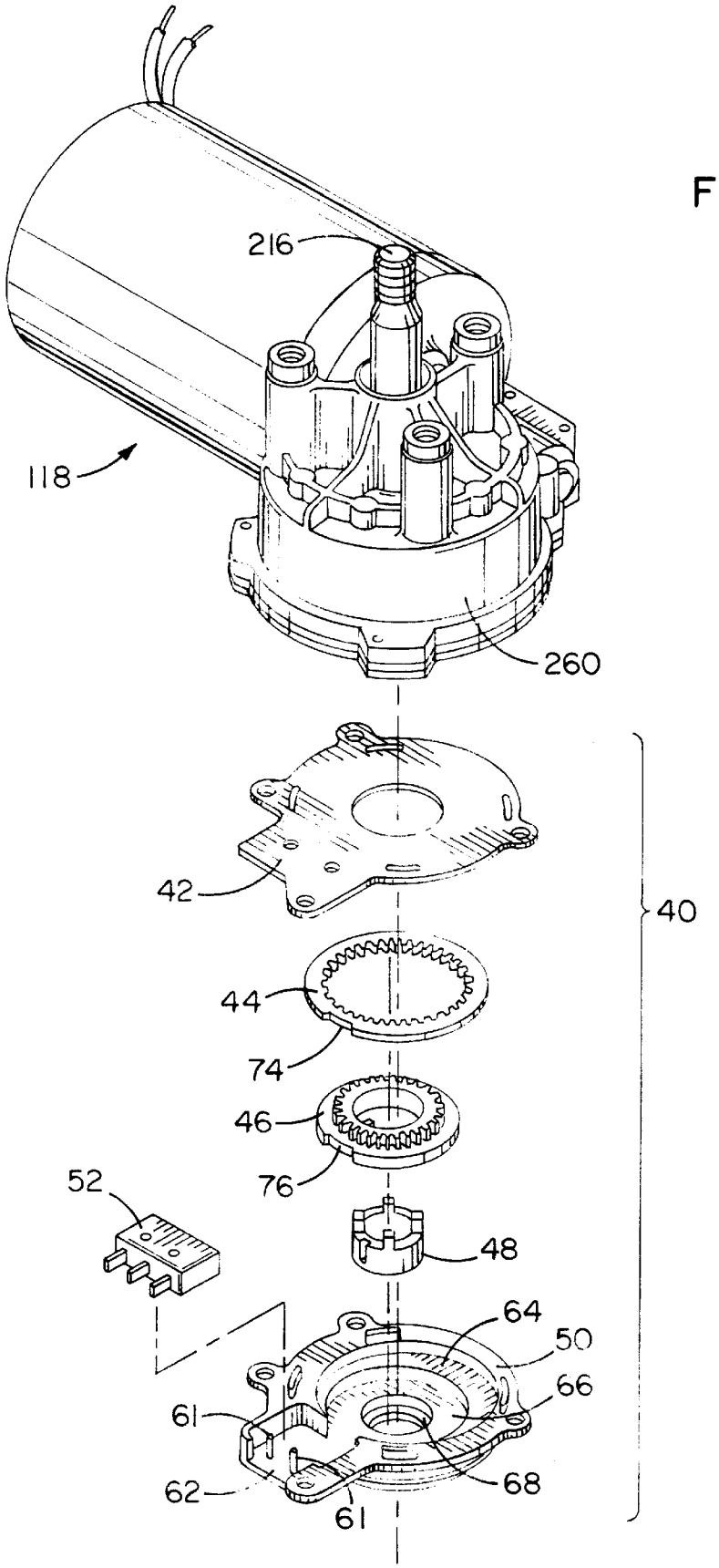
FIG. 21 is an exploded perspective view of a pass point detector and motor of the operator shown in FIG. 2.

The pass point for this system is provided internally in the motor 118. Referring to FIG. 21, the pass point module 40 is attached to gear reduction housing 260 of motor 118. Pass point module 40 includes upper plate 42 which covers the three internal gears and switch within lower housing 50. Lower housing 50 includes recess 62 having two pins 61 which position switch assembly 52 in recess 62. Housing 50 also includes three cutouts which are sized to support and provide for rotation of the three geared elements. Outer gear 44 fits rotatably within cutout 64. Outer gear 44 includes a smooth outer surface for rotating within housing 50 and inner gear teeth for rotating middle gear 46. Middle gear 46 fits rotatably within inner cutout 66. Middle gear 46 includes a smooth outer surface and a raised portion with gear teeth for being driven by the gear teeth of outer ring gear 44. Inner gear 48 fits within middle gear 46 and is driven by an extension of shaft 216 (FIG. 4). Rotation of the motor 118 causes shaft 216 to rotate and drive inner gear 48.

Figure 22A:
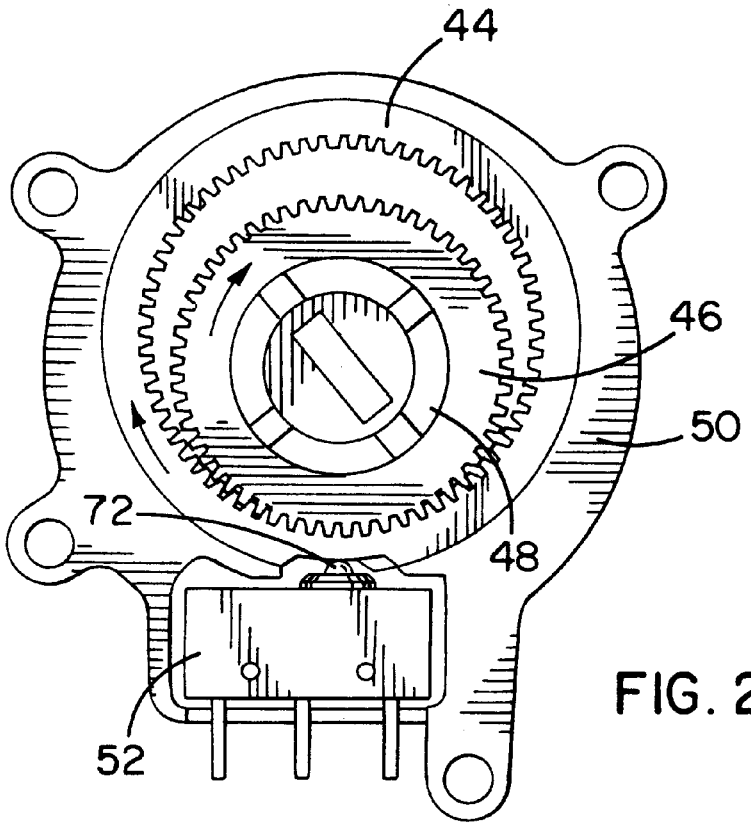
FIG. 22A is a plan view of the pass point detector shown in FIG. 21.
Figure 22B:
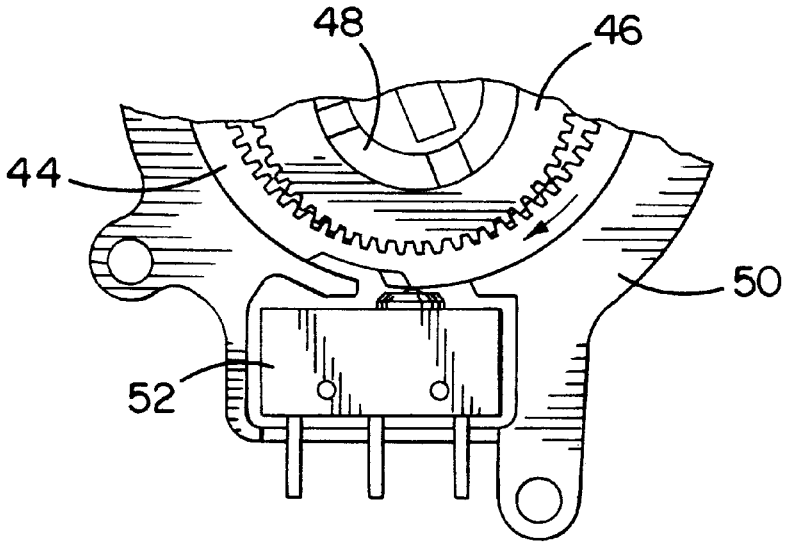
FIG. 22B is a partial plan view of the pass point detector shown in FIG. 21.

Outer gear 44 includes a notch 74 in the outer periphery. Middle gear includes a notch 76 in the outer periphery. Referring to FIG. 22A, rotation of inner gear 48 rotates middle gear 46 in the same direction. Rotation of middle gear 46 rotates outer gear 44 in the same direction. Gears 46 and 44 are sized such that pass point indications comprising switch release cutouts 74 and 76 line up only once during the entire travel distance of the door. As seen in FIG. 22A, when switch release cutouts 74 and 76 line up, switch 72 is open generating a pass point presence signal. The location where switch release cutouts 74 and 76 line up is the pass point. At all other times, at least one of the two gears holds switch 72 closed generating a signal indicating that the pass point has not been reached.

Figure 5A:
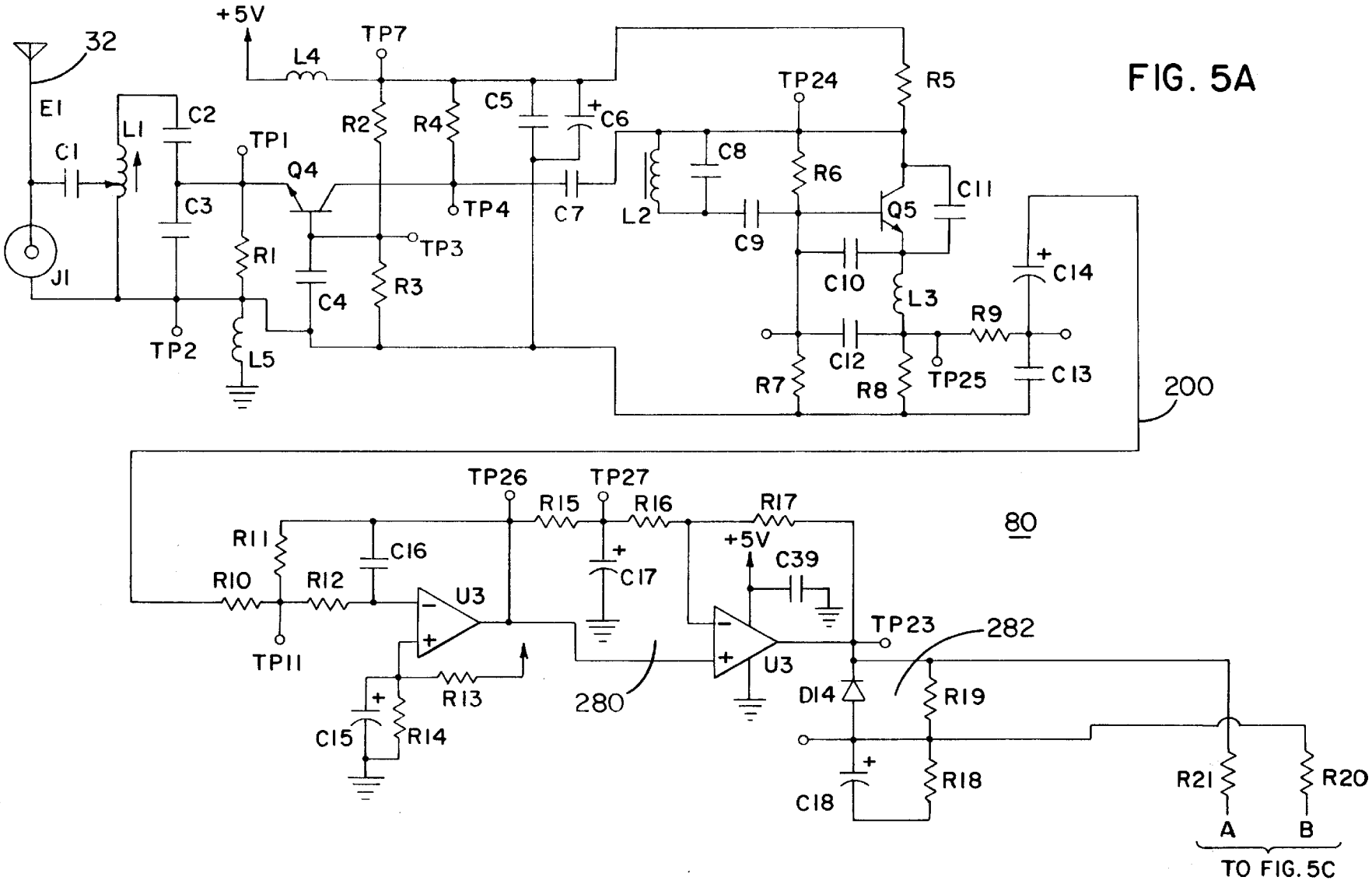
FIGS. 5A–5D are a schematic diagram of the controller shown in block format in FIG. 4.
Figure 5B:
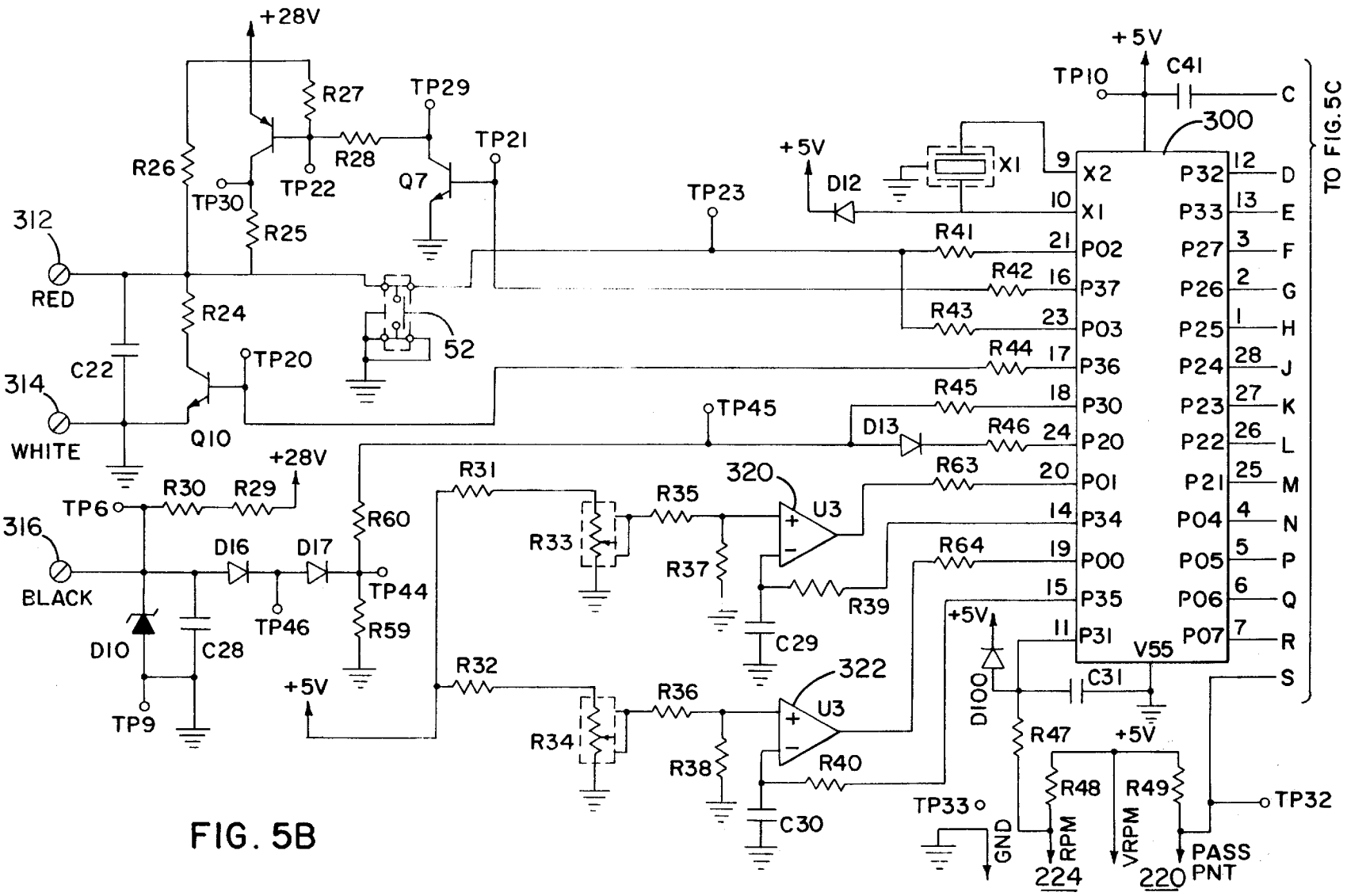
Figure 5C:
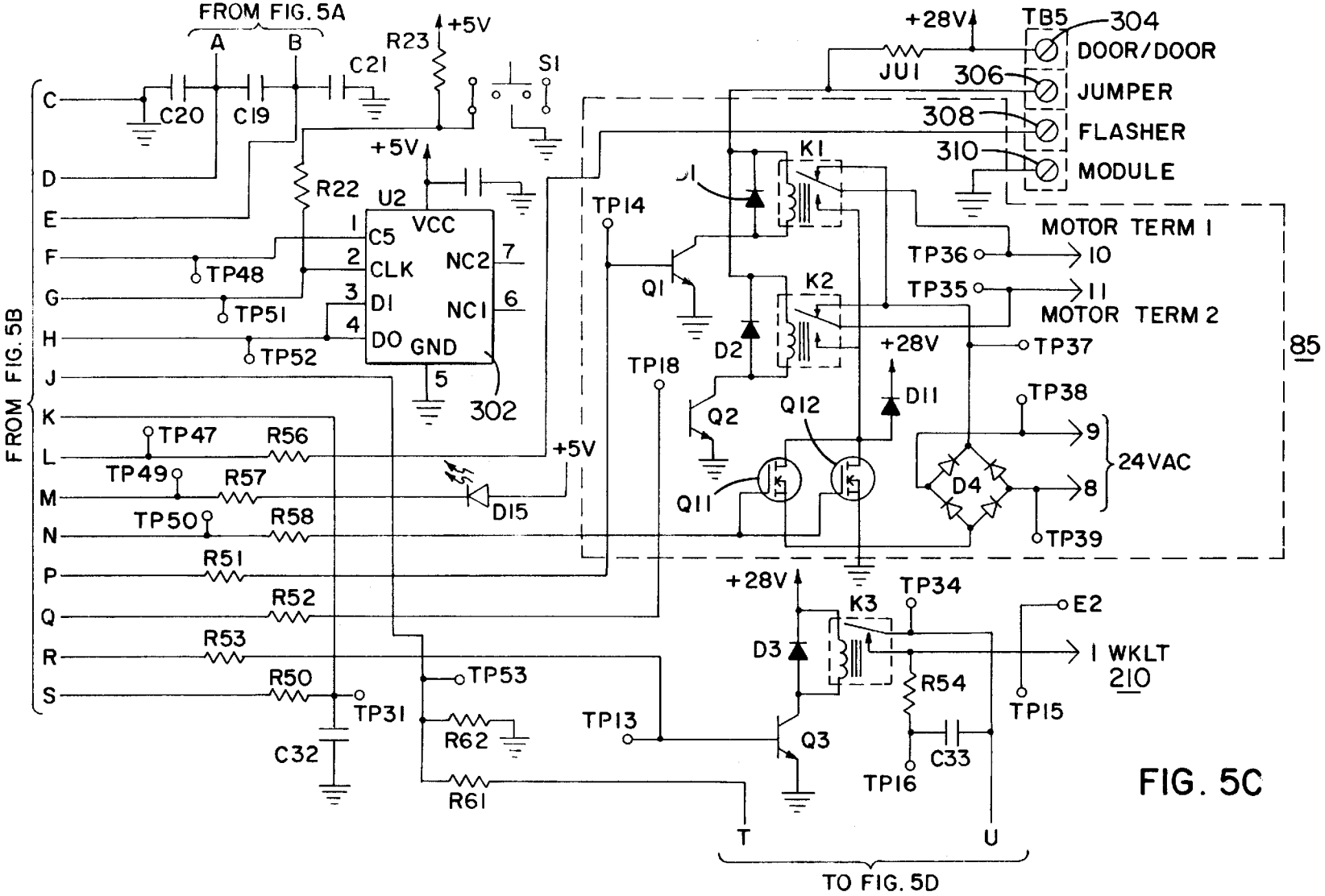

The receiver portion 80 of controller 200 is shown in FIG. 5A. RF signals may be received by the controller 200 at the antenna 32 and fed to the receiver 80. The receiver 80 includes variable inductor L1 and a pair of capacitors C2 and C3 that provide impedance matching between the antenna 32 and other portions of the receiver. An NPN transistor Q4 is connected in common-base configuration as a buffer amplifier. Bias to the buffer amplifier transistor Q4 is provided by resistors R2, R3. The buffered RF output signal is supplied to a second NPN transistor Q5. The radio frequency signal is coupled to a bandpass amplifier 280 to an average detector 282 which feeds a comparator 284. Referring to FIGS. 5C and 5B, the analog output signal A, B is applied to noise reduction capacitors C19, C20 and C21 then provided to pins P32 and P33 of the microcontroller 300. Microcontroller 300 may be a Z86733 microprocessor.

Figure 5D:
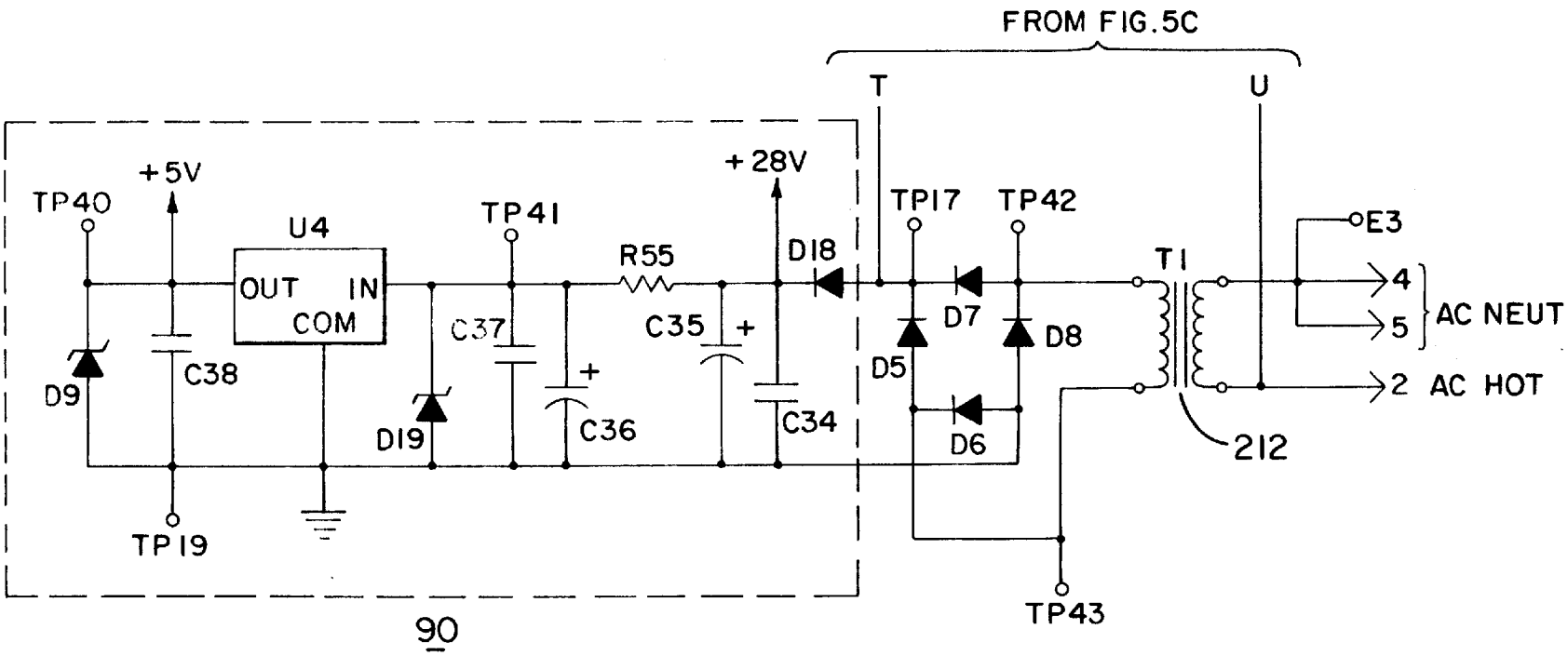

As can be seen in FIG. 5D, an external transformer 212 receives AC power from a source such as a utility and steps down the AC voltage to the power supply 90 circuit of controller 200. Transformer 212 provides AC current to full-wave bridge circuit 214, which produces a 28 volt full wave rectified signal across capacitor C35. The AC power may have a frequency of 50 Hz or 60 Hz. An external transformer is especially important when motor 118 is a DC motor. The 28 volt rectified signal is used to drive a wall control switch, an obstacle detector circuit, a door-in-door switch and to power FETs Q11 and Q12 (FIG. 5C) used to start the motor. Zener diode D18 protects against overvoltage due to the pulsed current, in particular, from the FETs rapidly switching off inductive load of the motor. The potential of the full-wave rectified signal is further reduced to provide 5 volts at capacitor C38, which is used to power the microprocessor 300, the receiver circuit 80 and other logic functions.

The 28 volt rectified power supply signal indicated by reference numeral T in FIG. 5C is voltage divided down by resistors R61 and R62, then applied to an input pin P24 of microprocessor 300 (FIG. 5B). This signal is used to provide the phase of the power line current to microprocessor 300. Microprocessor 300 constantly checks for the phase of the line voltage in order to determine if the frequency of the line voltage is 50 Hz or 60 Hz. This information is used to establish the worklight time-out period and to select the look-up table stored in the ROM in the microcontroller for converting pulse width to door speed.

When the door is commanded to move, either through a signal from a remote transmitter received through antenna 32 and processed by receiver 80, or through an optional wall switch, the microprocessor 300 commands the work light to turn on. Microprocessor 300 (FIG. 5B) sends a worklight enable signal from pin P07. In FIG. 5C, the worklight enable signal is applied to the base of transistor Q3, which drives relay K3. AC power from a signal U provides power for operating the worklight 210.

Microprocessor 300 reads from and writes data to an EEPROM 302 via its pins P25, P26 and P27. EEPROM 302 may be a 93C46. Microprocessor 300 provides a light enable signal at pin P21 which is used to enable a learn mode indicator yellow LED D15. LED D15 is enables or lit when the receiver is in the learn mode. Pin P26 provides double duty. When the user selects switch S1, a learn enable signal is provided to both microprocessor 300 and EEPROM 302. Switch S1 is mounted on the head unit 12 and is part of switch module 39, which is used by the installer to operate the system.

An optional flasher module provides an additional level of safety for users and is controlled by microprocessor 300 at pin P22. The optional flasher module is connected between terminals 308 and 310. In the optional flasher module, after receipt of a door command, the microprocessor 300 sends a signal from P22 which causes the flasher light to blink for 2 seconds. The door does not move during that 2 second period, giving the user notice that the door has been commanded to move and will start to move in 2 seconds. After expiration of the 2 second period, the door moves and the flasher light module blinks during the entire period of door movement. If the operator does not have a flasher module installed in the head unit, when the door is commanded to move, there is no time delay before the door begins to move.

Microprocessor 300 provides the signals which start motor 118, control its direction of rotation (and thus the direction of movement of the door) and the speed of rotation (speed of door travel). FETs Q11 and Q12 are used to start motor 118. Microprocessor 300 applies a pulsed output signal to the gates of FETs Q11 and Q12. The lengths of the pulses determine the time the FETs conduct and thus the amount of time current is applied to start and run the motor 118. The longer the pulse, the longer current is applied, the greater the speed of rotation the motor 118 will develop. Diode D11 is coupled between the 28 volt power supply and is used to clean up flyback voltage to the input bridge D4 when the FETs are conducting. Similarly, Zener diode D19 (see FIG. 5D) is used to protect against overvoltage when the FETs are conducting.

Control of the direction of rotation of motor 118 (and thus direction of travel of the door) is accomplished with two relays, K1 and K2 (FIG. 5C). Relay K1 supplies current to cause the motor to rotate clockwise in an opening direction (door moves UP); relay K2 supplies current to cause the motor to rotate counterclockwise in a closing direction (door moves DOWN). When the door is commanded to move UP, the microprocessor 300 sends an enable signal from pin P05 to the base of transistor Q1, which drives relay K1. When the door is commanded to move DOWN, the microprocessor 300 sends an enable signal from pin P06 to the base of transistor Q2, which drives relay K2.

Door-in-door contacts 13 and 15 are connected to terminals 304 and 306. Terminals 304 and 306 are connected to relays K1 and K2. If the signal between contacts 13 and 15 is broken, the signal across terminals 304 and 306 is open, preventing relays K1 and K2 from energizing. The motor 118 will not rotate and the door 24 will not move until the user closes pedestrian door 11, making contact between contacts 13 and 15.

In FIG. 5B, the pass point signal 220 from the pass point module 40 (see FIG. 21) of motor 118 is applied to pin P23 of microprocessor 300. The RPM signal 224 from the RPM sensor module in motor 118 is applied to pin P31 of microprocessor 300. Application of the pass point signal and the RPM signal is described with reference to the flow charts.

An optional wall control, which duplicates the switches on remote transmitter 30, may be connected to controller 200 at terminals 312 and 314. When the user presses the door command switch 39, a dead short is made to ground, which the microprocessor 300 detects by the failure to detect voltage. Capacitor C22 is provided for RF noise reduction. The dead short to ground is sensed at pins P02 and P03, for redundancy.

Switches S1 and S2 are part of switch module 39 mounted on head unit 12 and used by the installer for operating the system. As stated above, S1 is the learn switch. S2 is the door command switch. When S2 is pressed, microprocessor 300 detects the dead short at pins P02 and P03.

Input from an obstacle detector (not shown) is provided at terminal 316. This signal is voltage divided down and provided to microprocessor 300 at pins P20 and P30, for redundancy. Except when the door is moving and less than an inch above the floor, when the obstacle detector senses an object in the doorway, the microprocessor executes the auto-reverse routine causing the door to stop and/or reverse depending on the state of the door movement.

Force and speed of door travel are determined by two potentiometers. Potentiometer R33 adjusts the force and speed of UP travel; potentiometer R34 adjusts the force and speed of DOWN travel. Potentiometers R33 and R34 act as analog voltage dividers. The analog signal from R33, R34 is further divided down by voltage divider R35/R37, R36/R38 before it is applied to the input of comparators 320 and 322. Reference pulses from pins P34 and P35 of microprocessor 300 are compared with the force input from potentiometers R33 and R34 in comparators 320 and 322. The output of comparators 320 and 322 is applied to pins P01 and P00.

To perform the A/D conversion, the microprocessor 300 samples the output of the comparators 320 and 322 at pins P00 and P01 to determine which voltage is higher: the voltage from the potentiometer R33 or R34 (IN) or the voltage from the reference pin P34 or P35 (REF). If the potentiometer voltage is higher than the reference, then the microprocessor outputs a pulse. If not, the output voltage is held low. The RC filter (R39, C29/R40, C30) converts the pulses into a DC voltage equivalent to the duty cycle of the pulses. By outputting the pulses in the manner described above, the microprocessor creates a voltage at REF which dithers around the voltage at IN. The microprocessor then calculates the duty cycle of the pulse output which directly correlates to the voltage seen at IN.

Figure 6A:
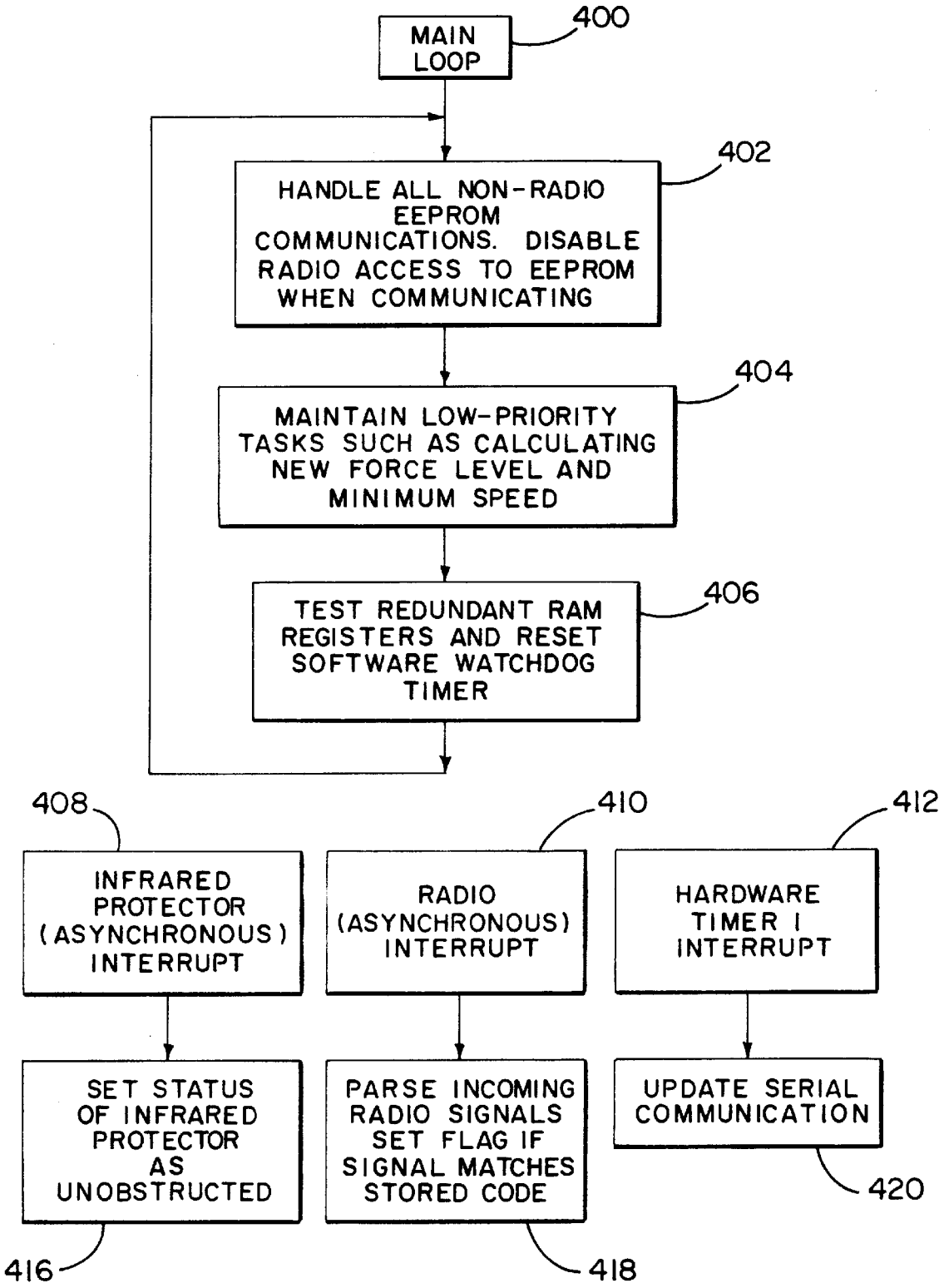
FIGS. 6A–6B are a flow chart of an overall routine that executes in a microprocessor of the controller shown in FIGS. 5A–5D.
Figure 6B:
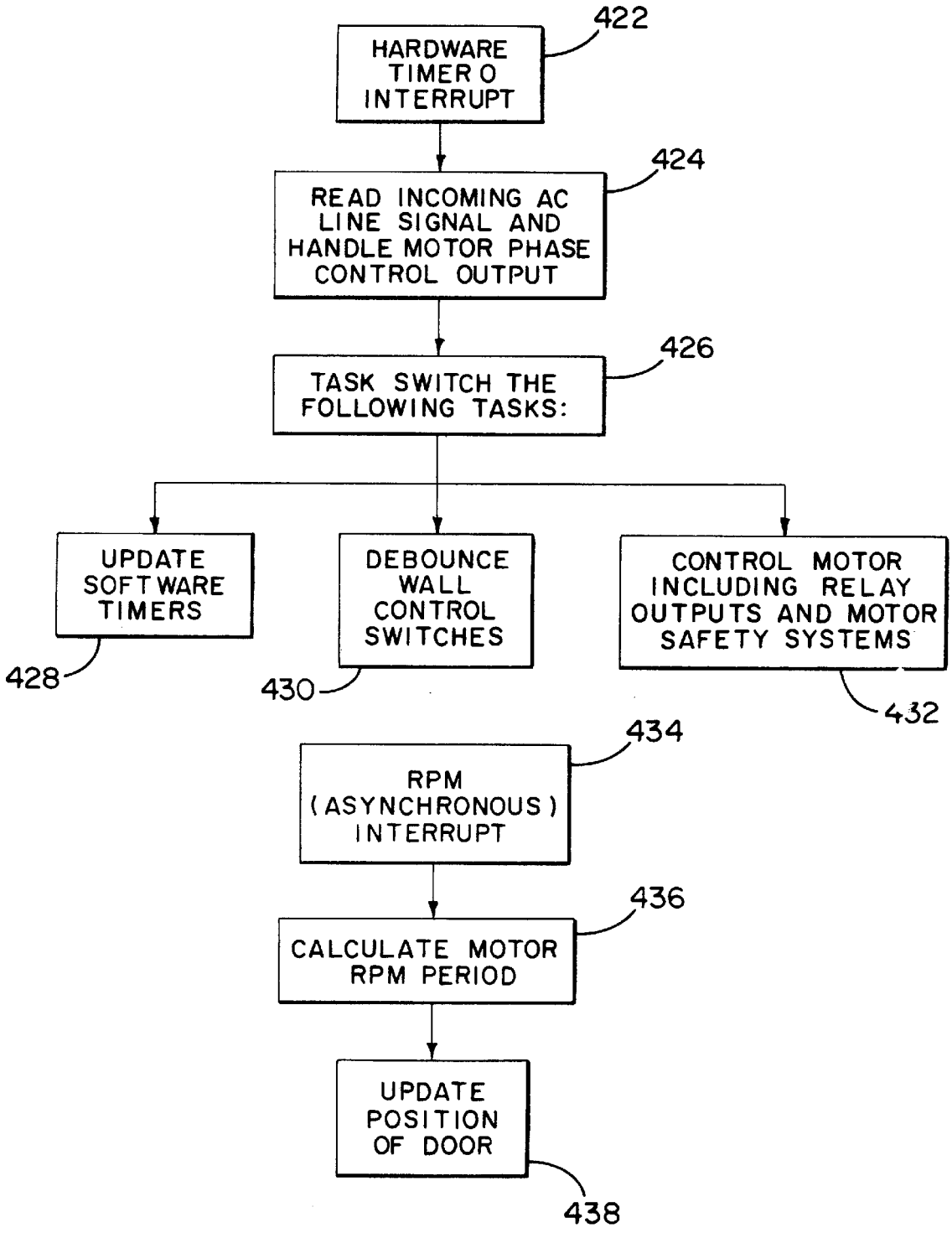
Figure 7A:
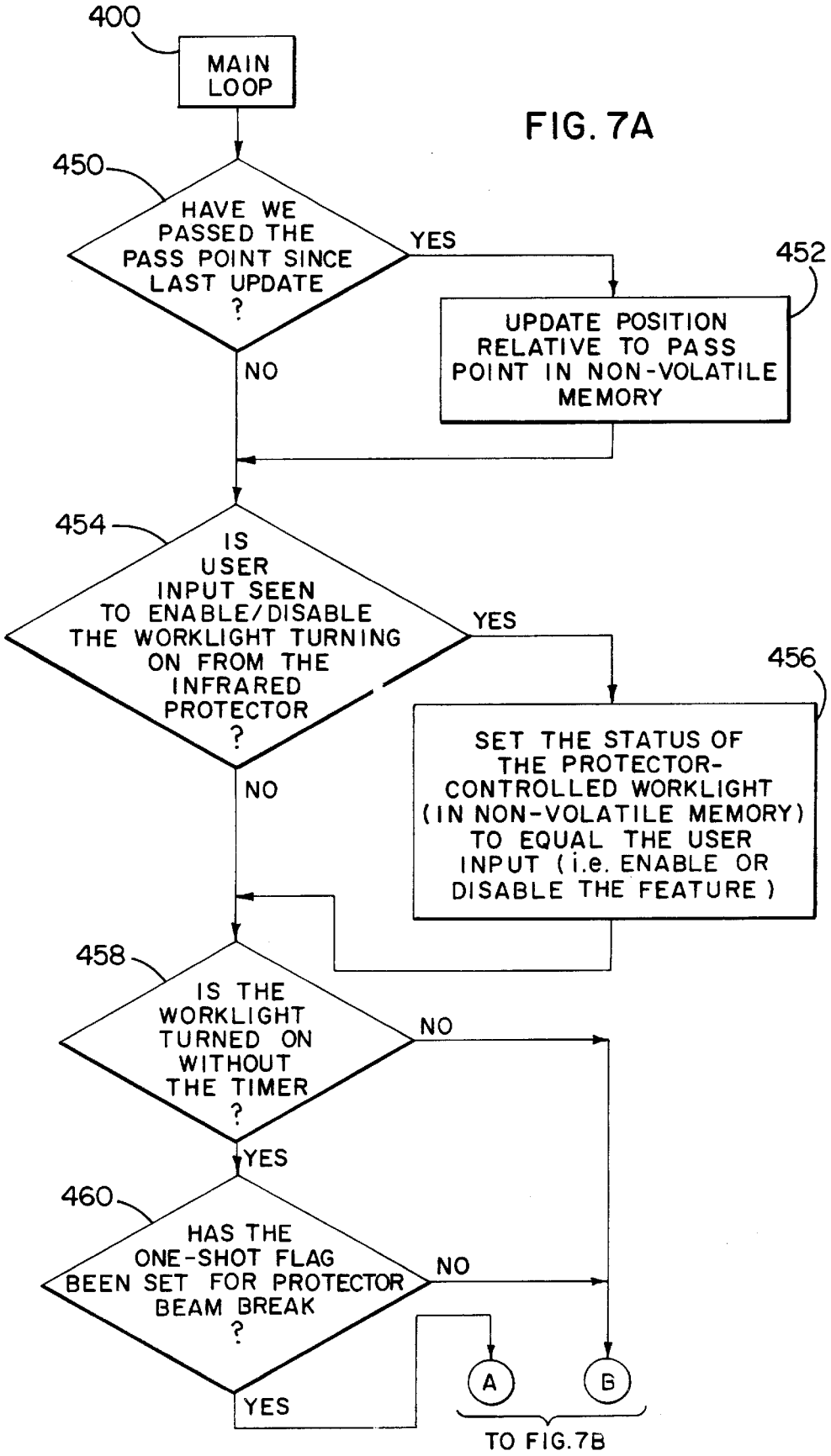
FIGS. 7A–7H are a flow chart of the main routine executed in the microprocessor.
Figure 7B:
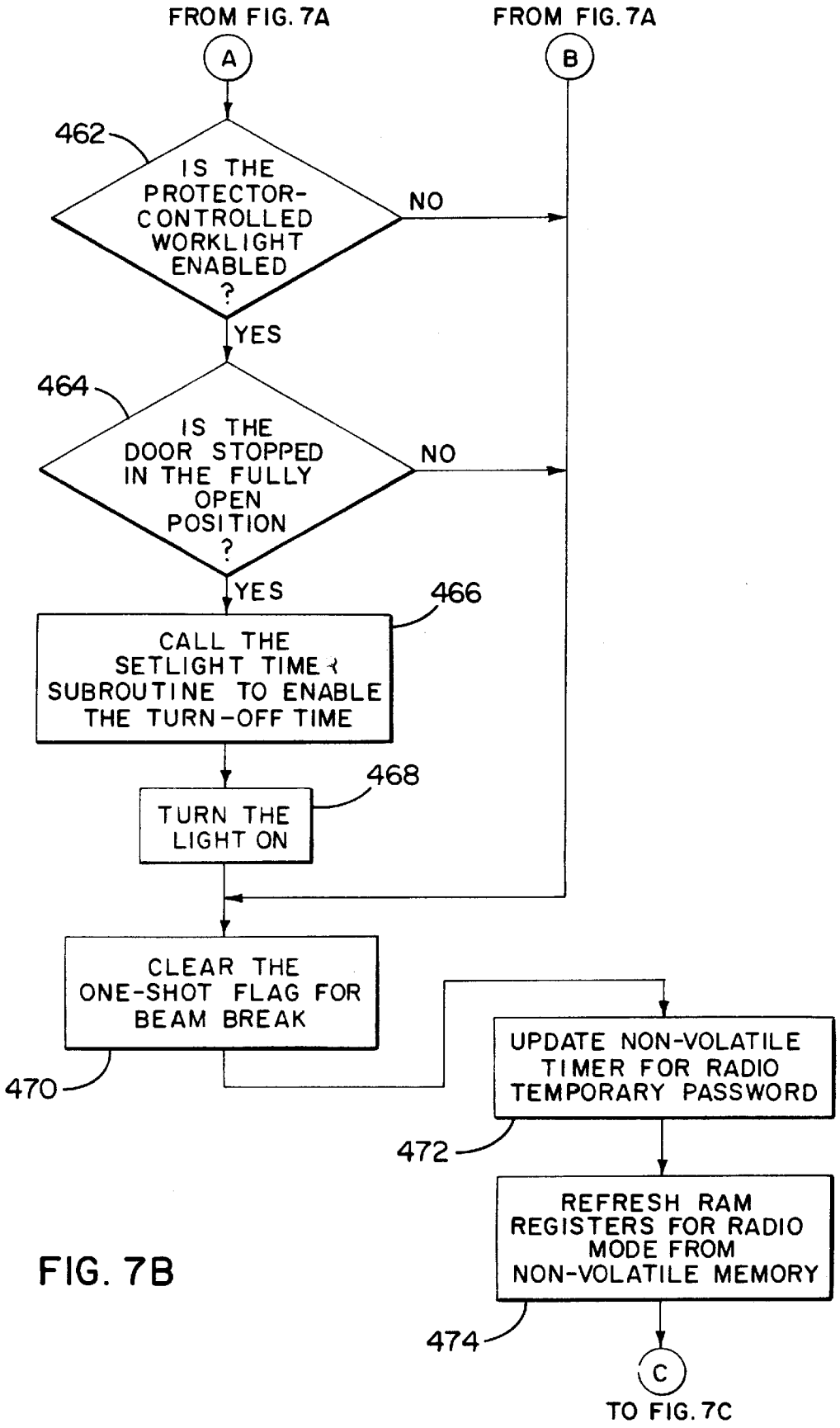
Figure 7C:
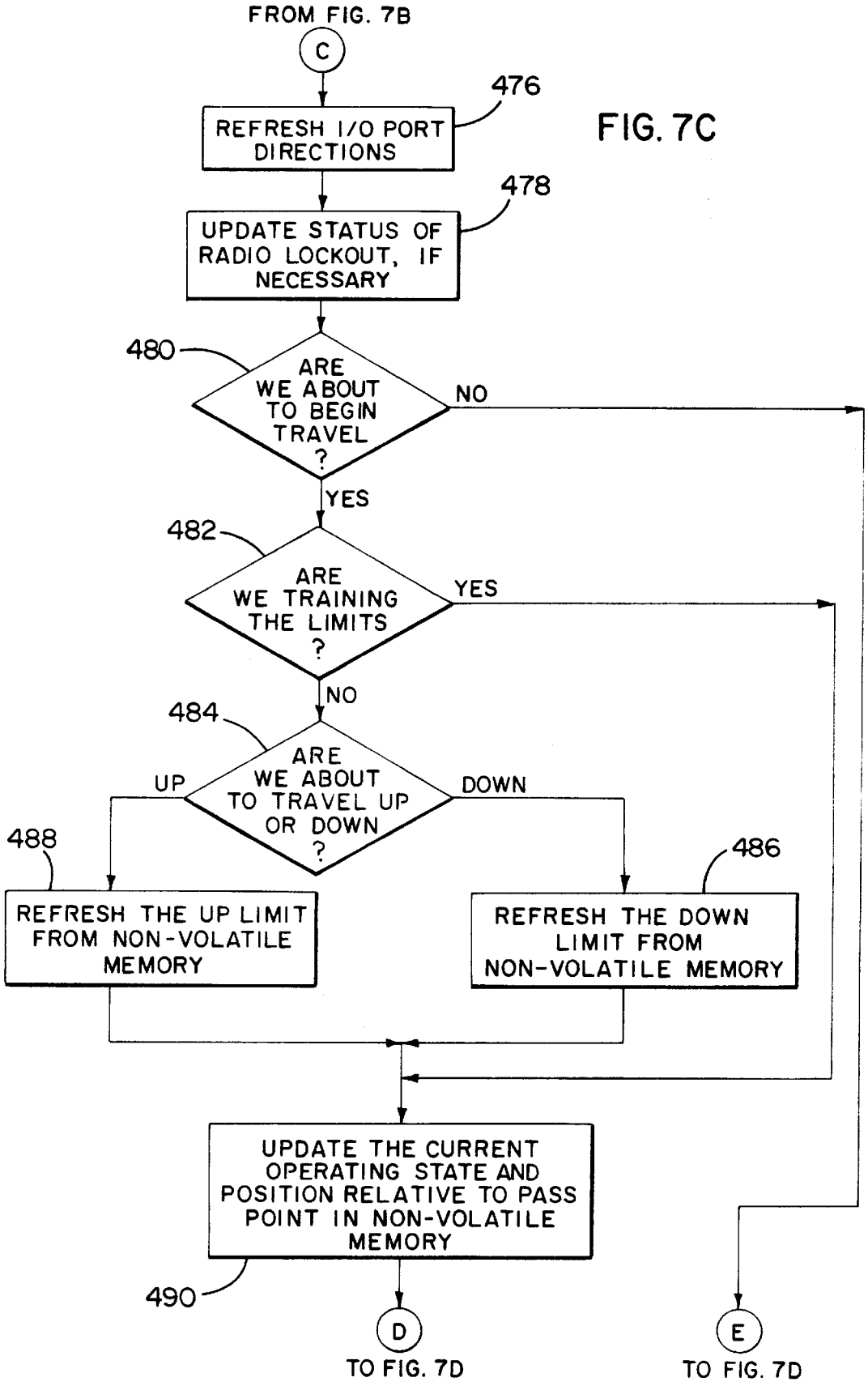
Figure 7D:
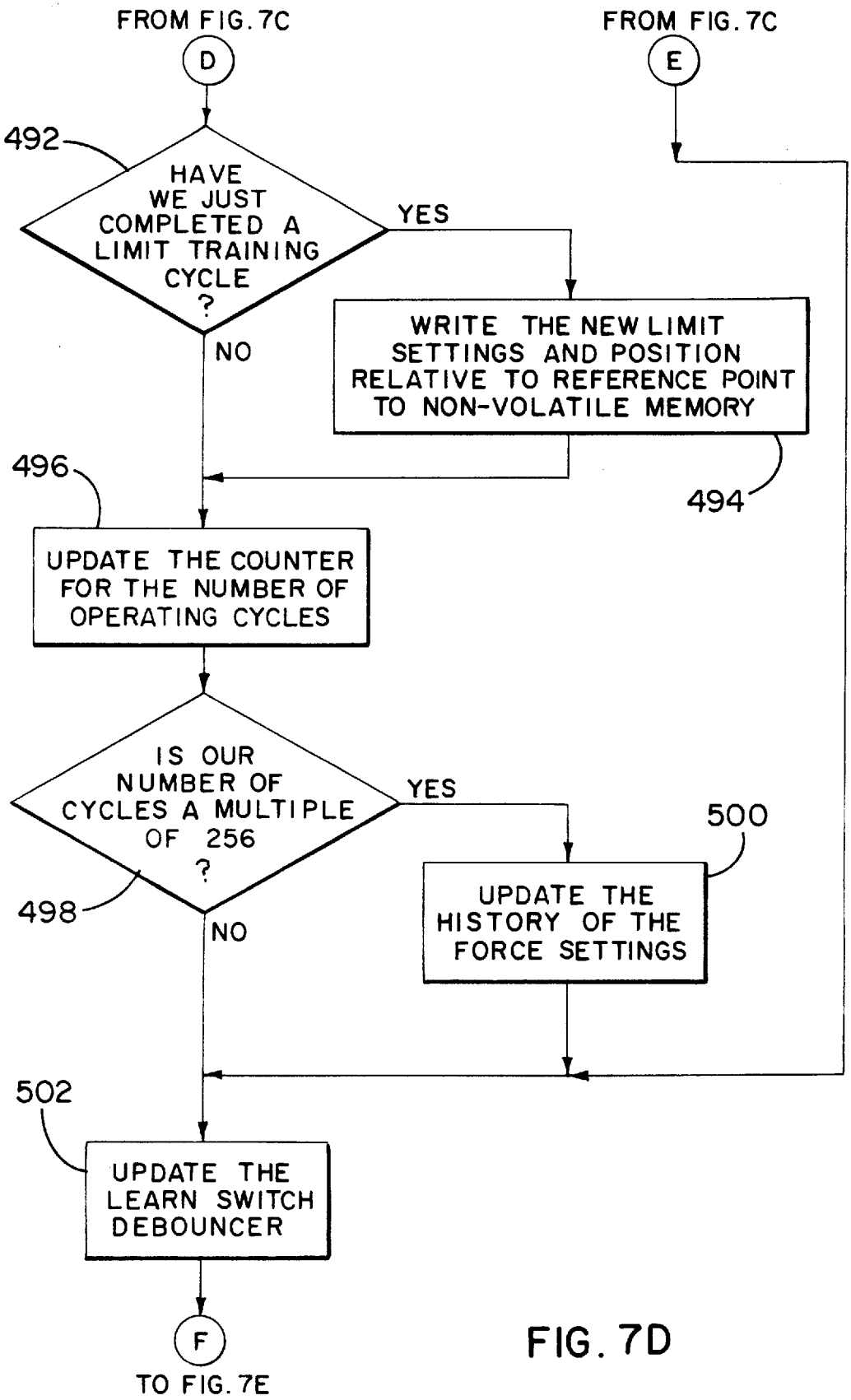
Figure 7E:
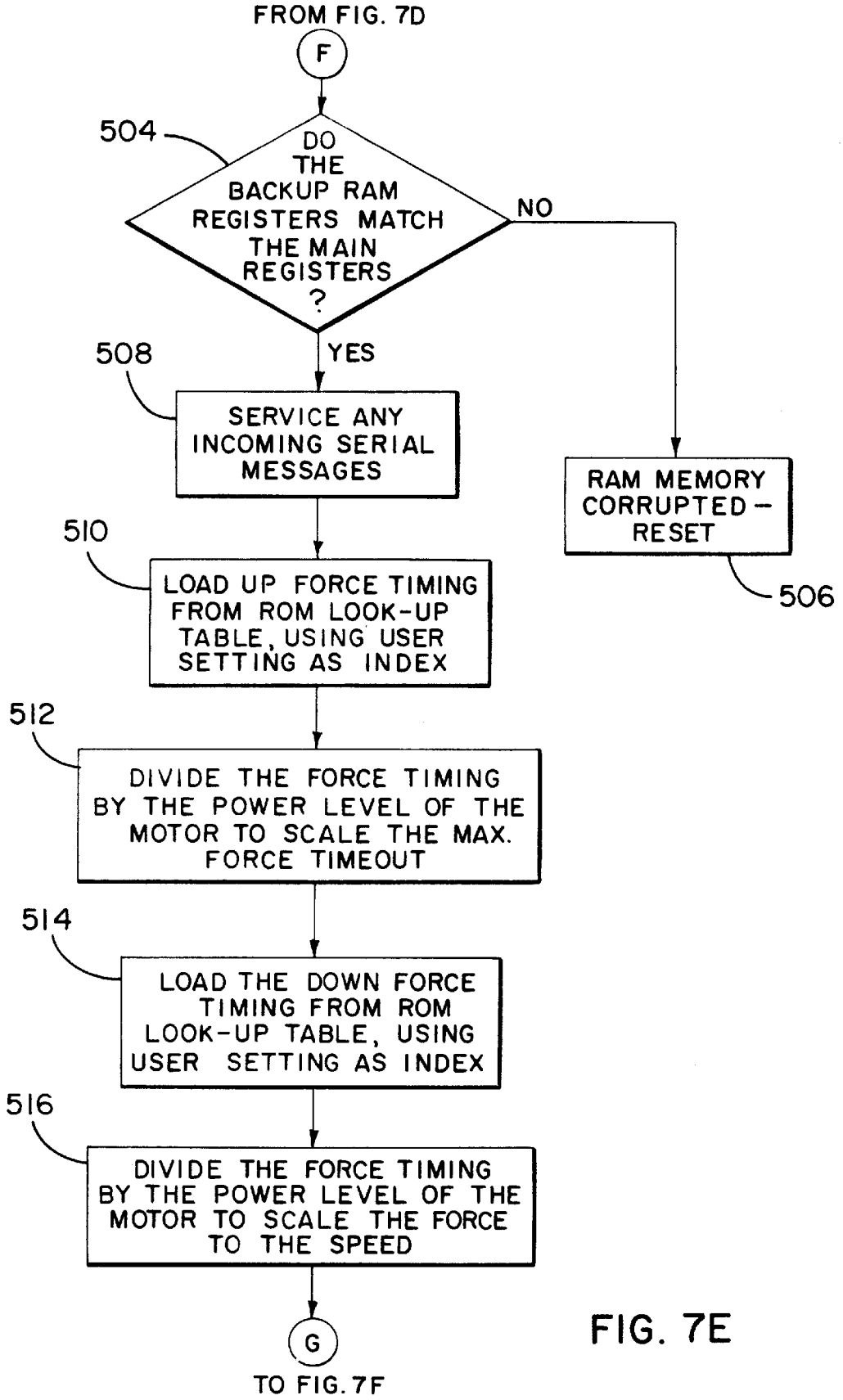
Figure 7F:
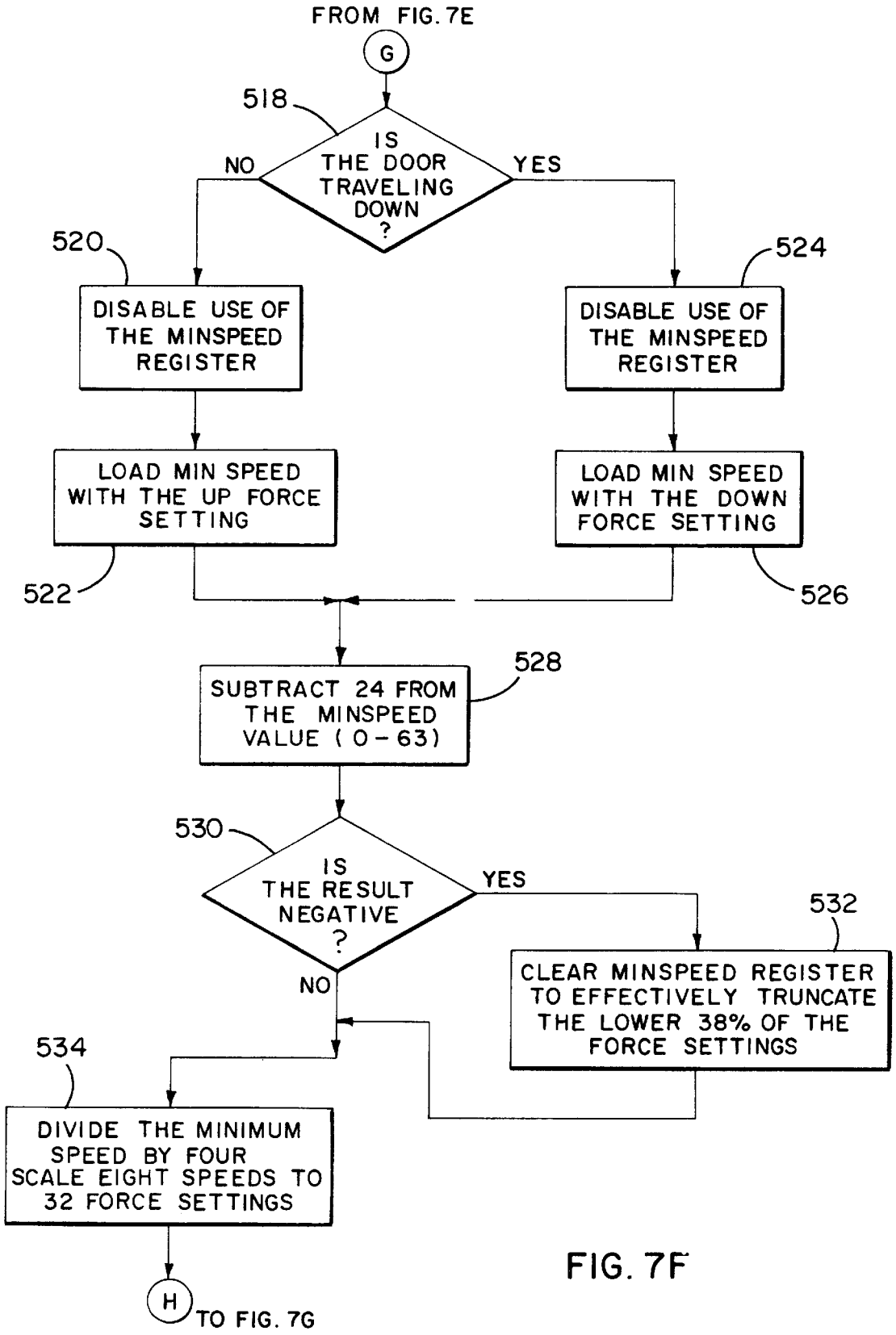
Figure 7G:
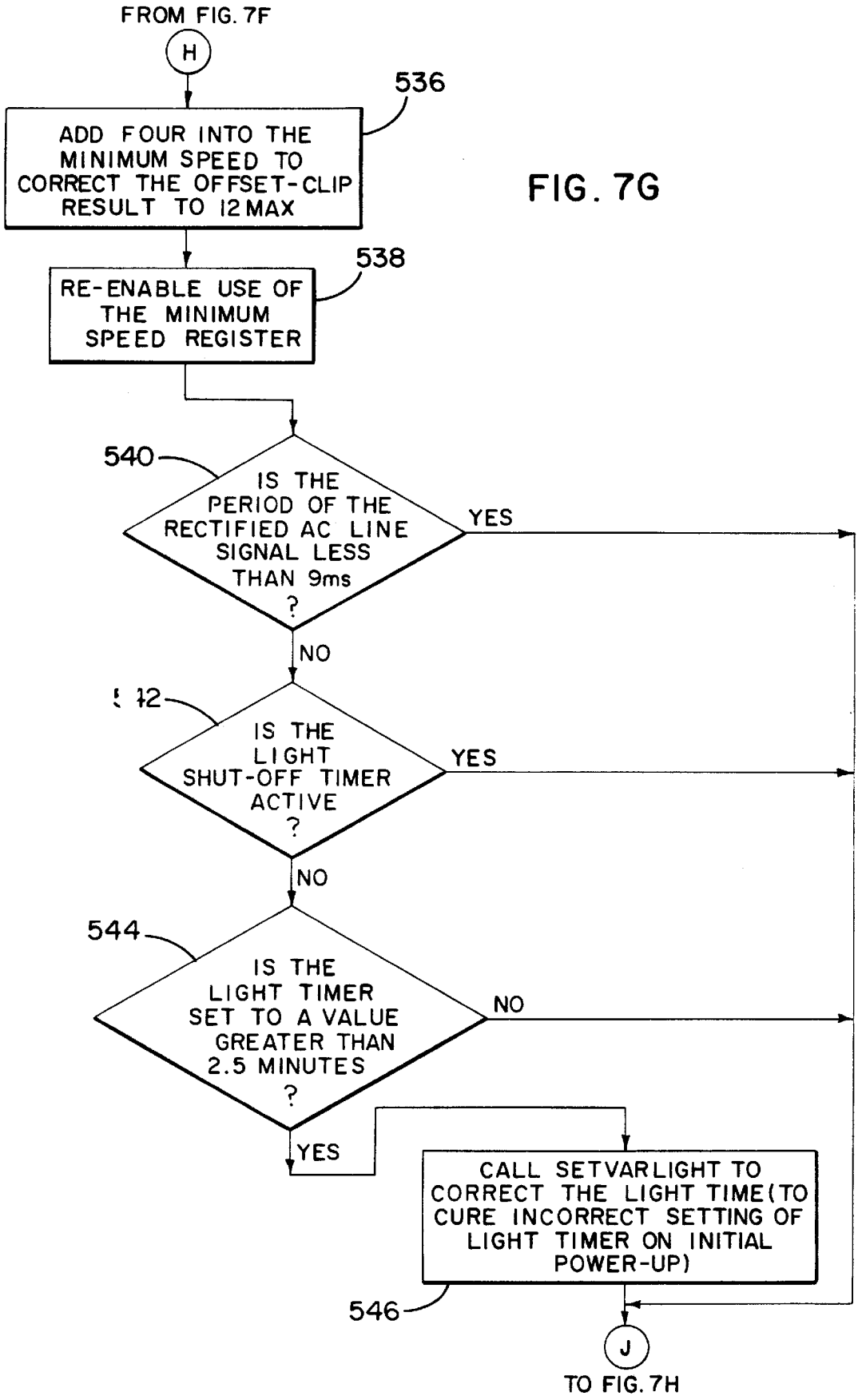
Figure 7H:
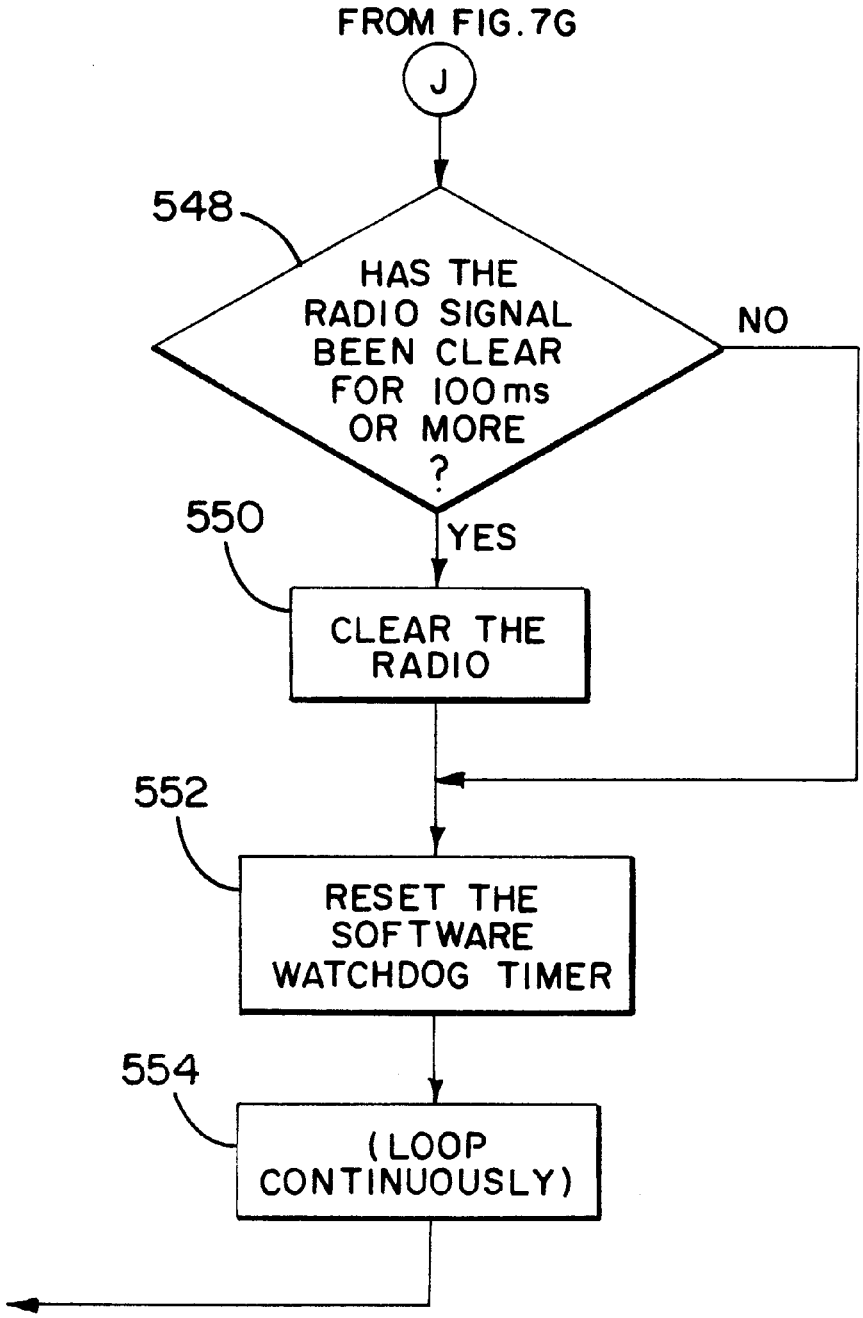

When power is applied to the head unit 12 including controller 200, microprocessor 300 executes a series of routines. With power applied, microprocessor 300 executes the main routines shown in FIGS. 6A and 6B. The main loop 400 includes three basic functions, which are looped continuously until power is removed. In block 402 the microprocessor 300 handles all non-radio EEPROM communications and disables radio access to the EEPROM 302 when communicating. This ensures that during normal operation, i.e., when the garage door operator is not being programmed, the remote transmitter does not have access to the EEPROM, where transmitter codes are stored. Radio transmissions are processed upon receipt of a radio interrupt (see below).

In block 404, microprocessor 300 maintains all low priority tasks, such as calculating new force levels and minimum speed. Preferably, a set of redundant RAM registers is provided. In the event of an unforeseen event (e.g., and ESD event) which corrupts regular RAM, the main RAM registers and the redundant RAM registers will not match. Thus, when the values in RAM do not match, the routine knows the regular RAM has been corrupted. (See block 504 below.) In block 406, microprocessor 300 tests redundant RAM registers. Several interrupt routines can take priority over blocks 402, 404 and 406.

The infrared obstacle detector generates an asynchronous IR interrupt signal which is a series of pulses. The absence of the obstacle detector pulses indicates an obstruction in the beam. After processing the IR interrupt, microprocessor 300 sets the status of the obstacle detector as unobstructed at block 416.

Receipt of a transmission from remote transmitter 30 generates an asynchronous radio interrupt at block 410. At block 418, if in the door command mode, microprocessor 300 parses incoming radio signals and sets a flag if the signal matches a stored code. If in the learn mode, microprocessor 300 stores the new transmitter codes in the EEPROM.

An asynchronous interrupt is generated if a remote communications unit is connected to an optional RS-232 communications port located on the head unit. Upon receipt of the hardware interrupt, microprocessor 300 executes a serial data communications routine for transferring and storing data from the remote hardware.

Hardware timer 0 interrupt is shown in block 422. In block 424, microprocessor 300 reads the incoming AC line signal from pin P24 and handles the motor phase control output. The incoming line signal is used to determine if the line voltage is 50 Hz for the foreign market or 60 Hz for the domestic market. With each interrupt, microprocessor 300, at block 426, task switches among three tasks. In block 428, microprocessor 300 updates software timers. In block 430, microprocessor 300 debounces wall control switch signals. In block 432, microprocessor 300 controls the motor state, including motor direction relay outputs and motor safety systems.

When the motor 118 is running, it generates an asynchronous RPM interrupt at block 434. When microprocessor 300 receives the asynchronous RPM interrupt at pin P31, it calculates the motor RPM period at block 436, then updates the position of the door at block 438.

Further details of main loop 400 are shown in FIGS. 7A through 7H. The first step executed in main loop 400 is block 450, where the microprocessor checks to see if the pass point has been passed since the last update. If it has, the routine branches to block 452, where the microprocessor 300 updates the position of the door relative to the pass point in EEPROM 302 or non-volatile memory. The routine then continues at block 454. An optional safety feature of the garage door operator system enables the worklight, when the door is open and stopped and the infrared beam in the obstacle detector is broken.

At block 454, the microprocessor checks if the enable/disable of the worklight for this feature has been changed. Some users want the added safety feature; others prefer to save the electricity used. If new input has been provided, the routine branches to block 456 and sets the status of the obstacle detector-controlled worklight in non-volatile memory in accordance with the new input. Then the routine continues to block 458 where the routine checks to determine if the worklight has been turned on without the timer. A separate switch is provided on both the remote transmitter 30 and the head unit at module 39 to enable the user to switch on the worklight without operating the door command switch. If no, the routine skips to block 470.

If yes, the routine checks at block 460 to see if the one-shot flag has been set for an obstacle detector beam break. If no, the routine skips to block 470. If yes, the routine checks if the obstacle detector controlled worklight is enabled at block 462. If not, the routine skips to block 470. If it is, the routine checks if the door is stopped in the fully open position at block 464. If no, the routine skips to block 470. If yes, the routine calls the SetVarLight subroutine (see FIG. 8) to enable the appropriate turn off time (4.5 minutes for 60 Hz systems or 2.5 minutes for 50 Hz systems). At block 468, the routine turns on the worklight.

At block 470, the microprocessor 300 clears the one-shot flag for the infrared beam break. This resets the obstacle detector, so that a later beam break can generate an interrupt. At block 472, if the user has installed a temporary password usable for a fixed period of time, the microprocessor 300 updates the non-volatile timer for the radio temporary password. At block 474, the microprocessor 300 refreshes the RAM registers for radio mode from non-volatile memory (EEPROM 302). At block 476, the microprocessor 300 refreshes I/O port directions, i.e., whether each of the ports is to be input or output. At block 478, the microprocessor 300 updates the status of the radio lockout flag, if necessary. The radio lockout flag prevents the microprocessor from responding to a signal from a remote transmitter. A radio interrupt (described below) will disable the radio lockout flag and enable the remote transmitter to communicate with the receiver.

At block 480, the microprocessor 300 checks if the door is about to travel. If not, the routine skips to block 502. If the door is about to travel, the microprocessor 300 checks if the limits are being trained at block 482. If they are, the routine skips to block 490. If not, the routine asks at block 484 if travel is UP or DOWN. If DOWN, the routine refreshes the DOWN limit from non-volatile memory (EEPROM 302) at block 486. If UP, the routine refreshes the UP limit from non-volatile memory (EEPROM 302) at block 488. The routine updates the current operating state and position relative to the pass point in non-volatile memory at block 490. This is a redundant read for stability of the system.

At block 492, the routine checks for completion of a limit training cycle. If training is complete, the routine branches to block 494 where the new limit settings and position relative to the pass point are written to non-volatile memory.

The routine then updates the counter for the number of operating cycles at block 496. This information can be downloaded at a later time and used to determine when certain parts need to be replaced. At block 498 the routine checks if the number of cycles is a multiple of 256. Limiting the storage of this information to multiples of 256 limits the number of times the system has to write to that register. If yes it updates the history of force settings at clock 500. If not, the routine continues to block 502.

At block 502 the routine updates the learn switch debouncer. At block 504 the routine performs a continuity check by comparing the backup (redundant) RAM registers with the main registers. If they do not match, the routine branches to block 506. If the registers do not match, the RAM memory has been corrupted and the system is not safe to operate, so a reset is commanded. At this point, the system powers up as if power had been removed and reapplied and the first step is a self test of the system (all installation settings are unchanged).

If the answer to block 504 is yes, the routine continues to block 508 where the routine services any incoming serial messages from the optional wall control (serial messages might be user input start or stop commands). The routine then loads the UP force timing from the ROM look-up table, using the user setting as an index at block 510. Force potentiometers R33 and R34 are set by the user. The analog values set by the user are converted to digital values. The digital values are used as an index to the look-up table stored in memory. The value indexed from the look-up table is then used as the minimum motor speed measurement. When the motor runs, the routine compares the selected value from the look-up table with the digital timing from the RPM routine to ensure the force is acceptable.

Instead of calculating the force each time the force potentiometers are set, a look-up table is provided for each potentiometer. The range of values based on the range of user inputs is stored in ROM and used to save microprocessor processing time. The system includes two force limits: one for the UP force and one for the DOWN force. Two force limits provide a safer system. A heavy door may require more UP force to lift, but need a lower DOWN force setting (and therefore a slower closing speed) to provide a soft closure. A light door will need less UP force to open the door and possibly a greater DOWN force to provide a full closure.

Next the force timing is divided by power level of the motor for the door to scale the maximum force timeout at block 512. This step scales the force reversal point based on the maximum force for the door. The maximum force for the door is determined based on the size of the door, i.e. the distance the door travels. Single piece doors travel a greater distance than segmented doors. Short doors require less force to move than normal doors. The maximum force for a short door is scaled down to 60 percent of the maximum force available for a normal door. So, at block 512, if the force setting is set by the user, for example at 40 percent, and the door is a normal door (i.e., a segmented door or multi-paneled door), the force is scaled to 40 percent of 100 percent. If the door is a short door (i.e., a single panel door), the force is scaled to 40 percent of 60 percent, or 24 percent.

At block 514, the routine loads the DOWN force timing from the ROM look-up table, using the user setting as an index. At block 516, the routine divides the force timing by the power level of the motor for the door to scale the force to the speed.

At block 518 the routine checks if the door is traveling DOWN. If yes, the routine disables use of the MinSpeed Register at block 524 and loads the MinSpeed Register with the DOWN force setting, i.e., the value read from the DOWN force potentiometer at block 526. If not, the routine disables use of the MinSpeed Register at block 520 and loads the MinSpeed Register with the UP force setting from the force potentiometer at block 522.

The routine continues at block 528 where the routine subtracts 24 from the MinSpeed value. The MinSpeed value ranges from 0 to 63. The system uses 64 levels of force. If the result if negative at block 530, the routine clears the MinSpeed Register at block 532 to effectively truncate the lower 38 percent of the force settings. If no, the routine divides the minimum speed by 4 to scale 8 speeds to 32 force settings at block 534. At block 536, the routine adds 4 into the minimum speed to correct the offset, and clips the result to a maximum of 12. At block 538 the routine enables use of the MinSpeed Register.

At block 540 the routine checks if the period of the rectified AC line signal (input to microprocessor 300 at pin P24) is less than 9 milliseconds (indicating the line frequency is 60 Hz). If it is, the routine skips to block 548. If not, the routine checks if the light shut-off timer is active at block 542. If not, the routine skips to block 548. If yes, the routine checks if the light time value is greater than 2.5 minutes at block 544. If no, the routine skips to block 548. If yes, the routine calls the SetVarLight subroutine (see FIG. 8), to correct the light timing setting, at block 546.

At block 548 the routine checks if the radio signal has been clear for 100 milliseconds or more. If not, the routine skips to block 552. If yes, the routine clears the radio at block 550. At block 552, the routine resets the watchdog timer. At block 554, the routine loops to the beginning of the main loop.

Figure 8:
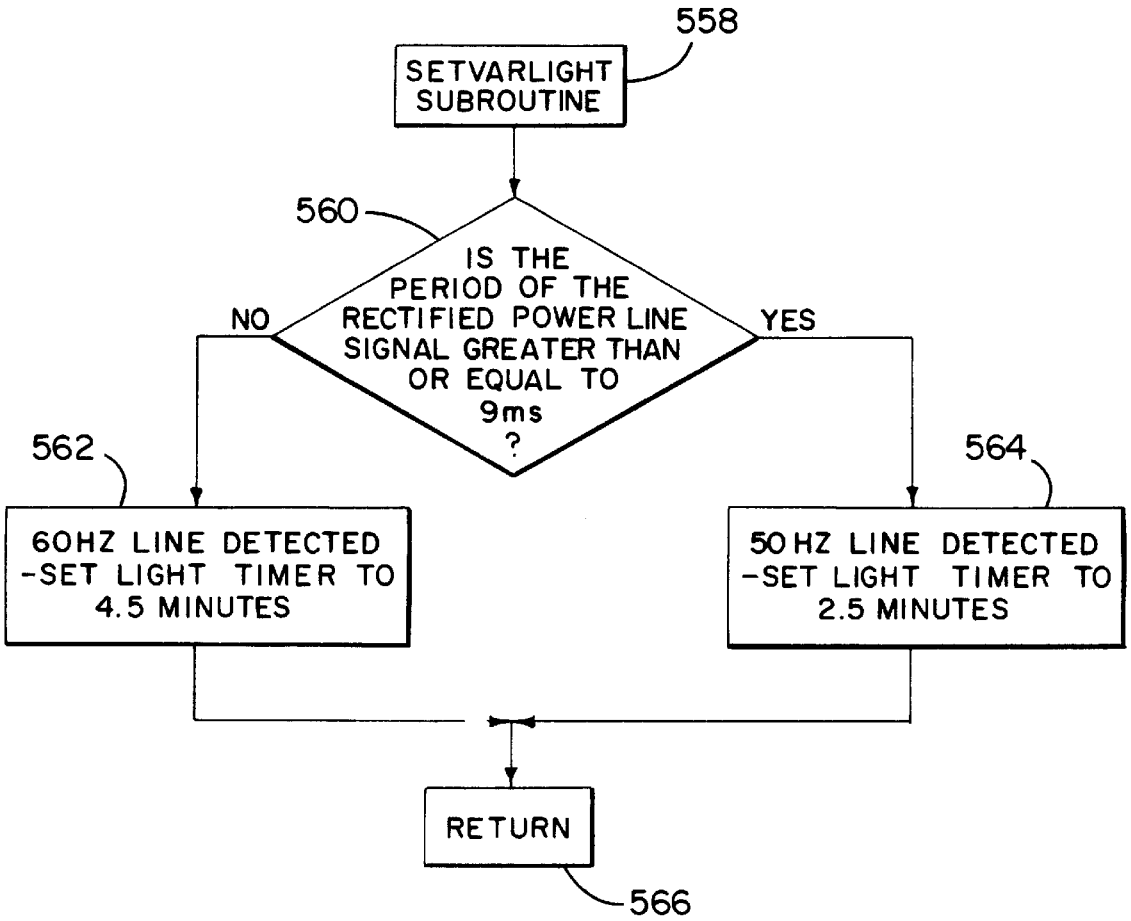
FIG. 8 is a flow chart of a set variable light shut-off timer routine executed by the microprocessor.

The SetVarLight subroutine, FIG. 8, is called whenever the door is commanded to move and the worklight is to be turned on. When the SetVarLight subroutine, block 558 is called, the subroutine checks if the period of the rectified power line signal (pin P24 of microprocessor 300) is greater than or equal to 9 milliseconds. If yes, the line frequency is 50 Hz, and the timer is set to 2.5 minutes at block 564. If no, the line frequency is 60 Hz and the timer is set to 4.5 minutes at block 562. After setting, the subroutine returns to the call point at block 566.

Figure 9A:
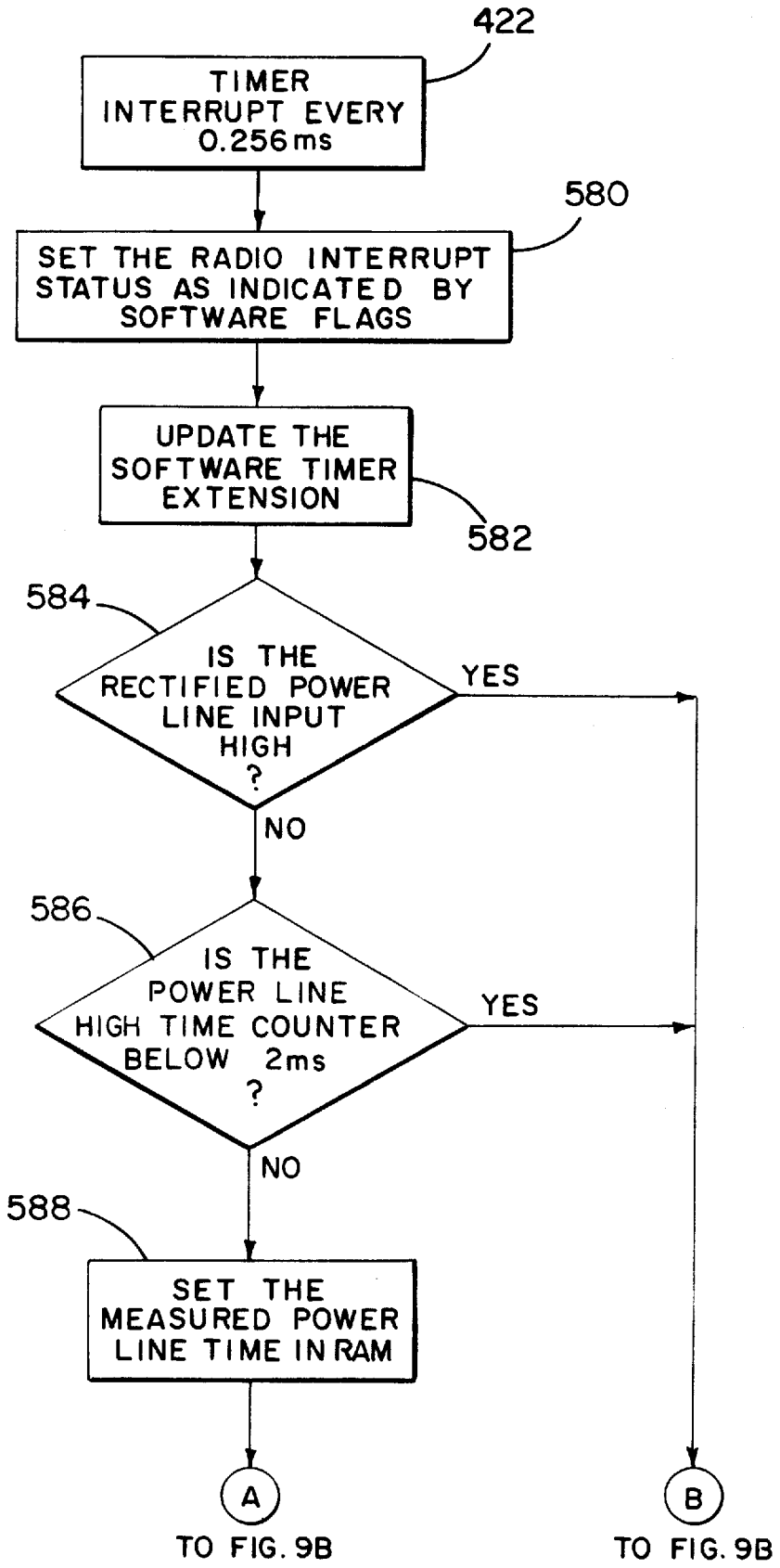
FIGS. 9A–9C are a flow chart of a hardware timer interrupt routine executed in the microprocessor.
Figure 9B:
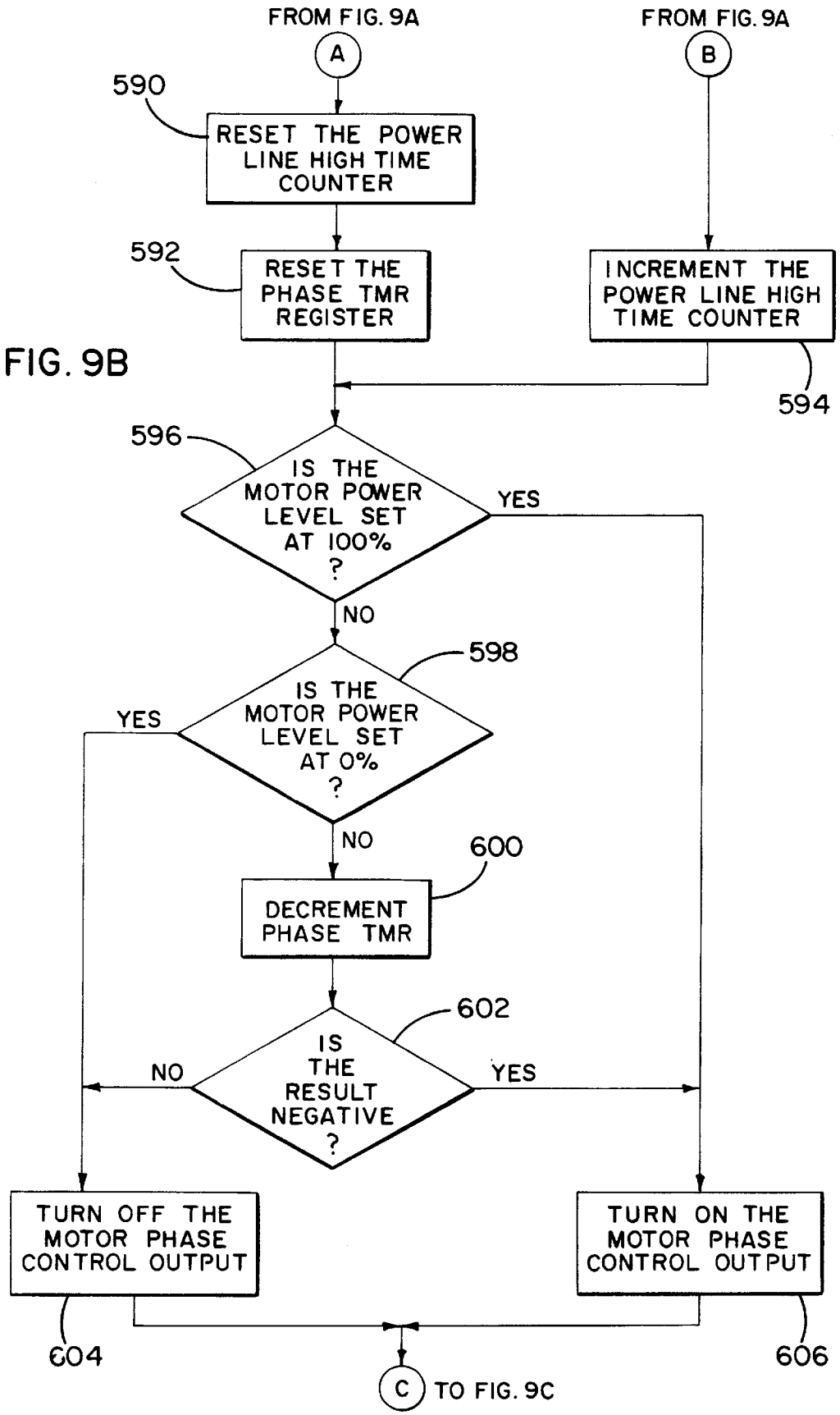
Figure 9C:
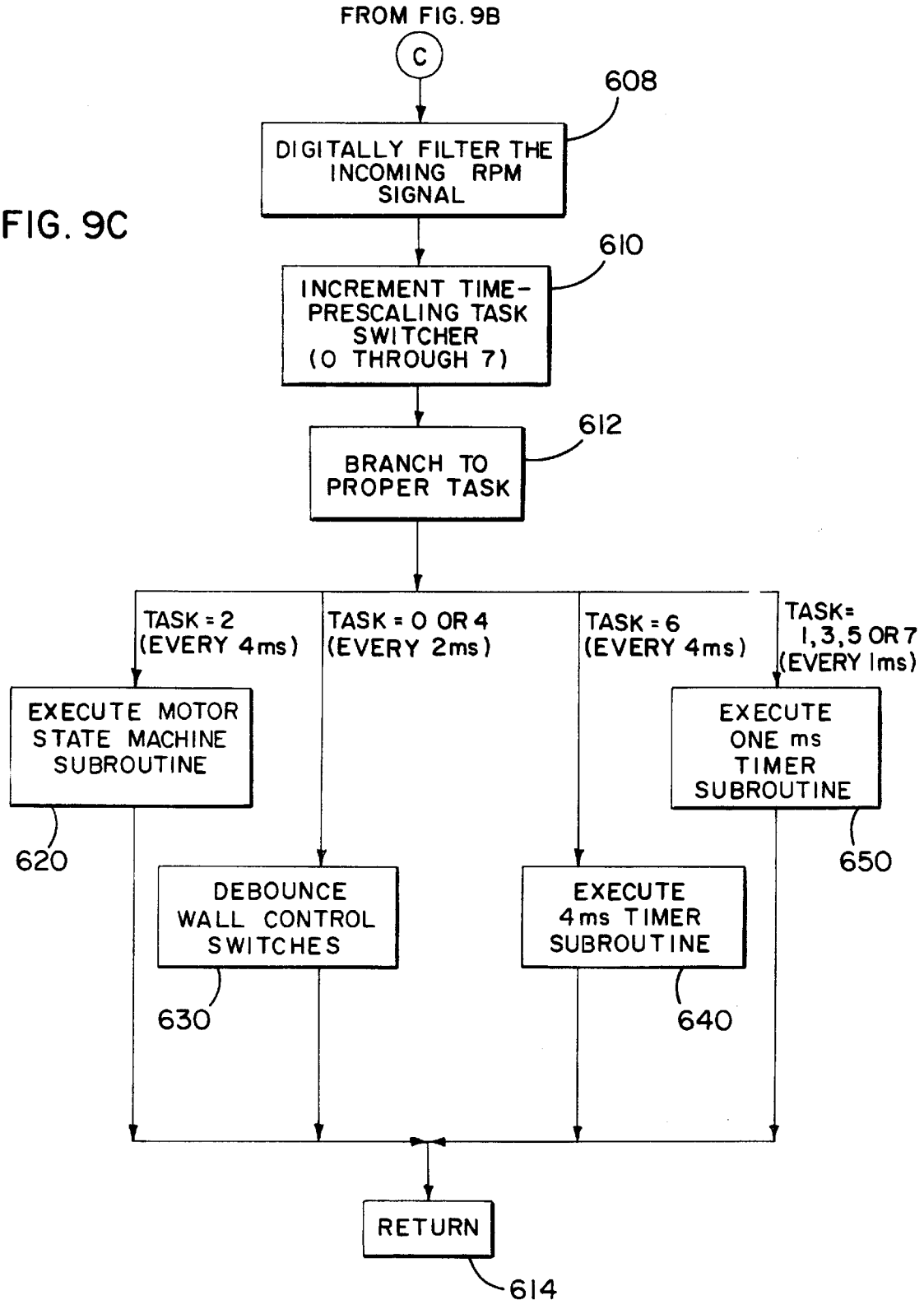

The hardware timer interrupt subroutine operated by microprocessor 300, shown at block 422, runs every 0.256 milliseconds. Referring to FIGS. 9A–9C, when the subroutine is first called, it sets the radio interrupt status as indicated by the software flags at clock 580. At block 582, the subroutine updates the software timer extension. The next series of steps monitor the AC power line frequency (pin P24 of microprocessor 300). At step 584, the subroutine checks if the rectified power line input is high (checks for a leading edge). If yes, the subroutine skips to block 594, where it increments the power line high time counter, then continues to block 596. If no, the subroutine checks if the high time counter is below 2 milliseconds at block 586. If yes, the subroutine skips to block 594. If no, the subroutine sets the measured power line time in RAM at block 588. The subroutine then resets the power line high time counter at block 590 and resets the phase timer register in block 592.

At block 596, the subroutine checks if the motor power level is set at 100 percent. If yes, the subroutine turns on the motor phase control output at block 606. If no, the subroutine checks if the motor power level is set at 0 percent at block 598. If yes, the subroutine turns off the motor phase control output at block 604. If no, the phase timer register is decremented at block 600 and the result is checked for sign at block 602. If positive the subroutine branches to block 606; if negative the subroutine branches to block 604.

The subroutine continues at block 608 where the incoming RPM signal (at pin P31 of microprocessor 300) is digitally filtered. Then the time prescaling task switcher (which loops through 8 tasks identified at blocks 620, 630, 640, 650) is incremented at block 610. The task switcher varies from 0 to 7. At block 612, the subroutine branches to the proper task depending on the value of the task switcher.

If the task switcher is at value 2 (this occurs every 4 milliseconds), the execute motor state machine subroutine is called at block 620. If the task is value 0 or 4 (this occurs every 2 milliseconds), the wall control switches are debounced at block 630. If the task value is 6 (this occurs every 4 milliseconds), the execute 4 ms timer subroutine is called at block 640. If the task is value 1, 3, 5 or 7, the 1 millisecond timer subroutine is called at block 650. Upon completion of the called subroutine, the 0.256 millisecond timer subroutine returns at block 614.

Figure 10A:
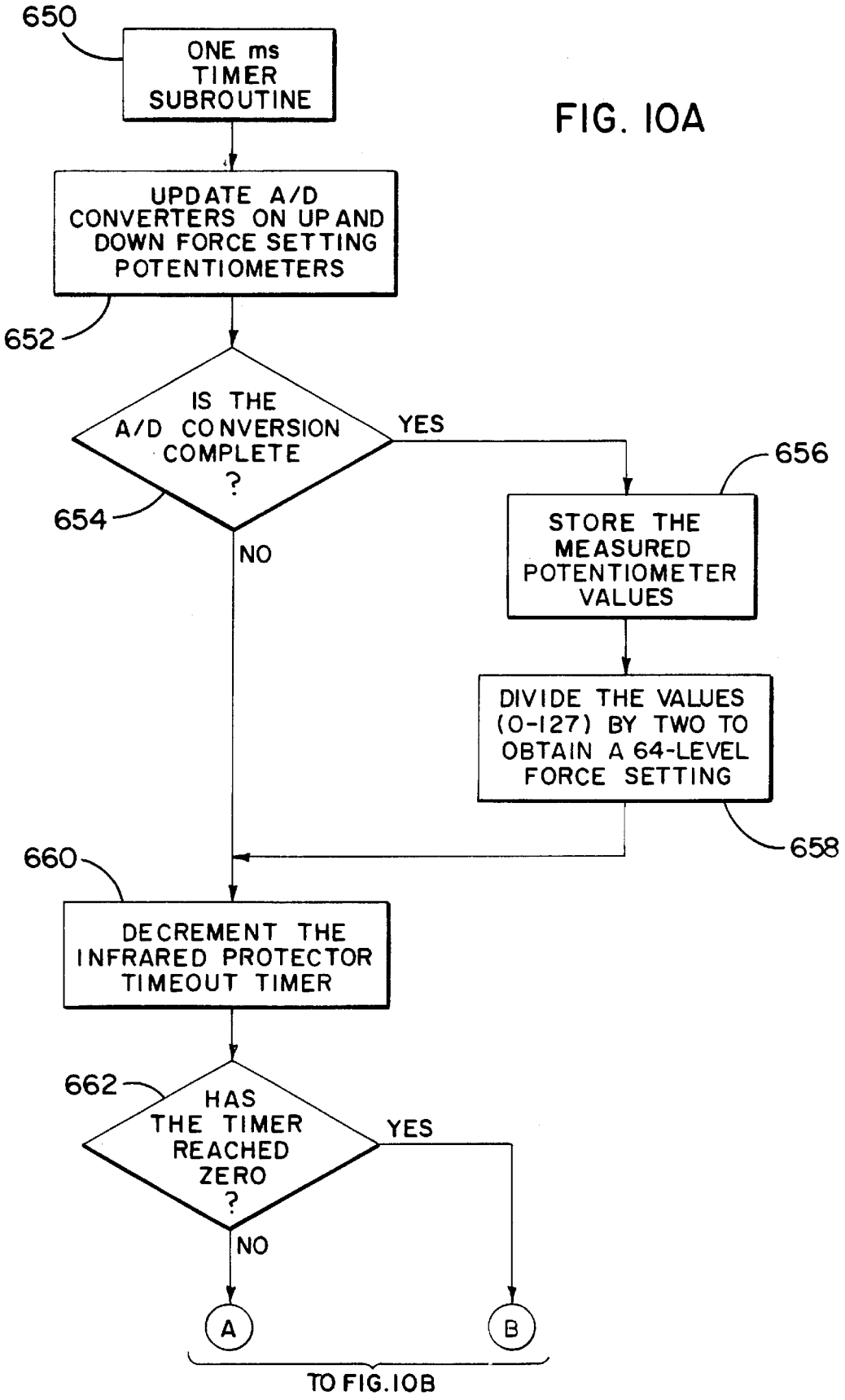
FIGS. 10A–10C are a flow chart of a 1 millisecond timer routine executed in the microprocessor.
Figure 10B:
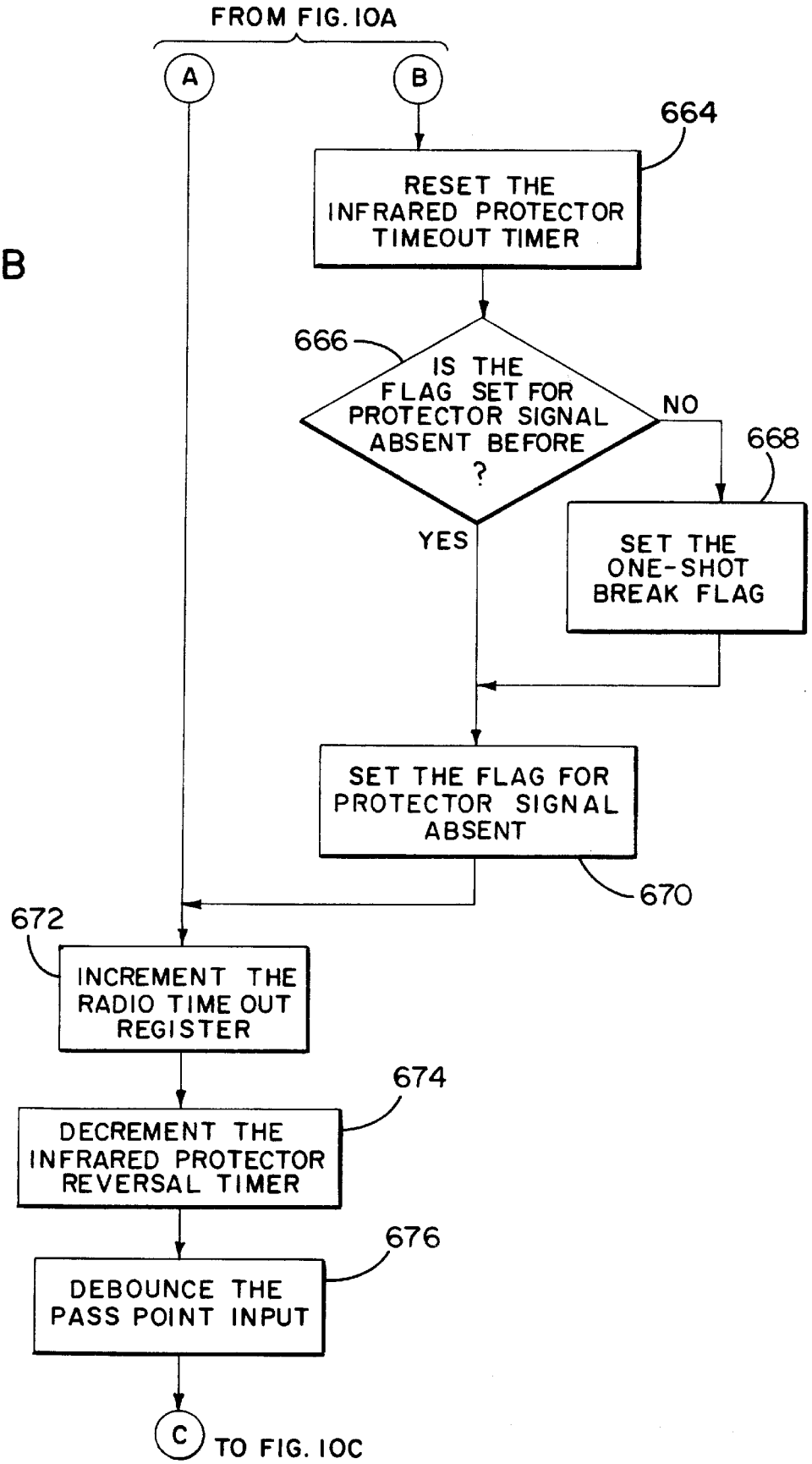
Figure 10C:
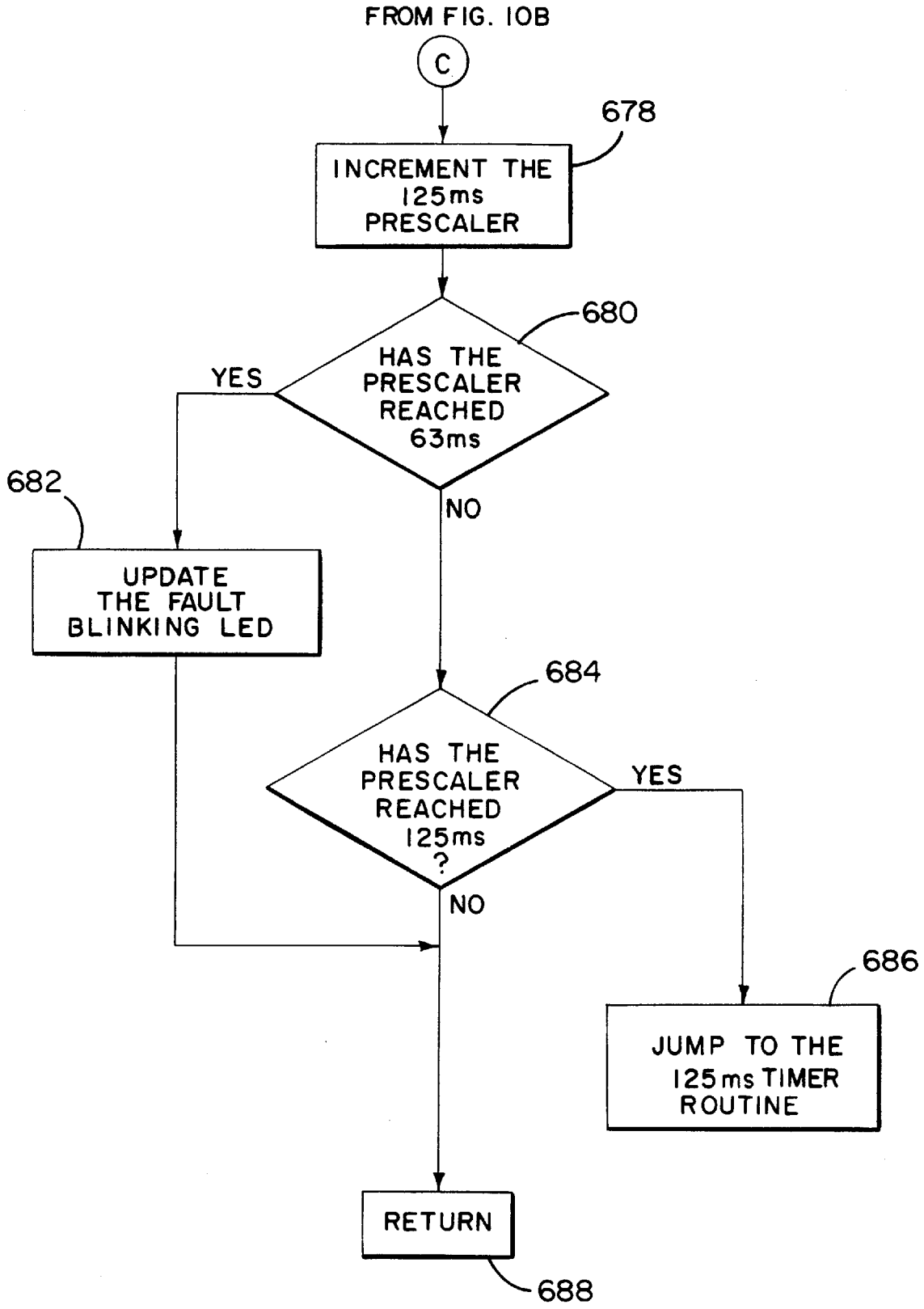

Details of the 1 ms timer subroutine (block 650) are shown in FIGS. 10A–10C. When this subroutine is called, the first step is to update the A/D converters on the UP and DOWN force setting potentiometers (P34 and P35 of microprocessor 300) at block 652. At block 654, the subroutine checks if the A/D conversion (comparison at comparators 320 and 322) is complete. If yes, the measured potentiometer values are stored at block 656. Then the stored values (which vary from 0 to 127) are divided by 2 to obtain the 64 level force setting at block 658. If no, the subroutine decrements the infrared obstacle detector timeout timer at block 660. In block 662, the subroutine checks if the timer has reached zero. If no, the subroutine skips to block 672. If yes, the subroutine resets the infrared obstacle detector timeout timer at block 664. The flag setting for the obstacle detector signal is checks at block 666. If no, the one-shot break flag is set at block 668. If yes, the flag is set indicating the obstacle detector signal is absent at block 670.

At block 672, the subroutine increments the radio time out register. Then the infrared obstacle detector reversal timer is decremented at block 674. The pass point input is debounced at block 676. The 125 millisecond prescaler is incremented at block 678. Then the prescaler is checked to see if it has reached 63 milliseconds at block 680. If yes, the fault blinking LED is updated at block 682. If no, the prescaler is checked if it has reached 125 ms at block 684. If yes, the 125 ms timer subroutine is executed at block 686. If no, the routine returns at block 688.

Figure 11A:
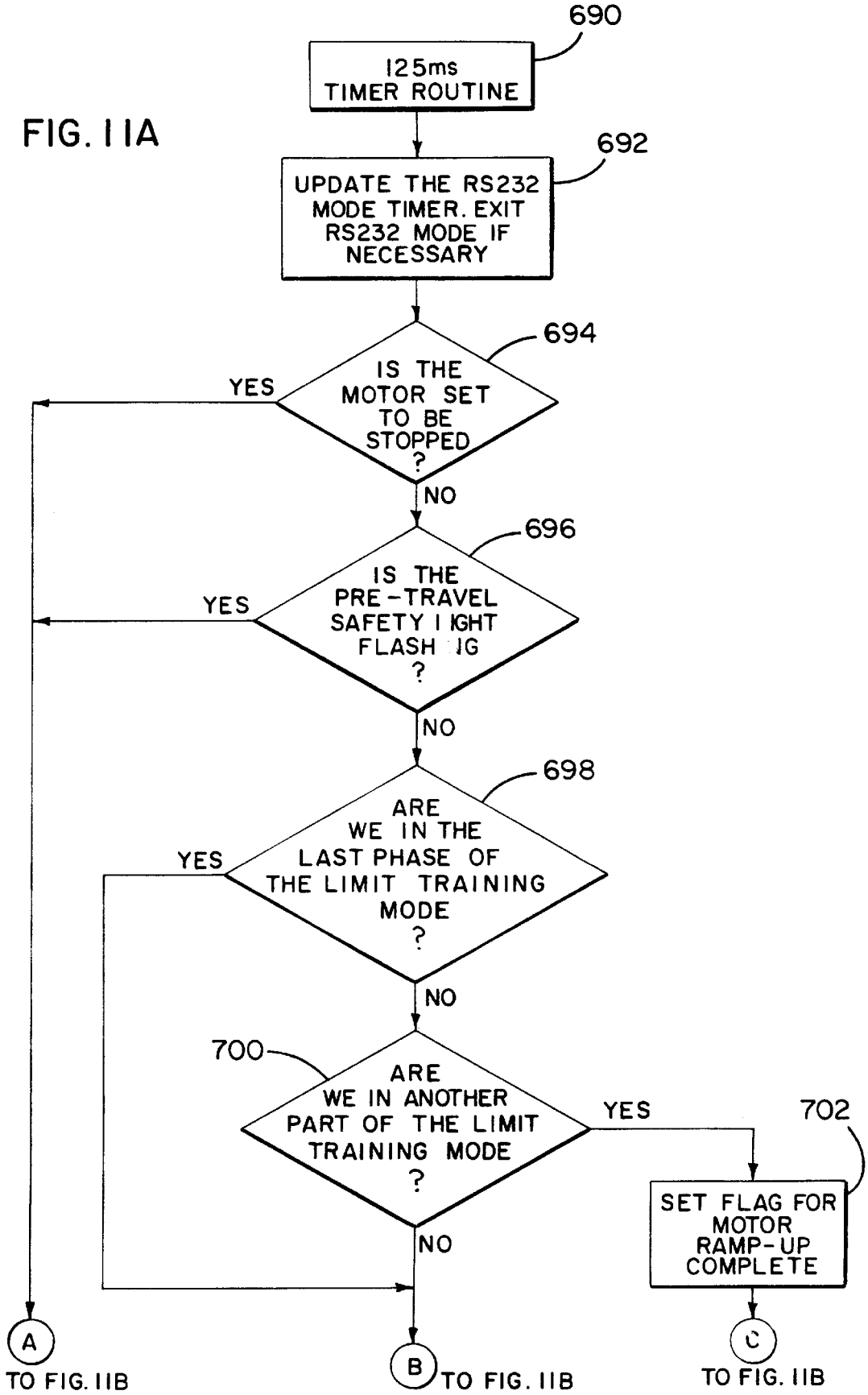
FIGS. 11A–11C are a flow chart of a 125 millisecond timer routine executed in the microprocessor.
Figure 11B:
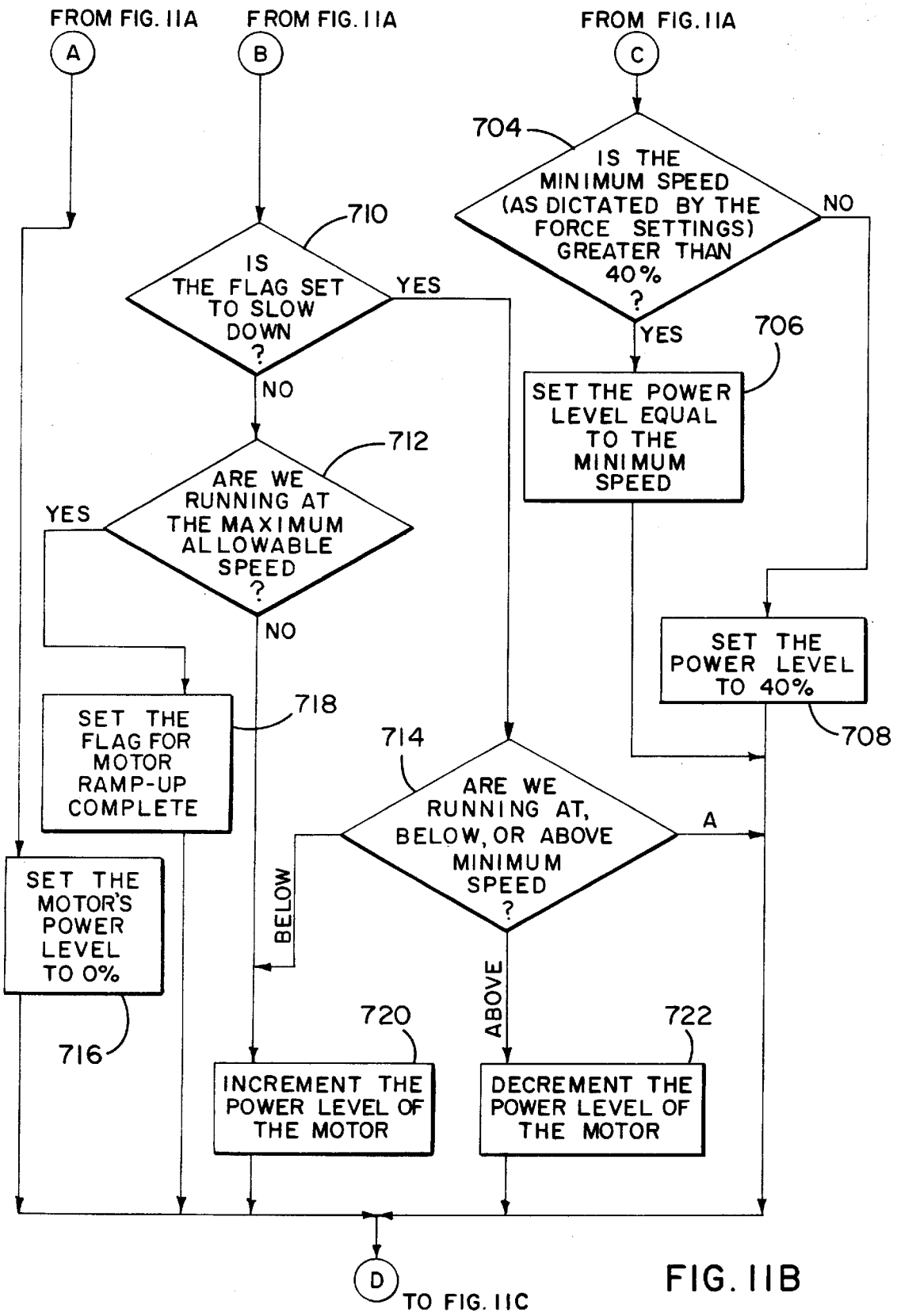
Figure 11C:
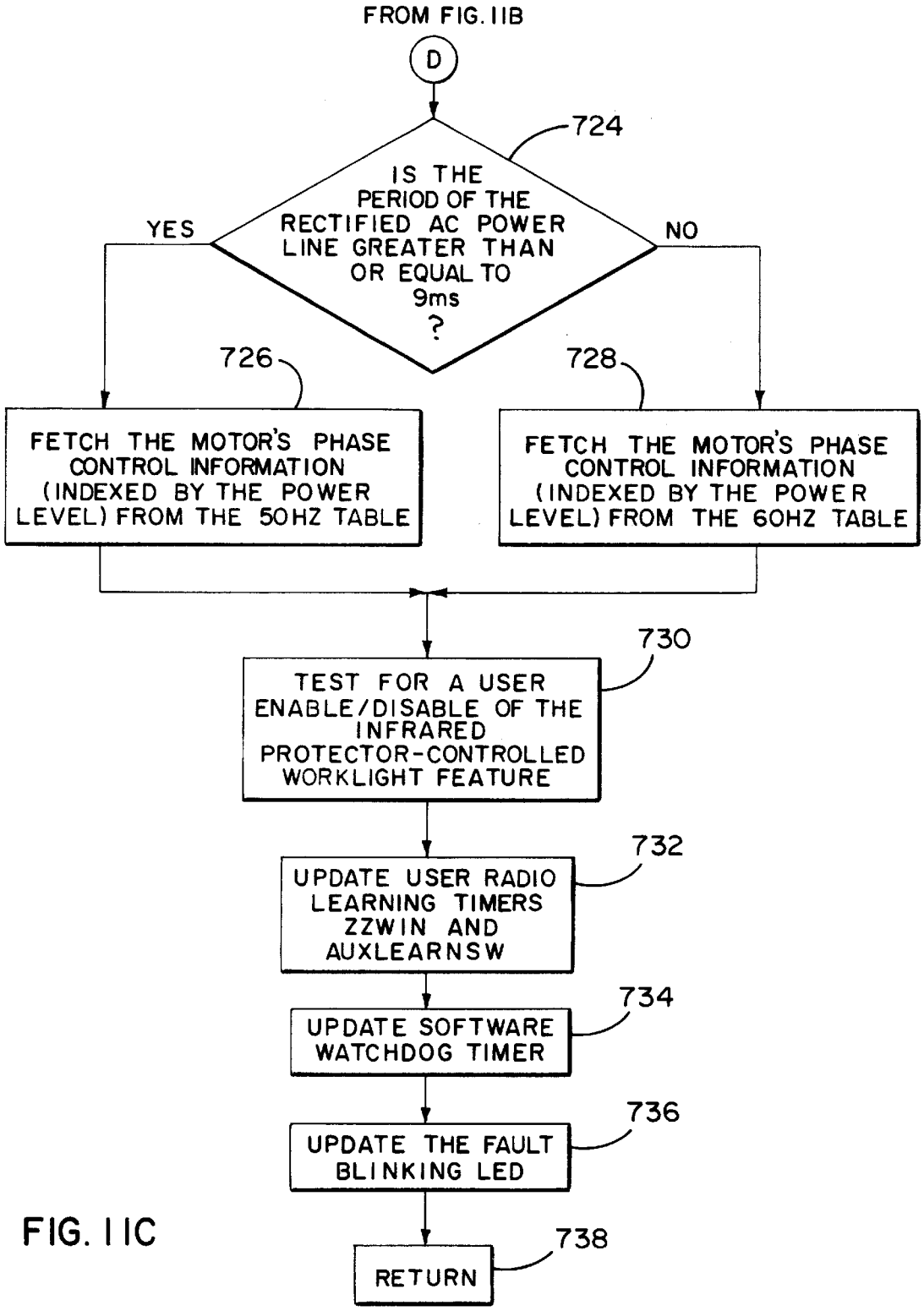

Turning to FIGS. 11A–C, the 125 millisecond timer subroutine (block 690) is used to manage the power level of the motor 118. At block 692, the subroutine updates the RS-232 mode timer and exits the RS-232 mode timer if necessary. The same pair of wires is used for both wall control switches and RS-232 communication. If RS-232 communication is received while in the wall control mode, the RS-232 mode is entered. If four seconds passes since the last RS-232 word was received, then the RS-232 timer times out and reverts to the wall control mode. At block 694 the subroutine checks if the motor is set to be stopped. If yes, the subroutine skips to block 716 and sets the motor's power level to 0 percent. If no, the subroutine checks if the pre-travel safety light is flashing at block 696 (if the optional flasher module has been installed, a light will flash for 2 seconds before the motor is permitted to travel and then flash at a predetermined interval during motor travel). If yes, the subroutine skips to block 716 and sets the motor's power level to 0 percent.

If no, the subroutine checks if the microprocessor 300 is in the last phase of a limit training mode at block 698. If yes, the subroutine skips to block 710. If no, the subroutine checks if the microprocessor 300 is in another part of the limit training mode at block 700. If no, the subroutine skips to block 710. If yes, the subroutine sets the motor ramp-up complete flag in step 702 and checks if the minimum speed (as determined by the force settings) is greater than 40 percent at block 704. If no, the power level is set to 40 percent at block 708. If yes, the power level is set equal to the minimum speed stored in MinSpeed Register at block 706.

At block 710 the subroutine checks if the flag is set to slow down. If yes, the subroutine checks if the motor is running above or below minimum speed at block 714. If above minimum speed, the power level of the motor is decremented one step increment (one step increment is preferably 5% of maximum motor speed) at block 722. If below the minimum speed, the power level of the motor is incremented one step increment (which is preferably 5% of maximum motor speed) to minimum speed at block 720.

If the flag is not set to slow down at block 710, the subroutine checks if the motor is running at maximum allowable speed at block 712. If no, the power level of the motor is incremented one step increment (which is preferably 5% of maximum motor speed) at block 720. If yes, the flag is set for motor ramp-up speed complete.

The subroutine continues at block 724 where it checks if the period of the rectified AC power line (pin P24 of microprocessor 300) is greater than or equal to 9 ms. If no, the subroutine fetches the motor's phase control information (indexed from the power level) from the 60 Hz look-up table stored in ROM at block 728. If yes, the subroutine fetches the motor's phase control information (indexed from the power level) from the 50 Hz look-up table stored in ROM at block 726.

The subroutine tests for a user enable/disable of the infrared obstacle detector-controlled worklight feature at block 730. Then the user radio learning timers, ZZWIN (at the wall keypad if installed) and AUXLEARNSW (radio on air and worklight command) are updated at block 732. The software watchdog timer is updated at block 734 and the fault blinking LED is updated at block 736. The subroutine returns at block 738.

Figure 12A:
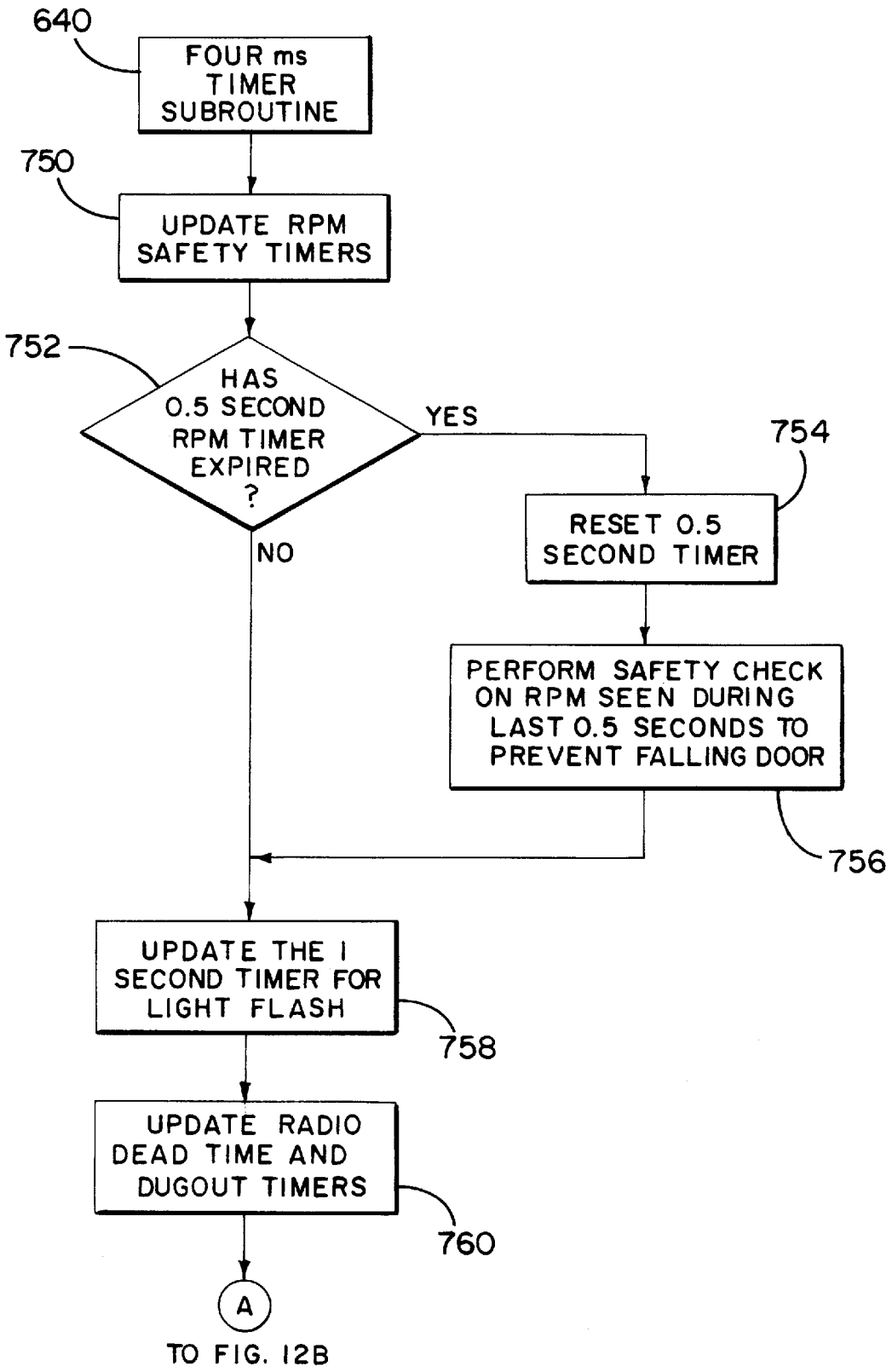
FIGS. 12A–12B are a flow chart of a 4 millisecond timer routine executed in the microprocessor.
Figure 12B:
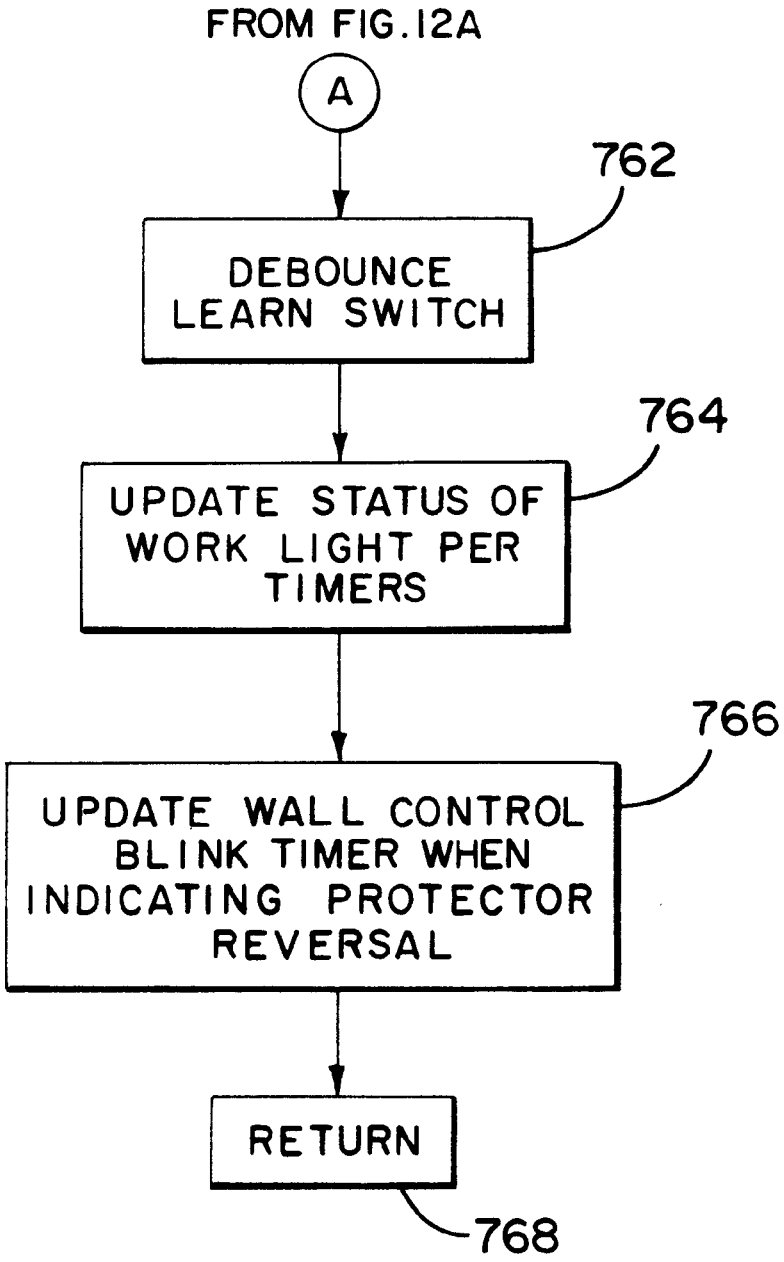

The 4 millisecond timer subroutine is used to check on various systems which do not require updating as often as more critical systems. Referring to FIGS. 12A and 12B, the subroutine is called at block 640. At block 750, the RPM safety timers are updated. These timers are used to determine if the door has engaged the floor. The RPM safety timer is a one second delay before the operator begins to look for a falling door, i.e., one second after stopping. There are two different forces used in the garage door operator. The first type force are the forces determined by the UP and DOWN force potentiometers. These force levels determine the speed at which the door travels in the UP and DOWN directions. The second type of force is determined by the decrease in motor speed due to an external force being applied to the door (an obstacle or the floor). This programmed or preselected external force is the maximum force that the system will accept before an auto-reverse or stop is commanded.

At block 752 the 0.5 second RPM timer is checked to se if it has expired. If yes, the 0.5 second timer is reset at block 754. At block 756 safety checks are performed on the RPM sen during the last 0.5 seconds to prevent the door from falling. The 0.5 second timer is chosen so the maximum force achieved at the trolley will reach 50 kilograms in 0.5 seconds if the motor is operating at 100 percent of power.

At block 758, the subroutine updates the 1 second timer for the optional light flasher module. In this embodiment, the preferred flash period is 1 second. At block 760 the radio dead time and dropout timers are updated. At block 762 the learn switch is debounced. At block 764 the status of the worklight is updated in accordance with the various light timers. At block 766 the optional wall control blink timer is updated. The optional wall control includes a light which blinks when the door is being commanded to auto-reverse in response to an infrared obstacle detector signal break. At block 768 the subroutine returns.

Figure 13A:
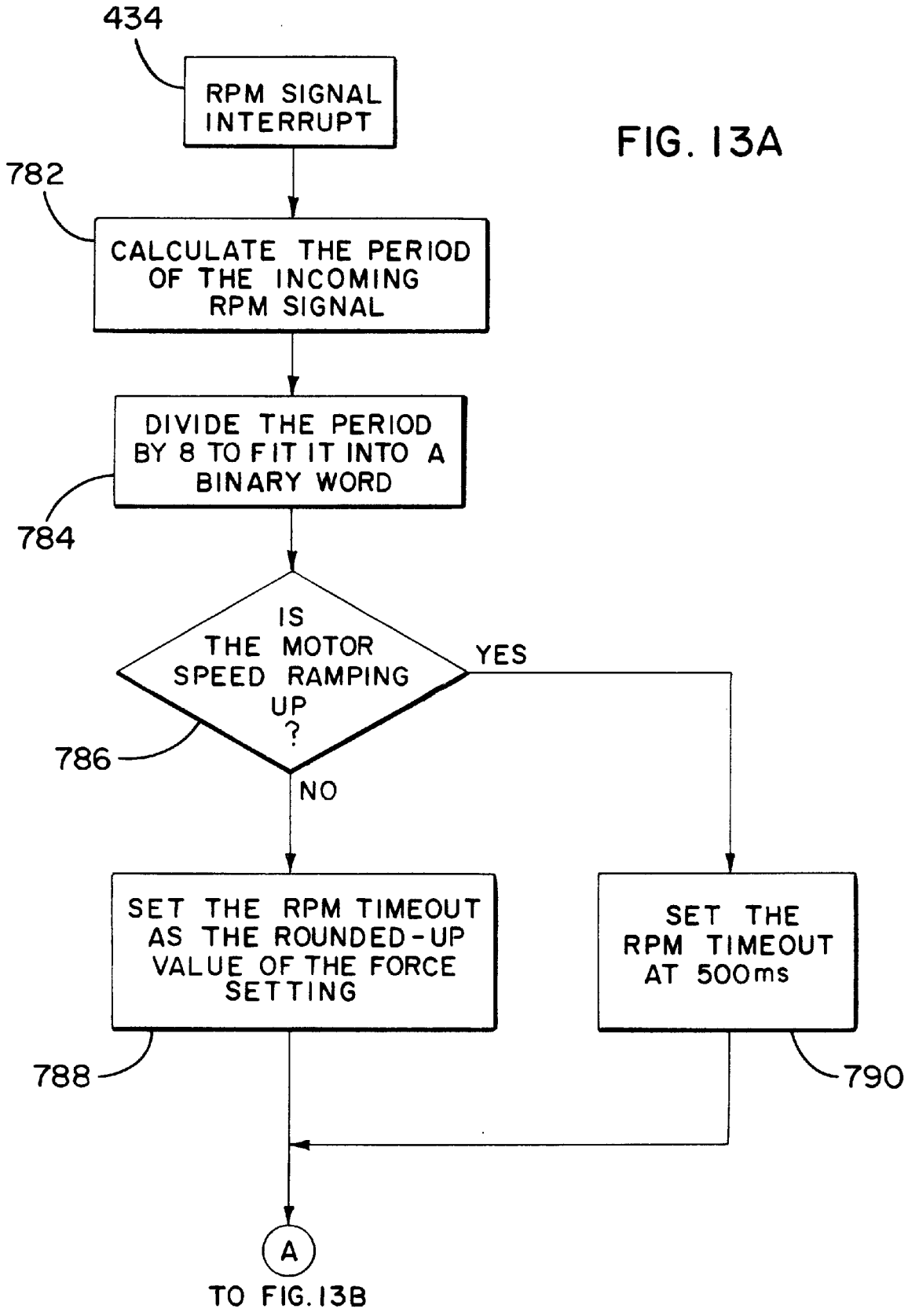
FIGS. 13A–13B are a flow chart of an RPM interrupt routine executed in the microprocessor.
Figure 13B:
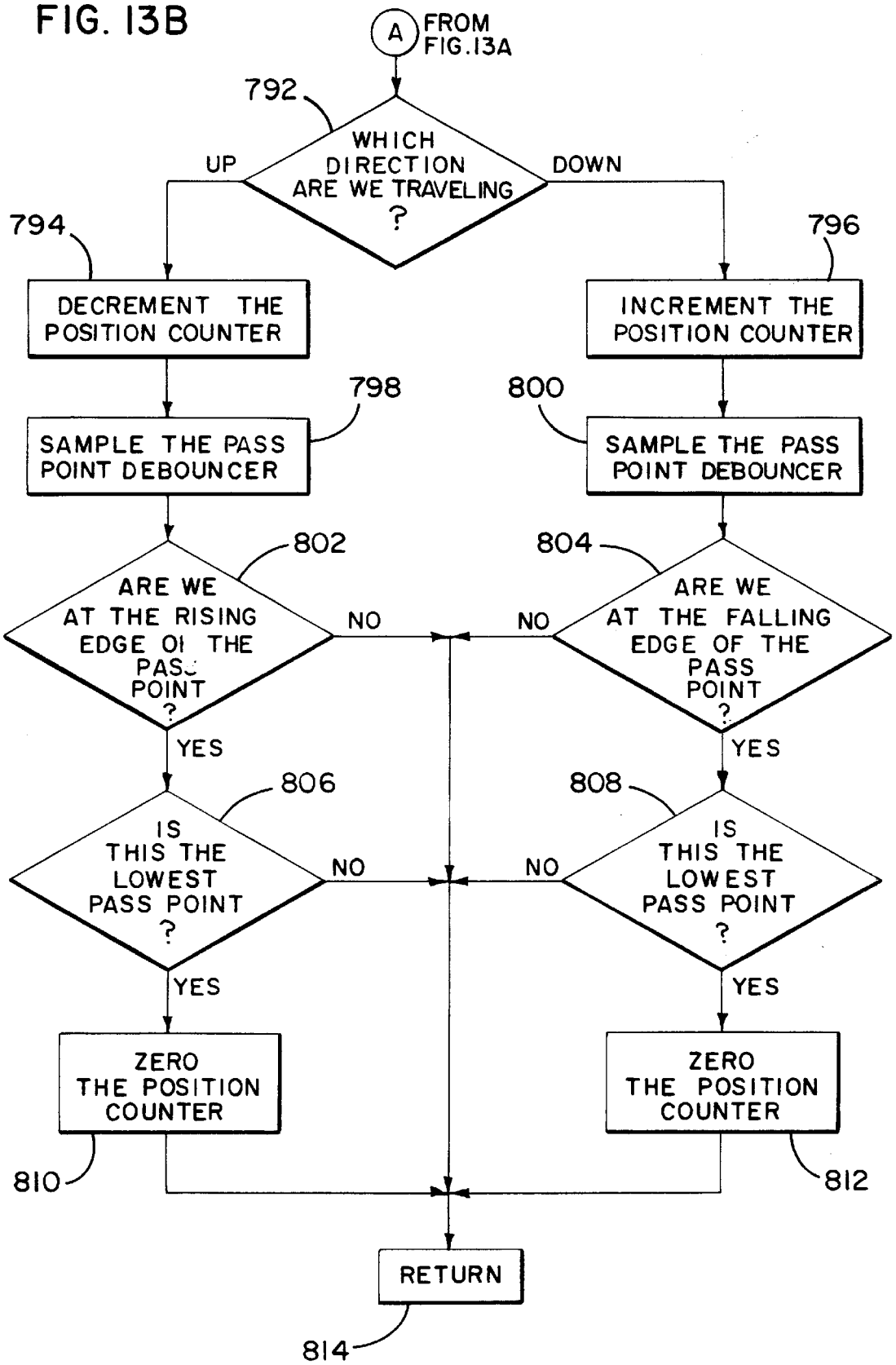

Further details of the asynchronous RPM signal interrupt, block 434, are shown in FIGS. 13A and 13B. This signal, which is provided to microprocessor 300 at pin P31, is used to control the motor speed and the position detector. Door position is determined by a value relative to the pass point. The pass point is set at 0. Positions above the pass point are negative; positions below the pass point are positive. When the door travels to the UP limit, the position detector (or counter) determines the position based on the number of RPM pulses to the UP limit number. When the door travels DOWN to the DOWN limit, the position detector counts the number of RPM pulses to the DOWN limit number. The UP and DOWN limit numbers are stored in a register.

At block 782 the RPM interrupt subroutine calculates the period of the incoming RPM signal. If the door is traveling UP, the subroutine calculates the difference between two successive pulses. If the door is traveling DOWN, the subroutine calculates the difference between two successive pulses. At block 784, the subroutine divides the period by 8 to fit into a binary word. At block 786 the subroutine checks if the motor speed is ramping up. This is the max force mode. RPM timeout will vary from 10 to 500 milliseconds. Note that these times are recommended for a DC motor. If an AC motor is used, the maximum time would be scaled down to typically 24 milliseconds. A 24 millisecond period is slower than the breakdown RPM of the motor and therefore beyond the maximum possible force of most preferred motors. If yes, the RPM timeout is set at 500 milliseconds (0.5 seconds) at block 790. If no, the subroutine sets the RPM timeout as the rounded-up value of the force setting in block 788.

At block 792 the subroutine checks for the direction of travel. This is found in the state machine register. If the door is traveling DOWN, the position counter is incremented at block 796 and the pass point debouncer is sampled at block 800. At block 804, the subroutine checks for the falling edge of the pass point signal. If the falling edge is not present, the subroutine returns at block 814. If there is a pass point falling edge, the subroutine checks for the lowest point (in cases where more than one pass point is used). If this is not the lowest pass point, the subroutine returns at block 814. If it is the only pass point or the lowest pass point, the position counter is zeroed at block 812 and the subroutine returns at block 814.

If the door is traveling UP, the subroutine decrements the position counter at block 794 and samples the pass point debouncer at block 798. Then it checks for the rising edge of the pass point signal at block 802. If there is no pass point signal rising edge, the subroutine returns at block 814. If there is, it checks for the lowest pass point at block 806. If no the subroutine returns at block 814. If yes, the subroutine zeroes the position counter at block 810 and returns at block 814.

Figure 14:
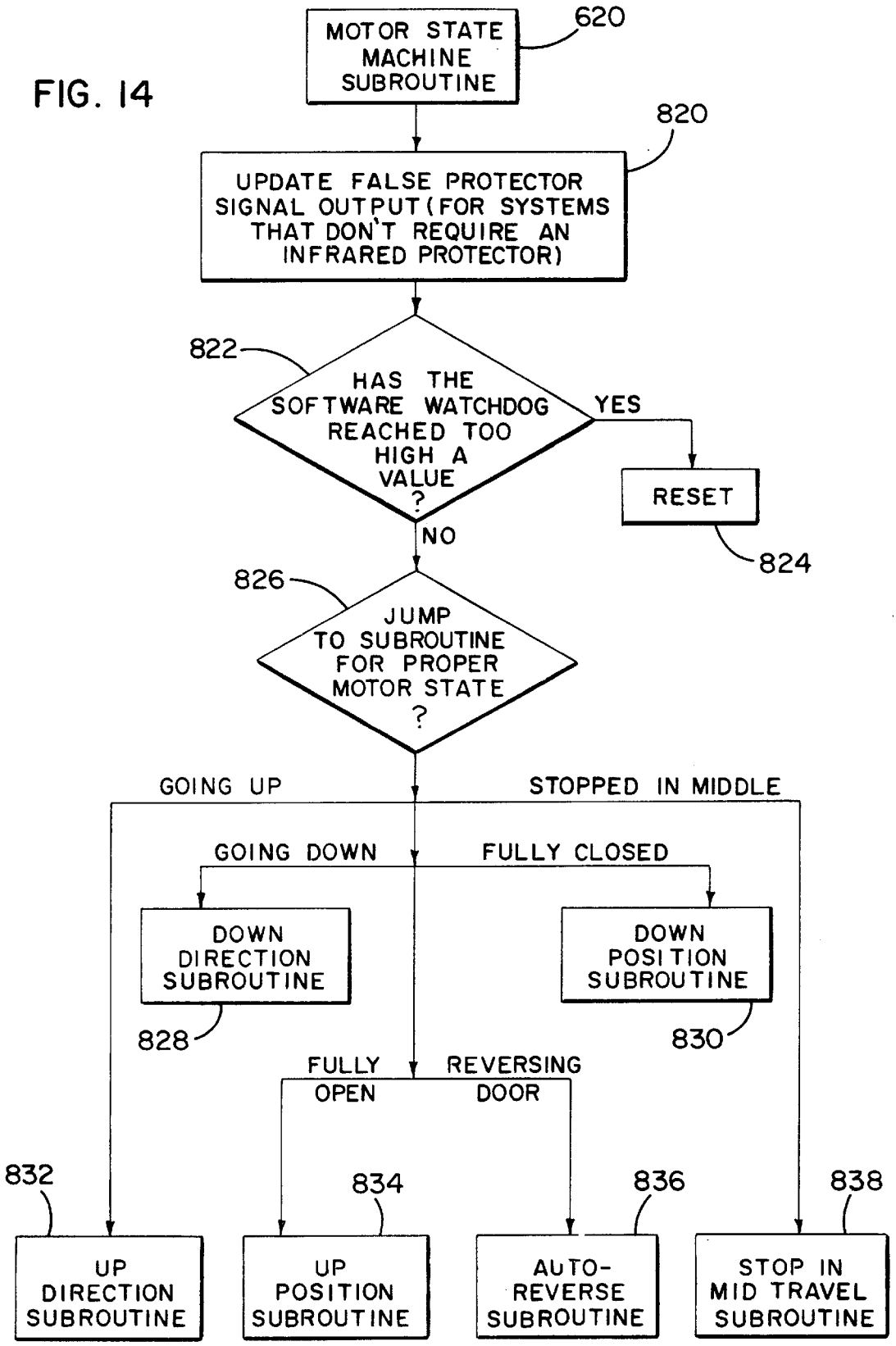
FIG. 14 is a flow chart of a motor state machine routine executed in the microprocessor.

The motor state machine subroutine, block 620, is shown in FIG. 14. It keeps track of the state of the motor. At block 820, the subroutine updates the false obstacle detector signal output, which is used in systems that do not require an infrared obstacle detector. At block 822, the subroutine checks if the software watchdog timer has reached too high a value. If yes, a system reset is commanded at block 824. If no, at block 826, it checks the state of the motor stored in the motor state register located in EEPROM 302 and executes the appropriate subroutine.

If the door is traveling UP, the UP direction subroutine at block 832 is executed. If the door is traveling DOWN, the DOWN direction subroutine is executed at block 828. If the door is stopped in the middle of the travel path, the stop in midtravel subroutine is executed at block 838. If the door is fully closed, the DOWN position subroutine is executed at block 830. If the door is fully open, the UP position subroutine is executed at block 834. If the door is reversing, the auto-reverse subroutine is executed at block 836.

Figure 15:
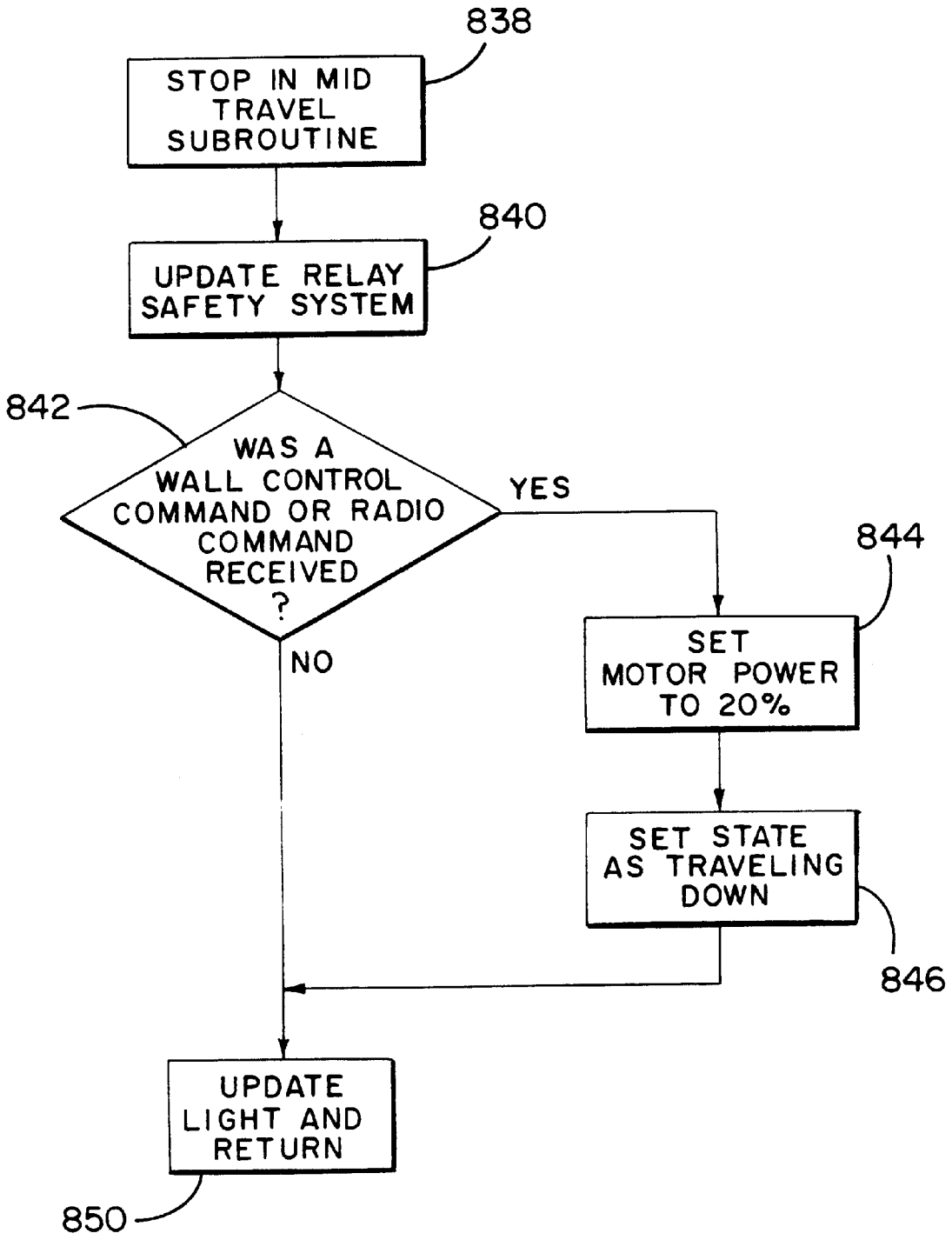
FIG. 15 is a flow chart of a stop in midtravel routine executed in the microprocessor.

When the door is stopped in midtravel, the subroutine at block 838 is called, as shown in FIG. 15. In block 840 the subroutine updates the relay safety system (ensuring that relays K1 and K2 are open). The subroutine checks in block 842 for a received wall command or radio command. If there is no received command, the subroutine updates the worklight status and returns at block 850. If yes, the motor power is set to 20 percent at block 844 and the motor state is set to traveling DOWN at block 846. The worklight status is updated and the subroutine returns at block 850. If the door is stopped in midtravel and a door command is received, the door is set to close. The next time the system calls the motor state machine subroutine, the motor state machine will call the DOWN direction subroutine. The door must close to the DOWN limit before it can be opened to the full UP limit.

Figure 16:
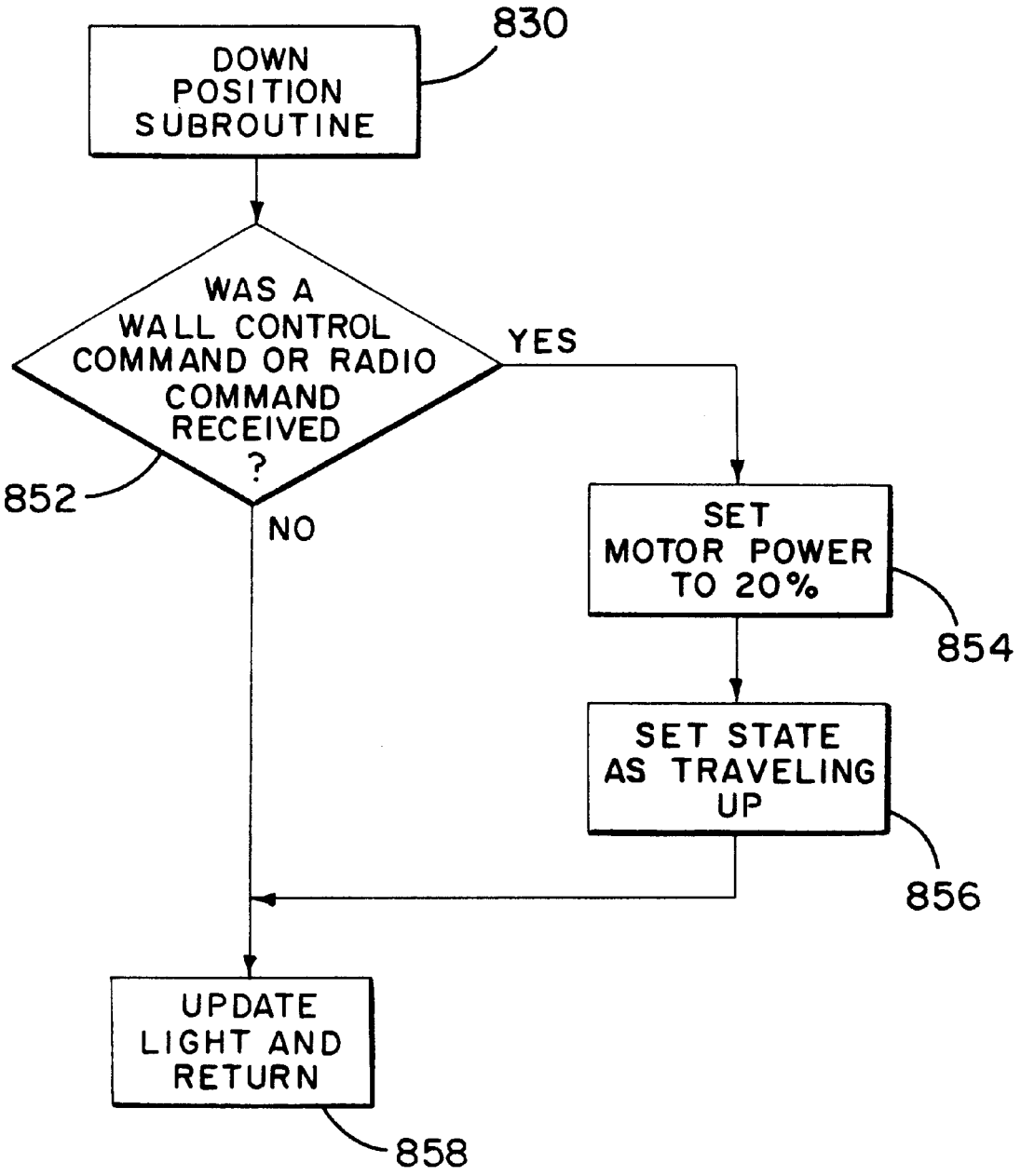
FIG. 16 is a flow chart of a DOWN position routine executed in the microprocessor.

If the state machine indicates the door is in the DOWN position (i.e. the DOWN limit position), the DOWN position subroutine, block 830, at FIG. 16 is called. When the door is in the DOWN position, the subroutine checks if a wall control or radio command has been received at block 852. If no, the subroutine updates the light and returns at block 858. If yes, the motor power is set to 20 percent at block 854 and the motor state register is set to show the state is traveling UP at block 856. The subroutine then updates the light and returns at block 858.

Figure 17A:
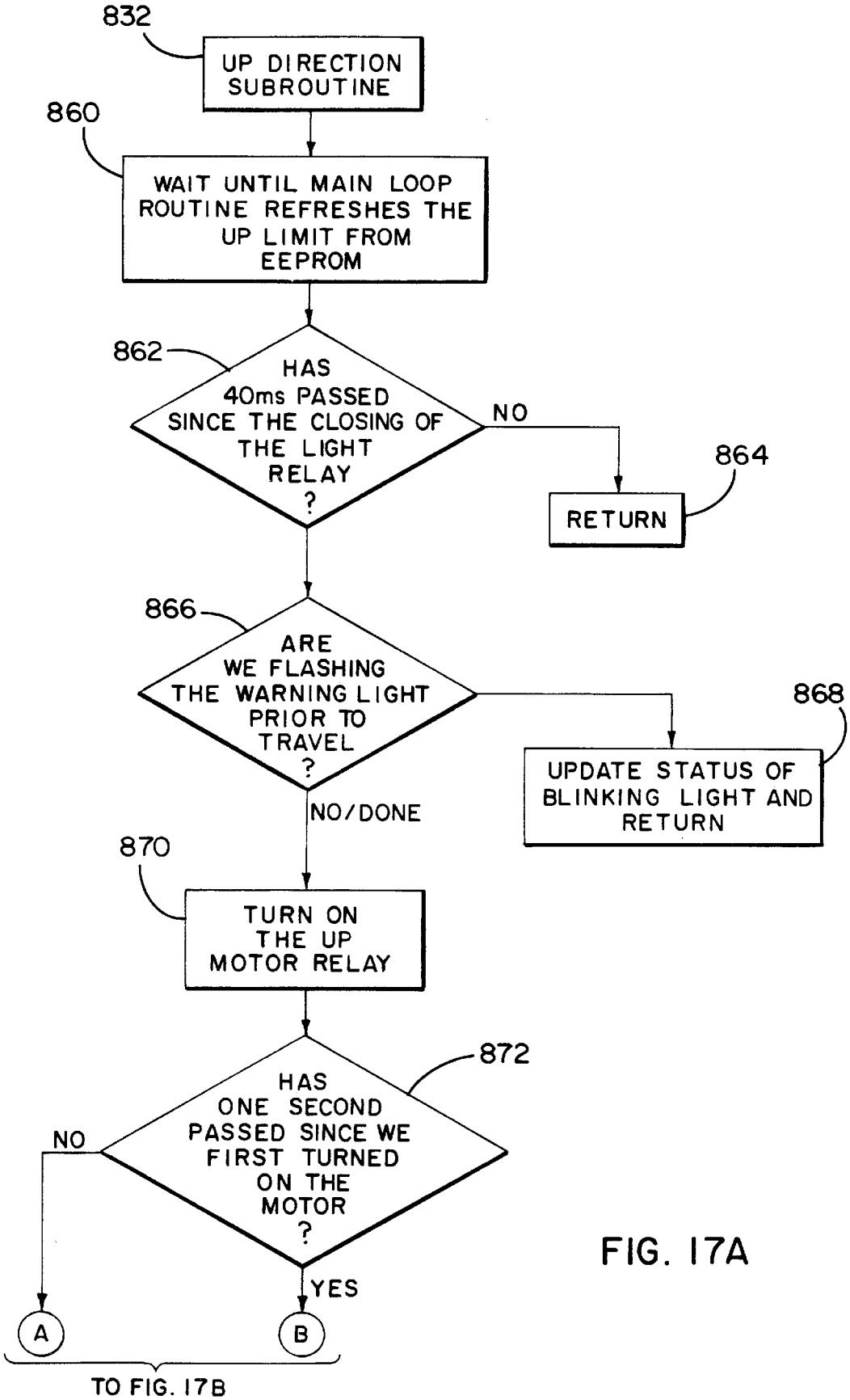
Figure 17C:
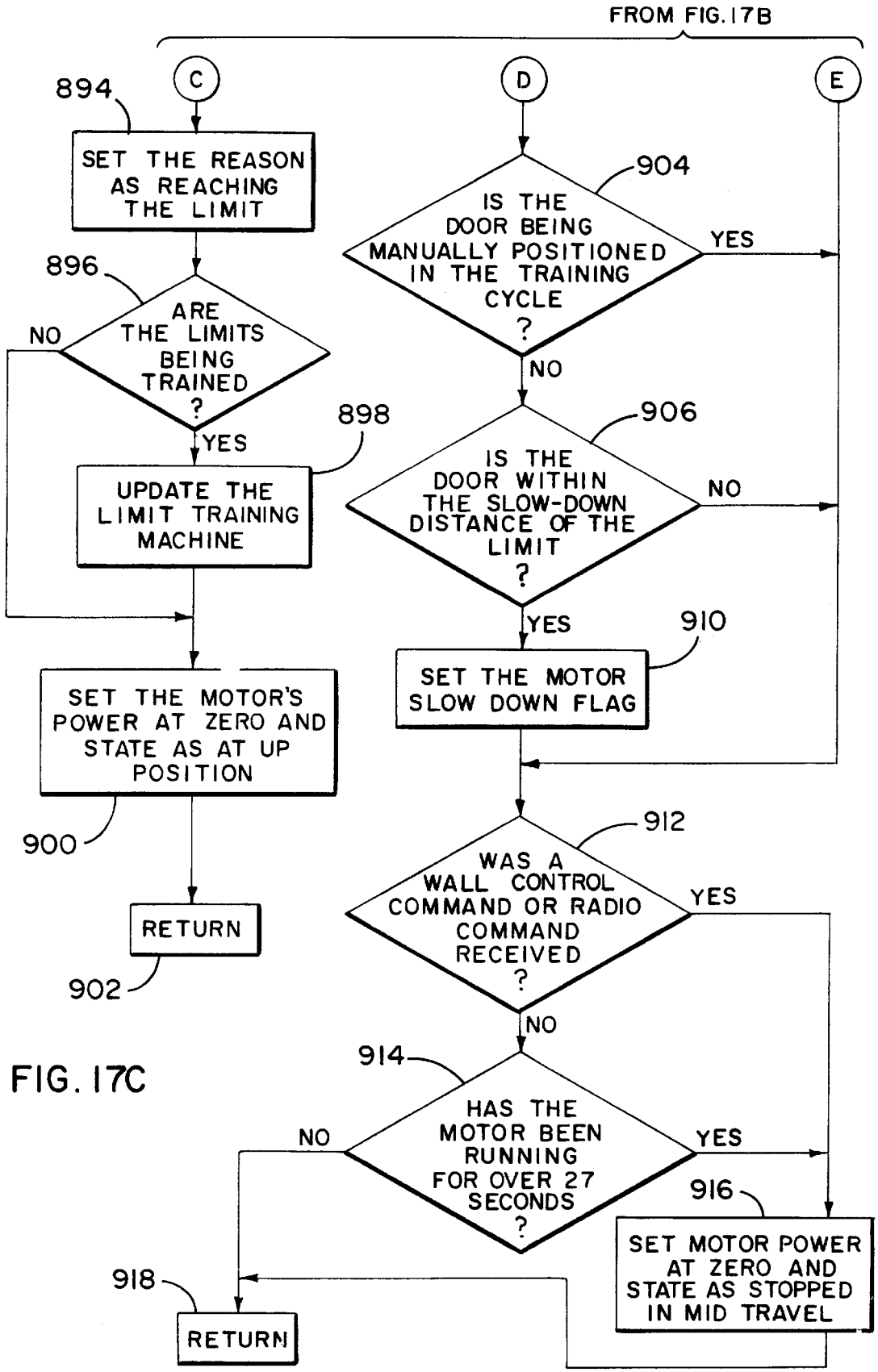

The UP direction subroutine, block 832, is shown in FIGS. 17A–17C. At block 860 the subroutine waits until the main loop refreshes the UP limit from EEPROM 302. Then it checks if 40 milliseconds have passed since closing of the light relay K3 at block 862. If not, the subroutine returns at block 864. If yes, the subroutine checks for flashing the warning light prior to travel at block 866 (only if the optional flasher module is installed). If the light is flashing, the status of the blinking light is updated and the subroutine returns at block 868. If not, or the flashing is terminated, the motor UP relay is turned on at block 870. Then the subroutine waits until 1 second has passed after the motor was turned on at block 872. If no, the subroutine skips to block 888. If yes, the subroutine checks for the RPM signal timeout at block 874. If no, the subroutine checks if the motor speed is ramping up at block 876 by checking the value of the RAMPFLAG register in RAM (i.e., UP, DOWN, FULLSPEED, STOP). If yes, the subroutine skips to block 888. If no, the subroutine checks if the measured RPM is longer than the allowable RPM period at block 878. If no, the subroutine continues at block 888.

If the RPM signal has timed out at block 874 or the measured time period is longer than allowable at block 878, the subroutine branches to block 880. At block 880, the reason is set as force obstruction. At block 882, if the training limits are being set, the training status is updated. At block 884 the motor power is set to zero and the state is set as stopped in midtravel. At block 886 the subroutine returns.

At block 888 the subroutine checks if the door's exact position is known. If it is not, the door's distance from the UP limit is updated in block 890 by subtracting the UP limit stored in RAM from the position of the door also stored in RAM. Then the subroutine checks at block 892 if the door is beyond its UP limit. If yes, the subroutine sets the reason as reaching the limit in block 894. Then the subroutine checks if the limits are being trained. If yes, the limit training machine is updated at block 898. If no, the motor's power is set as zero and the motor state is set at the UP position in block 900. Then the subroutine returns at block 902.

If the door is not beyond its UP limit, the subroutine checks if the door is being manually positioned in the training cycle at block 904. If not, the door position within the slowdown distance of the limit is checked at block 906. If yes, the motor slow down flag is set at block 910. If the door is being positioned manually at block 904 or the door is not within the slow down distance, the subroutine skips to block 912. At block 912 the subroutine checks if a wall control or radio command has been received. If yes, the motor power is set at zero and the state is set at stopped in midtravel at block 916. If no, the system checks if the motor has been running for over 27 seconds at block 914. If no, the subroutine returns at block 918. If yes, the motor power is set at zero and the motor state is set at stopped in midtravel at block 916. Then the subroutine returns at block 918.

Figure 18:
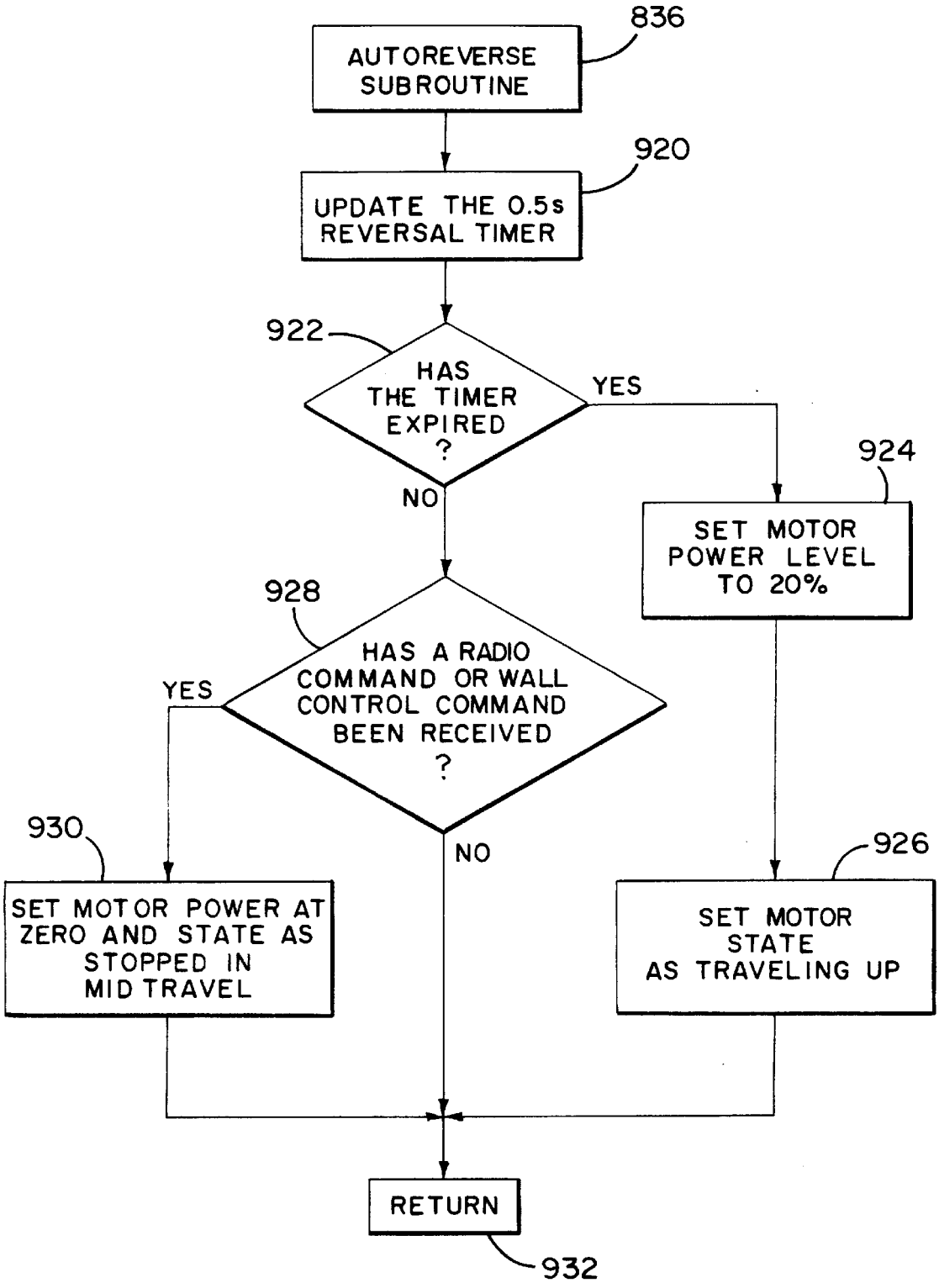
FIG. 18 is a flow chart of an auto-reverse routine executed in the microprocessor.

Referring to FIG. 18, the auto-reverse subroutine block 836 is described. (Force reversal is stopping the motor for 0.5 seconds, then traveling UP.) At block 920 the subroutine updates the 0.5 second reversal timer (the force reversal timer described above). Then the subroutine checks at block 922 for expiration of the force-reversal timer. If yes, the motor power is set to 20 percent at block 924 and the motor state is set to traveling UP at block 926 and the subroutine returns at block 932. If the timer has not expired, the subroutine checks for receipt of a wall command or radio command at block 928. If yes, the motor power is set to zero and the state is set at stopped in midtravel at block 930, then the subroutine returns at block 932. If no, the subroutine returns at block 932.

Figure 19:
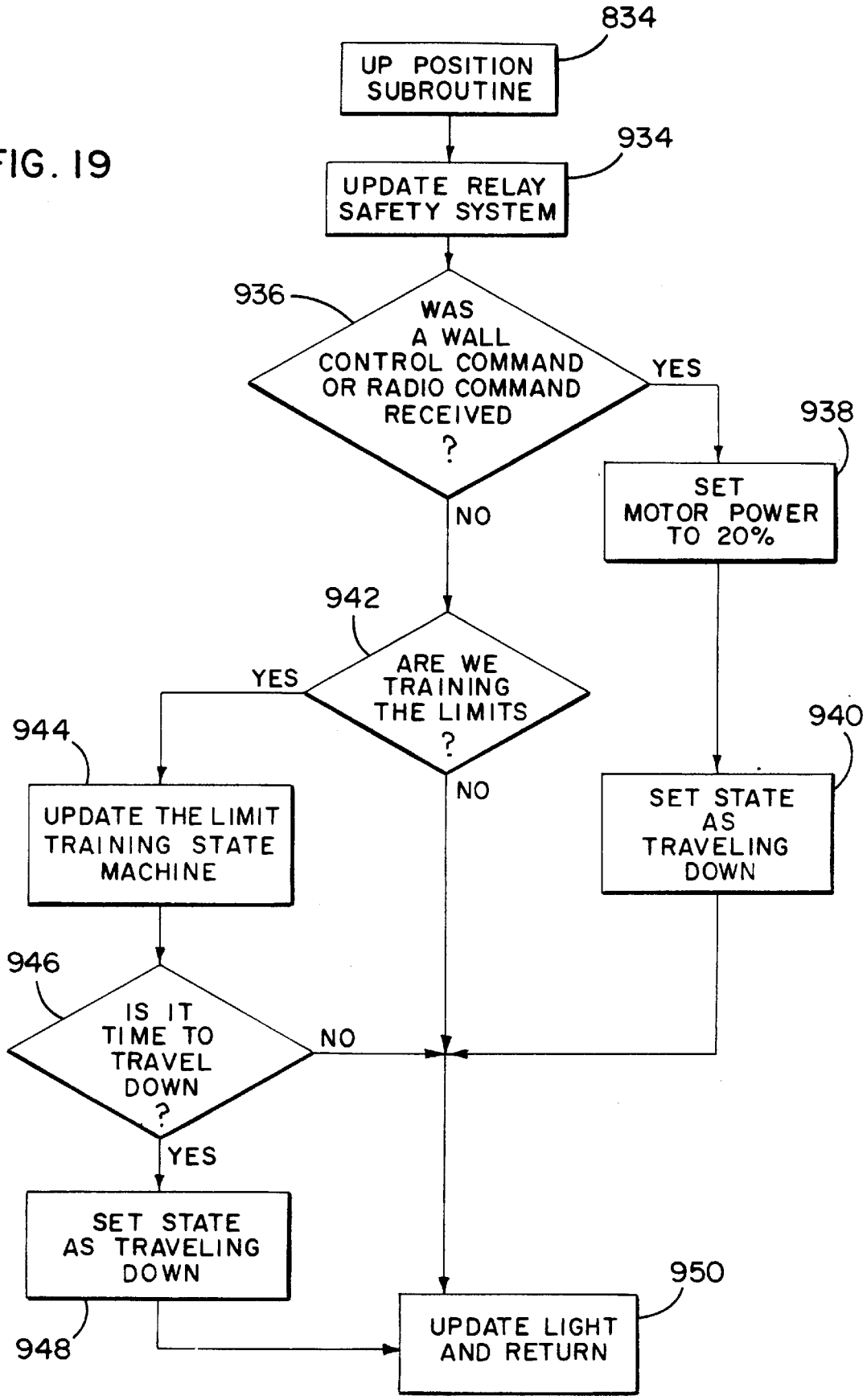
FIG. 19 is a flow chart of an UP position routine executed in the microprocessor.
Figure 20A:
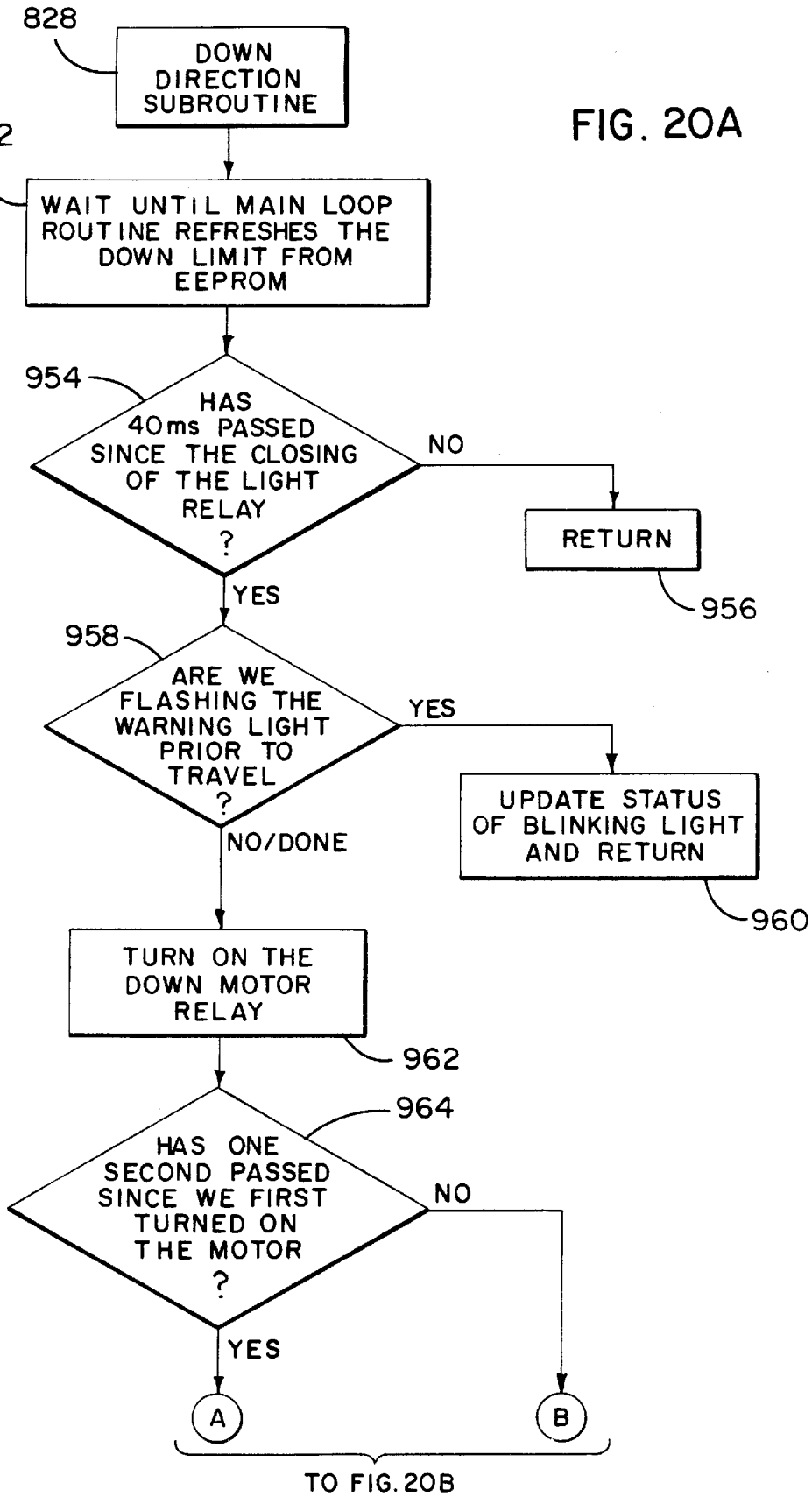
FIGS. 20A–20D are a flow chart of the DOWN direction routine executed in the microprocessor.
Figure 20B:
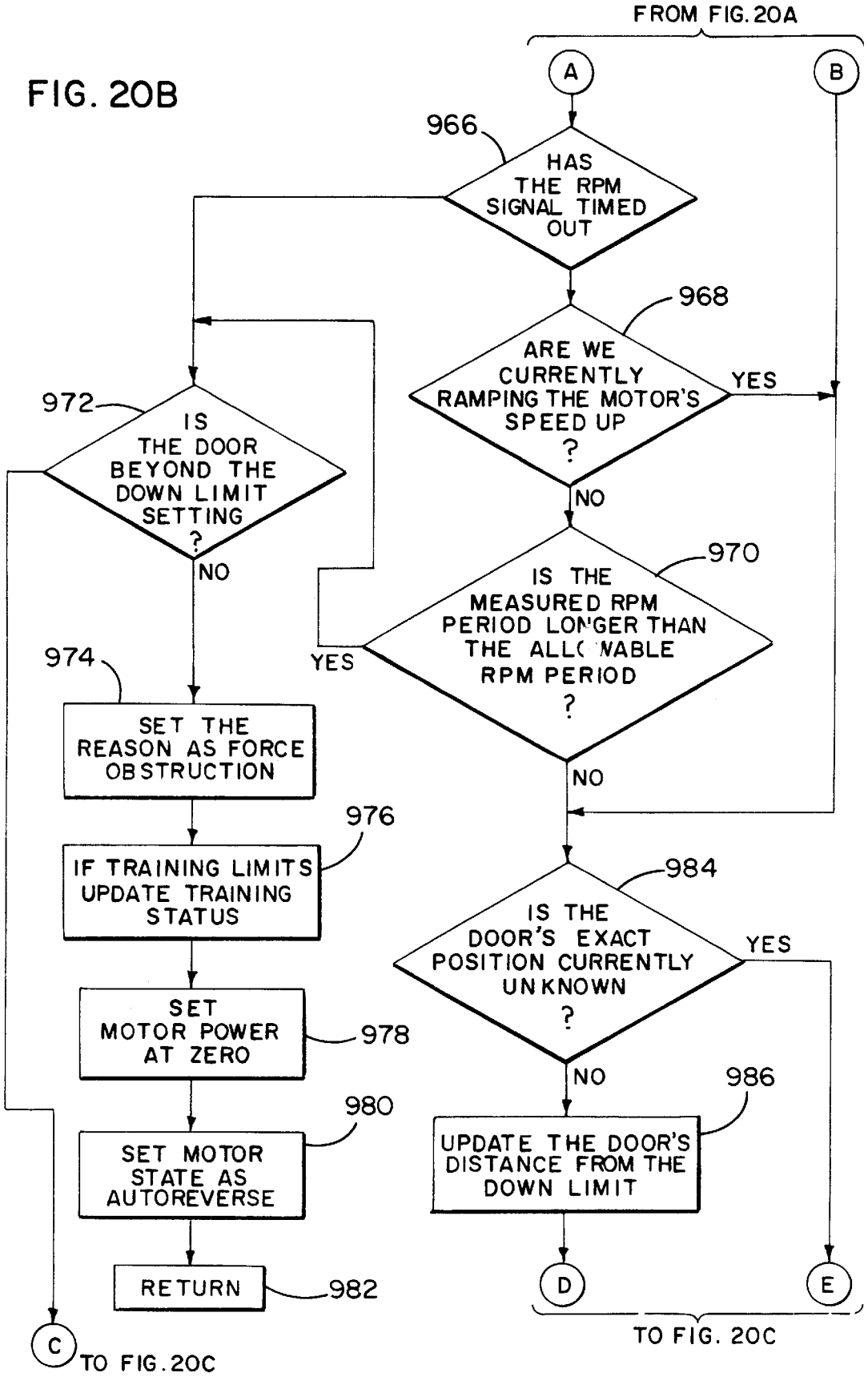
Figure 20C:
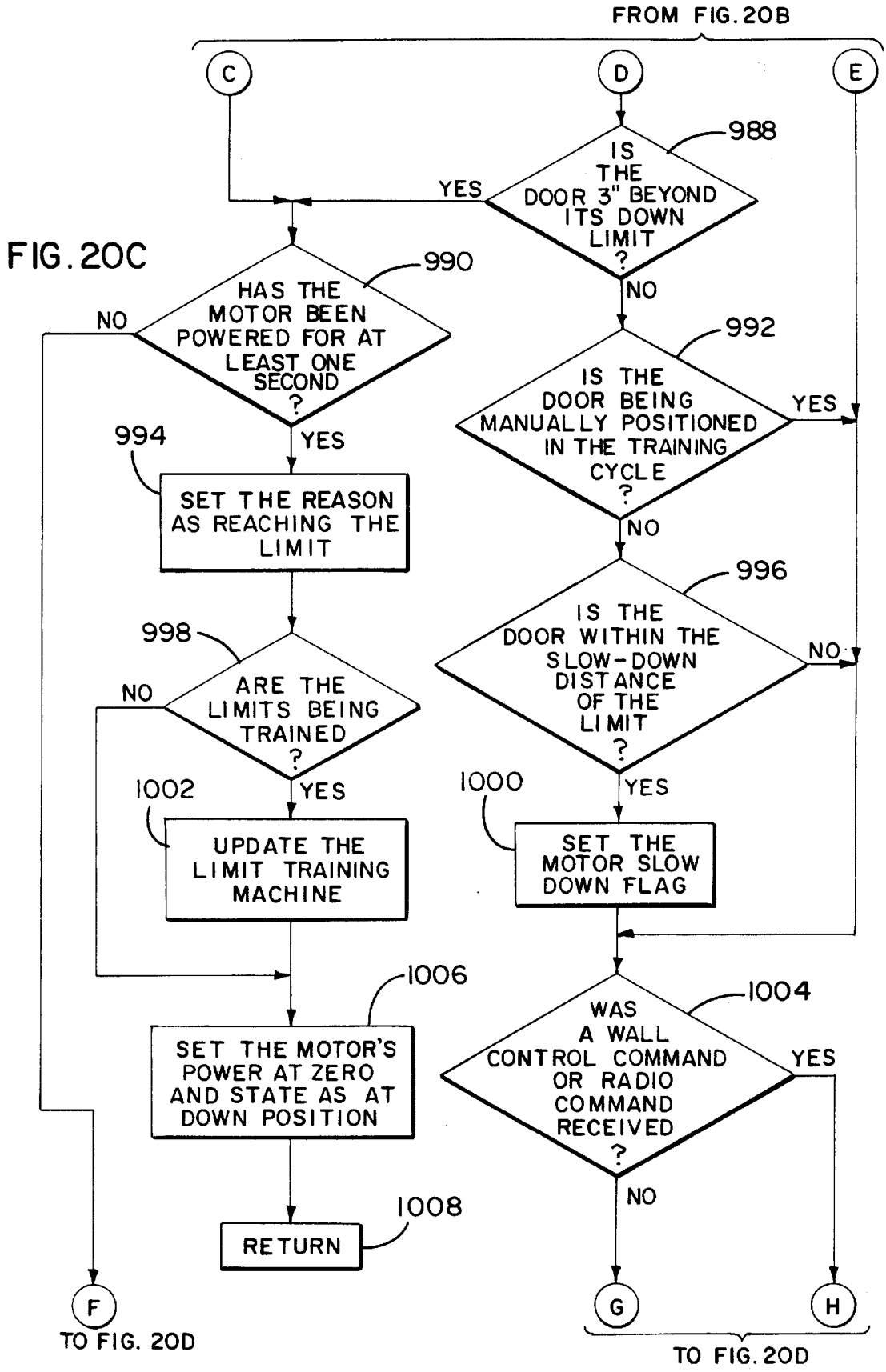
Figure 20D:
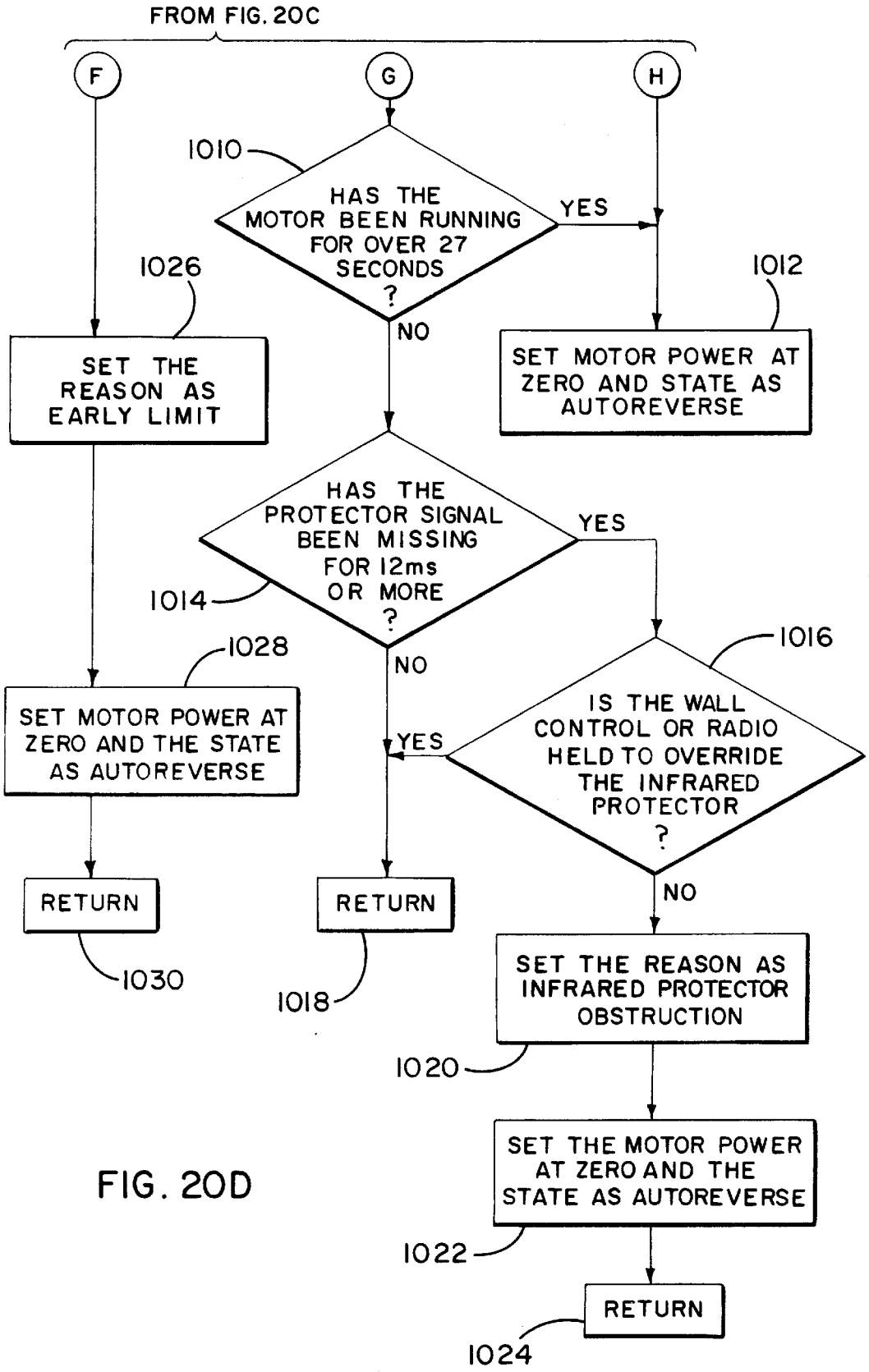

The UP position routine, block 834, is shown in FIG. 19. Door travel limits training is started with the door in the UP position. At block 934, the subroutine updates the relay safety system. Then the subroutine checks for receipt of a wall command or radio command at block 936 indicating an intervening user command. If yes, the motor power is set to 20 percent at block 938 and the state is set at traveling DOWN in block 940. Then the light is updated and the subroutine returns at block 950. If no wall command or radio command has been received, the subroutine checks for training the limits at block 942. If no, the light is updated and the subroutine returns at block 950. If yes, the limit training state machine is updated at block 944. Then the subroutine checks if it is time to travel DOWN at block 946. If no, the subroutine updates the light and returns at block 950. If it is time to travel DOWN, the state is set at traveling DOWN at block 948 and the system returns at block 950.

The DOWN direction subroutine, block 828, is shown in FIGS. 20A–20D. At block 952, the subroutine waits until the main loop routine refreshes the DOWN limit from EEPROM 302. For safety purposes, only the main loop or the remote transmitter (radio) can access data stored in or written to the EEPROM 302. Because EEPROM communication is handled within software, it is necessary to ensure that two software routines do not try to communicate with the EEPROM at the same time (and have a data collision). Therefore, EEPROM communication is allowed only in the Main Loop and in the Radio routine, with the Main loop having a busy flag to prevent the radio from communicating with the EEPROM at the same time. At block 954, the subroutine checks if 40 milliseconds has passed since closing of the light relay K3. If no, the subroutine returns at block 956. If yes, the subroutine checks if the warning light is flashing (for 2 seconds if the optional flasher module is installed) prior to travel at block 958. If yes, the subroutine updates the status of the flashing light and returns at block 960. If no, or the flashing is completed, the subroutine turns on the DOWN motor relay K2 at block 962. At block 964 the subroutine checks if one second has passed since the motor was first turned on. The system ignores the force on the motor for the first one second. This allows the motor time to overcome the inertia of the door (and exceed the programmed force settings) without having to adjust the programmed force settings for ramp up, normal travel and slow down. Force is effectively set to maximum during ramp up to overcome sticky doors.

If the one second time has not passed, the subroutine skips to block 984. If the one second time limit has passed, the subroutine checks for the RPM signal time out at block 966. If no, the subroutine checks if the motor speed is currently being ramped up at block 968 (this is a maximum force condition). If yes, the routine skips to block 984. If no, the subroutine checks if the measured RPM period is longer than the allowable RPM period. If no, the subroutine continues at block 984.

If either the RPM signal has timed out (block 966) or the RPM period is longer than allowable (block 970), this is an indication of an obstruction or the door has reached the DOWN limit position, and the subroutine skips to block 972. At block 972, the subroutine checks if the door is positioned beyond the DOWN limit setting. If it is, the subroutine skips to block 990 where it checks if the motor has been powered for at least one second. This one second power period after the DOWN limit has been reached provides for the door to close fully against the floor. This is especially important when DC motors are used. The one second period overcomes the internal braking effect of the DC motor on shut-off. Auto-reverse is disabled after the position detector reaches the DOWN limit. If the door is not positioned beyond the DOWN limit setting, the subroutine sets the reason as force obstruction at block 974, updates the training status if the operator is training limits at block 976, and sets the motor power at 0 at block 978. The motor state is set as autoreverse at block 980, and the subroutine returns at block 982.

If the subroutine determines that the door position is beyond the DOWN limit setting and if the motor as been running for one second, at block 990, the subroutine sets the reason as reaching the limit at block 994. The subroutine then checks if the limits are being trained at block 998. If yes, the limit training machine is updated at block 1002. If no, the motor's power is set to zero and the motor state is set at the DOWN position in block 1006. In block 1008 the subroutine returns.

If the motor has not been running for at least one second at block 990, the subroutine sets the reason as early limit at block 1026. Then the subroutine sets the motor power at zero and the motor state as auto-reverse at block 1028 and returns at block 1030.

Returning to block 984, the subroutine checks if the door's position is currently unknown. If yes, the subroutine skips to block 1004. If no, the subroutine updates the door's distance from the DOWN limit using internal RAM microprocessor 300 in block 986. Then the subroutine checks at block 988 if the door is three inches beyond the DOWN limit. If yes, the subroutine skips to block 990. If no, the subroutine checks if the door is being positioned manually in the training cycle at block 992. If yes, the subroutine skips to block 1004. If no, the subroutine checks if the door is within the slow DOWN distance of the limit at block 996. If no, the subroutine skips to block 1004. If yes, the subroutine sets the motor slow down flag at block 1000.

At block 1004, the subroutine checks if a wall control command or radio command has been received. If yes, the subroutine sets the motor power at zero and the state as auto-reverse at block 1012. If no, the subroutine checks if the motor has been running for over 27 seconds at block 1010. If yes, the subroutine sets the motor power at zero and the state at auto-reverse at block 1012. If no, the subroutine checks if the obstacle detector signal has been missing for 12 milliseconds or more at block 1014 indicating the presence of the obstacle or the failure of the detector. If no, the subroutine returns at block 1018. If yes, the subroutine checks if the wall control or radio signal is being held to override the infrared obstacle detector at block 1016. If yes, the subroutine returns at block 1018. If no, the subroutine sets the reason as infrared obstacle detector obstruction at block 1020. The subroutine then sets the motor power at zero and the state as auto-reverse at block 1022 and returns at block 1024. (The auto-reverse routine stops the motor for 0.5 seconds then causes the door to travel up.)

The appendix attached hereto includes a source listing of a series of routines used to operate a movable barrier operator in accordance with the present invention.

While there has been illustrated and described a particular embodiment of the present invention, it will be appreciated that numerous changes and modifications will occur to those skilled in the art, and it is intended in the appended claims to cover all those changes and modifications which followed in the true spirit and scope of the present invention.

What is claimed is:

1. A movable barrier operator having linearly variable output speed, comprising:

an electric motor having a motor output shaft;

a transmission connected to the motor output shaft to be driven thereby and to the movable barrier to be moved;

a circuit for providing a pulse signal comprising a series of pulses;

a motor control circuit responsive to the pulse signal, for starting the motor and for determining the direction of rotation of the motor output shaft; and a controller for controlling the length of the pulses in the pulse signal in accordance with a predetermined set of values, wherein in accordance with the predetermined set of values, a speed of the motor is linearly varied from zero to a maximum speed and from the maximum speed to zero.

2. A movable barrier operator according to claim 1 wherein the predetermined set of values causes incrementing of the motor speed from zero to a maximum motor speed in a plurality of steps, causing the motor to operate at the maximum speed for a predetermined period of time, then decrementing the motor speed from the maximum speed to zero in a plurality of steps.

3. A movable barrier operator according to claim 2 wherein each step comprises a value substantially corresponding to five percent of a maximum speed of the motor.

4. A movable barrier operator according to claim 1 wherein the motor control circuit comprises:

a first electromechanical switch for causing the motor output shaft to rotate in a first direction;

a second electromechanical switch for causing the motor output shaft to rotate in a second direction; and a solid state device responsive to the pulse signal, for providing current to the motor to cause it to rotate.

5. A movable barrier operator according to claim 4 wherein the first and second electromechanical switches comprise relays and the solid state device comprises an FET.

6. A movable barrier operator having linearly variable output speed, comprising:

an electric motor having a motor output shaft;

a transmission connected to the motor output shaft to be driven thereby and to the movable barrier to be moved;

a circuit for providing a pulse signal comprising a series of pulses;

a motor control circuit responsive to the pulse signal, for starting the motor and for determining the direction of rotation of the motor output shaft; and a controller for controlling the pulses in the pulse signal in accordance with a predetermined set of values, wherein in accordance with the predetermined set of values, a speed of the motor is linearly varied from zero to a maximum speed and from the maximum speed to zero.

* * * * *